US008177924B2

(12) United States Patent
Okitsu

(10) Patent No.: US 8,177,924 B2
(45) **Date of Patent: *May 15, 2012**

(54) HIGH-STRENGTH STEEL SHEET AND PROCESS FOR PRODUCING THE SAME

(75) Inventor: Yoshitaka Okitsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 358 days.

This patent is subject to a terminal disclaimer.

(21) Appl. No.: 12/302,724

(22) PCT Filed: Jun. 1, 2007

(86) PCT No.: PCT/JP2007/000590

§ 371 (c)(1),
(2), (4) Date: Nov. 26, 2008

(87) PCT Pub. No.: WO2007/138752

PCT Pub. Date: Dec. 6, 2007

(65) Prior Publication Data

US 2009/0188589 A1 Jul. 30, 2009

(30) Foreign Application Priority Data

Jun. 1, 2006 (JP) ..... 2006-153492
Jun. 1, 2006 (JP) ..... 2006-153531

(51) Int. Cl.
*C22C 38/00* (2006.01)
*C21D 11/00* (2006.01)

(52) U.S. Cl. ..... 148/320; 148/504

(58) Field of Classification Search ..... 148/320, 148/504

See application file for complete search history.

(56) References Cited

U.S. PATENT DOCUMENTS

| | | | | |
|---|---|---|---|---|
| 4,466,842 | A | 8/1984 | Yada et al. | |
| 6,221,179 | B1 | 4/2001 | Yasuhara et al. | |
| 6,638,371 | B1 * | 10/2003 | Mochida et al. | 148/320 |
| 6,682,613 | B2 | 1/2004 | Bai et al. | |
| 2004/0101432 | A1 | 5/2004 | Bai et al. | |

(Continued)

FOREIGN PATENT DOCUMENTS

JP 61-3843 A 1/1986

(Continued)

OTHER PUBLICATIONS

Supplementary European Search Report dated Feb. 23, 2010, issued in corresponding European Patent Application No. 07737246.4.

Matsumura, Yoshikazu et al.; "Evolution of Ultrafine-grained Ferrite in Hot Successive Deformation"; Transactions of the Iron and Steel Institute of Japan, vol. 27, No. 6, 1987, pp. 492-498.

(Continued)

*Primary Examiner* — Jessica L Ward
*Assistant Examiner* — Alexander Polyansky
(74) *Attorney, Agent, or Firm* — Westerman, Hattori, Daniels & Adrian, LLP

(57) ABSTRACT

A high-strength steel sheet comprises a metallic structure consisting of a ferrite phase and a hard second phase dispersed in the ferrite phase, the hard second phase in the metallic structure having an area ratio of 30 to 70%, and the ferrite of which grain sizes are not more than 1.2 μm having an area ratio of 15 to 90% in the ferrite phase. The term ds is an average grain size of the ferrite of which grain sizes are not more than 1.2 μm, the term dL is an average grain size of ferrite of which grain sizes are more than 1.2 μm, and the ds and the dL satisfy the following equation (1):

$$dL/ds \geqq 3 \quad (1).$$

8 Claims, 8 Drawing Sheets

U.S. PATENT DOCUMENTS

| | | | | |
|---|---|---|---|---|
| 2005/0155673 | A1* | 7/2005 | Soshiroda et al. | 148/333 |
| 2006/0108035 | A1 | 5/2006 | Sun | |
| 2008/0131305 | A1 | 6/2008 | Okitsu | |

FOREIGN PATENT DOCUMENTS

| | | | |
|---|---|---|---|
| JP | 62-182225 | A | 8/1987 |
| JP | 7-3381 | A | 1/1995 |
| JP | 7-188834 | A | 7/1995 |
| JP | 07252591 | A | 10/1995 |
| JP | 10-53837 | A | 2/1998 |
| JP | 11-152544 | A | 6/1999 |
| JP | 2000-73152 | A | 3/2000 |
| JP | 2002-105533 | A | 4/2002 |
| JP | 2002-285278 | A | 10/2002 |
| JP | 2006-161077 | A | 6/2006 |
| JP | 2006-316301 | A | 11/2006 |
| WO | 2006/059653 | A1 | 6/2006 |

OTHER PUBLICATIONS

Song, R et al.; "Microstructure and crystallographic texture of an ultrafine grained C-Mn steel and their evolution during warm deformation and annealing"; ACTA Materialia, vol. 53, No. 3, (Feb. 1, 2005), pp. 845-858.

Tsuji, N. et al.; "Nanoscale crystallographic analysis of ultrafine grained IF steel fabricated by ARB process"; Scripta Materialia, vol. 47, No. 2 (Jul. 1, 2002), pp. 69-76.

Tsuji, N. et al.; "Strength and ductility of ultrafine grained aluminum and iron produced by ARB and annealing"; Scripta Materialia, vol. 47, No. 12, (Dec. 1, 2002), pp. 893-899.

Tsuji, N. et al.; "Ultra-fine grained bulk steel produced by accumulative roll-bonding (ARB) process"; Scripta Materialia, vol. 40, No. 7, (Mar. 5, 1993), pp. 795-800.

International Search Report of PCT/JP2007/000590, date of mailing Sep. 4, 2007.

* cited by examiner

| | |
|---|---|
| T1 | Temperature of heating slab |
| t1 | Time of heating slab |
| T2 | Finishing temperature of rolling |
| T3 | Maintaining temperature |
| t3 | Maintaining time |
| R3 | Cooling rate |
| T4 | Winding temperature |
| t4 | Maintaining time at winding temperature |

| | |
|---|---|
| $T_S$ | Annealing temperature |
| $t_S$ | Annealing time |
| $T_Q$ | Starting temperature of rapidly cooling |
| $R_C$ | Cooling rate |
| $T_{OA}$ | Overaging temperature |
| $t_{OA}$ | Overaging time |

HIGH-STRENGTH STEEL SHEET AND PROCESS FOR PRODUCING THE SAME

TECHNICAL FIELD

The present invention relates to a cold-rolled high-strength steel sheet for automobiles, which has high strength and high ductility and is superior in press formability and absorption characteristics of impact energy, and relates to a production method therefor. The present invention also relates to a production method for high-strength steel sheets, and specifically, the present invention relates to a production technique for high-strength steel sheets for automobiles, which have a large difference between static strength and dynamic strength and high ductility in rapid deformation. The high-strength steel sheet exhibits low strength in press forming and exhibits high strength, high ductility, and high absorption characteristics of impact energy during impacts.

BACKGROUND ART

Recently, in order to satisfy conflicting requirements of improving crash safety of automobiles and decreasing the weight of automobile bodies, a steel sheet used in automobile bodies is required to have both higher strength and higher ductility. As a high-strength steel sheet that may satisfy these requirements, the following have been disclosed. A production method for high-strength steel sheets is disclosed in Japanese Unexamined Patent Application Publication No. 62-182225, and in this production method, hot-rolling, cold-rolling, and annealing are performed on a steel including 0.1 to 0.45% of C and 0.5 to 1.8% of Si under predetermined conditions. In this case, a steel sheet having a tensile strength of 82 to 113 kgf/mm$^2$ and a good ductility in which the tensile strength multiplied by elongation is not less than 2500 kgf/mm$^2$% is produced.

Another production method for a high-strength steel sheet is disclosed in Japanese Unexamined Patent Application Publication No. 7-188834, and in this production method, a steel including 0.1 to 0.4% of C and limited Si is adjusted to have a larger amount of Mn and is annealed twice under predetermined conditions. In this case, a steel sheet having a tensile strength of 811 to 1240 MPa and a high ductility in which the tensile strength multiplied by elongation is not less than 28000 MPa·% is produced.

Another production method for a high-ductility and high-strength cold-rolled steel sheet is disclosed in Japanese Unexamined Patent Application Publication No. 61-3843, and in this production method, an austenite volume fraction of a steel including 0.02 to 0.3% of C during annealing is adjusted to be in a predetermined range. In this case, a steel sheet in which a tensile strength is 48 to 151 kgf/mm$^2$ and the tensile strength multiplied by elongation is not less than 1800 kgf/mm$^2$% is produced.

Since formability of a steel sheet is decreased when strength of the steel sheet is increased, use of a high-strength steel sheet is limited to parts having a simple shape. Accordingly, in order to overcome this drawback, attempts were made to use steel sheets having large difference between static and dynamic strengths.

In general, deformation strength of a steel sheet is affected by a strain rate, and deforming stress is increased as the strain rate increases. That is, if the difference between static and dynamic strengths is large, formability of the steel sheet is ensured because the strength of the steel sheet is relatively low in press forming, whereas a sufficient strength is ensured during rapid deformation in automobile collisions.

For example, a thin steel sheet having a superior impact resistance and a production method therefor are disclosed in Japanese Unexamined Patent Application Publication No. 7-3381. In this case, in a ferrite single phase steel, amounts of solid-solved C and solid-solved N in the ferrite are decreased, and the amount of cementite is appropriately adjusted, so that the difference between static and dynamic strengths of the steel sheet is increased. A production method for high-strength steel sheets having an ultrafine structure is disclosed in Japanese Unexamined Patent Application Publication No. 2000-73152. In this case, plural metal sheets, the surfaces of which had been cleaned, are laminated, and accumulative roll-bonding is performed on the metal sheets so that ferrite grains are refined and are of sizes on the order of nanometers, that is, smaller than 1 μm. A high-strength and high-ductility steel sheet and a production method therefor are disclosed in Japanese Unexamined Patent Application Publication No. 2002-285278. In this case, the steel sheet is formed by cold rolling and annealing a martensite of a normal low carbon steel, so as to generate an ultrafine ferrite and cementite structure which have a superior balance of strength and ductility.

As described above, the principal purpose of applying a high-strength steel sheet to automobile bodies is to decrease impacts on occupants by effectively absorbing the impact energy of crashes, and the high-strength steel sheet is desirably used for more of the parts. However, the following two problems occur in trying to achieve this.

First, since the ductility of a steel sheet decreases as the strength of the steel sheet increases, press formability is decreased, and the use of the steel sheet may be limited to parts having a simple shape. Second, a member made of the steel sheet may be fractured during a crash. That is, when a head-on crash occurs, which is a major type of automobile crash, parts such as a front frame absorb the impact energy by receiving the loads in longitudinal directions thereof and buckling. At that time, if the ductility of the steel sheet is low, the material is fractured in the crash deformation, and the impact energy may not be efficiently absorbed. Therefore, a steel sheet having higher tensile strength and higher ductility compared to those of conventional steels is required. Next, problems of high-strength steel sheets produced by conventional techniques will be described.

A steel sheet having a complex structure of ferrite and residual austenite is disclosed in Japanese Unexamined Patent Application Publication No. 62-182225, and the steel sheet has a superior balance of strength and ductility, but requires addition of not less than a certain amount of Si, which deteriorates surface characteristics. In addition, 0.36% of C is required in order to obtain a steel sheet having a high strength of 1000 MPa or more, whereby the strength of spot welding is small, and tensile strength of the steel sheet will be approximately 113 kgf/mm$^2$ at most.

A production method for a high-strength steel sheet having a good balance of strength and ductility with less Si is disclosed in Japanese Unexamined Patent Application Publication No. 7-188834. In this method, the production cost is high because annealing must be performed twice, strength of spot welding is small because the amount of C is large, and tensile strength of the steel sheet is not more than 1240 MPa. A production method for a high-strength steel sheet having tensile strength of 1300 MPa or more is disclosed in Japanese Unexamined Patent Application Publication No. 61-3843. In this case, a steel sheet having tensile strength of 1500 MPa exhibits elongation that is not more than 12% and does not have a good balance of strength and ductility.

In the above conventional techniques, alloying elements are added to a steel, and the steel is heat treated so as to have a complex structure of a ferrite phase and a hard second phase such as martensite, bainite, and residual austenite, thereby increasing strength of the steel. In this case, a high-strength steel sheet having a tensile strength of 1300 MPa or more and a ductility of more than 12% cannot be obtained. Substantial amounts of alloying elements such as C, Si, and Mn are required in order to obtain a steel sheet having a tensile strength of 800 to 1300 MPa, whereby the strength of spot welding of the steel sheet is low, and the production cost and recyclability of the steel sheet are inferior. Therefore, a technique for producing steel sheets including minimized amounts of such alloying elements and having a good balance of strength and ductility is required.

The present inventors have focused on a refinement of ferrite grains as a method for strengthening steels, which is not based only on conventional methods as described above. That is, in this method, a steel sheet is strengthened by increasing the area of grain boundaries of a ferrite phase in a matrix, addition amounts of alloying elements are minimized, and the purity of the ferrite is maintained at a high level. This method is based on the idea that the difference between static and dynamic strengths of a steel sheet can be obtained by maintaining the purity of a ferrite phase so that it is as high as possible.

The relationship between the grain size and the strength is known from the Hall-Petch equation, and the deformation strength is proportional to the $-\frac{1}{2}$ the power of the grain size. According to the equation, since the strength is considerably increased when the grain size is less than 1 μm, grains of a steel sheet must be refined to be ultrafine grains having a size of not more than 1 μm so as to extremely increase the strength of the steel sheet.

The technique of appropriately adjusting the amount of cementite, which is disclosed in Japanese Unexamined Patent Application Publication No. 7-3381, is based on the idea that the difference between static and dynamic strengths can be improved by minimizing the amounts of impurity elements in a ferrite. Tensile strengths of steel sheets obtained by this method are approximately 430 MPa, which is insufficient for use as a high-strength steel sheet. Since the tensile strength of a steel sheet having a structure of a ferrite single phase cannot be greatly increased, in order to obtain a higher-strength steel sheet, the structure is generally formed so as to be a complex structure of a ferrite and a second phase such as martensite. If a steel sheet is formed so as to have a complex structure, the tensile strength thereof is improved, but the difference between static and dynamic strengths is decreased, and it is smaller than that of a steel with a ferrite single phase, which is typical as a soft steel sheet. For example, the following fact is disclosed on page 174 of "Report of Workshop on Rapid Deformation of Automobile Materials" compiled by The Iron and Steel Institute of Japan (2001). Whereas a soft steel exhibits a difference between static and dynamic strengths of 210 MPa at 5% strain, a dual phase steel which can exhibit a difference between static and dynamic strengths of 590 MPa exhibits a difference between static and dynamic strengths that is decreased to approximately 60 MPa at 5% strain. On the other hand, ductility in rapid deformation, and specifically, a uniform elongation of the dual phase steel which can exhibit the difference between static and dynamic strengths of 590 MPa are greater than those of the soft steel. Steels having high ductility at rapid deformation, such as the dual phase steel, are desirable in view of avoiding rupture of automobile parts during crashes.

Therefore, in the technique disclosed in Japanese Unexamined Patent Application Publication No. 7-3381, it is difficult to achieve both a large difference between static and dynamic strengths and a high tensile strength simultaneously, and to achieve both a large difference between static and dynamic strengths and a high ductility at rapid deformation simultaneously. Accordingly, a high-strength steel sheet having a large difference between static and dynamic strengths, high tensile strength, and high ductility at rapid deformation is desired.

Since the method of rapid deformation testing has not yet been standardized, a method such as the Hopkinson bar method, the one-bar method, and the sensing-block method have each been used, and the shape of the test specimen differs according to the method. Therefore, the yield point and the overall elongation may be different according to the method, and stress-strain diagrams obtained using different fast tensile test methods are not comparable. Moreover, a test result obtained by using a test specimen having a shape of No. 5 specified by the Japanese Industrial Standard (JIS), which is generally used in a quasi-static tensile test, and a test result obtained by using a smaller test specimen which is generally used in a fast tensile test, may be different even when the tests are performed at the same strain rate. Accordingly, test results obtained by using the same test apparatus and test specimens having the same shape and by varying only stain rate should be compared, or else the test results cannot be accurately compared. In the following descriptions relating to characteristics such as deforming stress and elongation, data of the characteristics measured by the following method will be used. That is, measurements were performed by using a sensing block type high speed material testing machine manufactured by Saginomiya Seisakusyo, Inc. and using test specimens with a shape shown in FIG. 14, and only the strain rate was varied.

The above Japanese Unexamined Patent Application Publication No. 2000-73152 may be mentioned as an example of a method of refining the grain sizes of ferrite of a steel sheet to the order of nanometers, that is, smaller than 1 μm. In this method, by repeatedly performing accumulative roll-bonding for 7 cycles, the structure becomes an ultrafine structure having grain sizes on the order of nanometers, and the tensile strength reaches 3.1 times (870 MPa) as high as that of the IF steel which was used as the raw material. However, the method has two drawbacks.

The first drawback is that a material having a structure consisting only of ultrafine grains of which the sizes are not more than 1 μm has extremely low ductility. The reason for this is described in a paper written by the inventors of Japanese Unexamined Patent Application Publication No. 2000-73152, for example, "Iron and Steel" (The Iron and Steel Institute of Japan, Vol. 88 (2002), No. 7, p. 365, FIG. 6b). According to this paper, when the grain sizes of ferrite are less than 1.2 μm, the overall elongation is suddenly decreased, and the uniform elongation is simultaneously decreased to approximately 0. Such a structure is not suitable for steel sheets to be press formed.

The second drawback is that performing the accumulative roll-bonding repeatedly in an industrial process decreases the production efficiency and greatly increases the production cost. Large strain is required for ultra-refining the grains, and for example, the grains are not ultrarefined until 97% of the strain in terms of rolling reduction is applied by performing the accumulative roll-bonding for 5 cycles. This ultra-refinement cannot be practically performed by an ordinary cold rolling in which the production efficiency is good, because the steel sheet needs to be rolled from a thickness of 32 mm to a thickness of 1 mm.

In Japanese Unexamined Patent Application Publication No. 2002-285278, by cold rolling and annealing martensite as an initial structure, the martensite forms an ultrafine ferrite and cementite structure having a good balance of strength and ductility, whereby the balance of strength and ductility of a steel sheet is improved. An invention example disclosed in Japanese Unexamined Patent Application Publication No. 2002-285278 has advantages in that the amount of C is 0.13% and is relatively small, and that addition amounts of alloying elements are small. However, the example exhibits a tensile strength of 870 MPa and an elongation of 21%, and therefore, the example does not have satisfactory characteristics.

DISCLOSURE OF THE INVENTION

The present invention has been completed in view of the above circumstances, and an object of the present invention is to provide a high-strength steel sheet and a production method therefor. By decreasing the amounts of alloying elements added and refining ferrite grains, the high-strength steel sheet is strengthened and has a superior balance of strength and ductility required in press forming and superior absorption characteristics of impact energy at rapid deformation.

In Japanese Unexamined Patent Application Publication No. 2002-285278 in which ultrafine ferrite and cementite structures are produced, an invention example has a tensile strength of 870 MPa, an elongation of 21%, and a ductility that is better than that of the ferrite single phase steel disclosed in Japanese Unexamined Patent Application Publication No. 7-3381. However, according to investigations conducted by the inventors of the present invention, a difference between static and dynamic strengths of the invention example was 80 MPa at 5% strain and was small. As described above, the difference between static and dynamic strengths cannot be sufficiently produced by using a simple ultrafine grain structure and by using a structure in which cementite is precipitated in an ultrafine grain structure.

The present invention has been completed in view of the above circumstances, and another object of the present invention is to provide a production method for high-strength steel sheets. The high-strength steel sheet is produced by refining ferrite grains. Therefore, the strength of the steel sheet is improved, the steel sheet has a large difference between static and dynamic strengths and is thereby easily press formed, and the high-strength steel sheet has superior ductility in rapid deformation and thereby absorbs large amounts of impact energy.

The present inventors have conducted intensive research regarding high-strength steel sheets which are strengthened and have superior balance of strength and ductility required in press forming, by decreasing the amounts of alloying elements added and refining ferrite grains. As a result, the inventors have come to understand that a structure of a steel sheet may be formed without a uniform ultrafine grain structure, but with a mixed structure of ferrite of which grain sizes are not more than 1.2 μm (hereinafter simply called "nanograins" in the present invention) and ferrite of which grain sizes are more than 1.2 μm (hereinafter simply called "micrograms" in the present invention). Based on this concept, the inventors have found that a high-strength steel sheet having high strength and high ductility can be obtained by appropriately selecting the kind and the ratio of a hard second phase included in the steel sheet and adjusting a structure other than the hard second phase.

The inventors also found that a high-strength steel sheet having a static strength of not less than 450 MPa, good press formability, and a large difference between static and dynamic strengths can be obtained by the above settings. Moreover, the inventors found that elongation at dynamic deformation of the above steel sheet is improved by applying strain using a method such as skin-pass rolling. Generally, the nanograin refers to a grain in which the grain size is not more than 1.0 μm and a microgram refers to a grain in which the grain size is more than 1.0 μm in the technical field of the present invention. In contrast, the critical value of grain size that divides nanograins from micrograms is defined as 1.2 μm in the present invention, as described above.

The present invention provides a high-strength steel sheet having a metallic structure consisting of a ferrite phase and a hard second phase dispersed in the steel sheet. The area ratio of the hard second phase in the metallic structure is 30 to 70%, and the area ratio of the ferrite having grain size of not more than 1.2 μm in the ferrite phase is 15 to 90%. In the ferrite phase, ds as an average grain size of ferrite having a grain size of not more than 1.2 μm, and dL as an average grain size of ferrite having a grain size of more than 1.2 μm, satisfy the following equation (1).

$$dL/ds \geqq 3 \quad (1)$$

In such a high-strength steel sheet, A(ave) as an average of Ai (i=1, 2, 3, . . . ) which is an area ratio of the hard second phase at each area, and standard deviation s, desirably satisfy the following equation (3), when 9 pieces or more of 3 μm square area are optionally selected in a cross section parallel to a rolling direction of the steel sheet.

$$s/A(ave) \leqq 0.6 \quad (3)$$

In such a high-strength steel sheet, C and at least one selected from the group consisting of Si, Mn, Cr, Mo, Ni and B are included, and C(ss) (amount of solid-solved carbon calculated by subtracting the amount of C combined with Nb, Ti, and V from the total amount of C) desirably satisfies the following equations (8) to (10) on the basis of the following equations (4) to (7). Component ratios (mass %) of the addition elements are substituted for each of the addition elements in the equations (4) to (7).

$$F_1(Q)=0.65Si+3.1Mn+2Cr+2.3Mo+0.3Ni+2000B \quad (4)$$

$$F_2(T)=735+19Si-31Mn-12Ni+17Mo+20Cr+30V-800N \quad (5)$$

$$F_3(S)=112Si+98Mn+218P+317Al+9Cr+56Mo+8Ni+1417B \quad (6)$$

$$F_4(G)=620+300C+0.5\times F_3(S) \quad (7)$$

$$F_1(Q) \geqq 6.0 \quad (8)$$

$$F_2(T) \leqq F_4(G)-20 \quad (9)$$

$$0.07 \leqq C(ss) \leqq 0.45 \quad (10)$$

Moreover, compositions desirably satisfy the following equations (13) and (14) on the basis of the following equations (11) and (12).

$$F_3(S)=112Si+98Mn+218P+317Al+9Cr+56Mo+8Ni+1417B \quad (11)$$

$$F_5(P)=500\times Nb+1000\times Ti+250\times V \quad (12)$$

$$F_3(S) \leqq 600 \quad (13)$$

$$F_5(P) \leqq 130 \quad (14)$$

Component ratios (mass %) of the addition elements are substituted for each of the addition elements in the equations (11) and (12).

Such a high-strength steel sheet desirably includes, by mass %, at least one of not more than 0.26% of Nb, not more than 0.13% of Ti, and not more than 0.52% of V, and desirably includes, by mass %, at least one of not more than 2% of P and not more than 18% of Al. Moreover, the high-strength steel sheet desirably includes, by mass %, not more than 5% of Si, not more than 5% of Mn, not more than 1.5% of Cr, not more than 0.7% of Mo, not more than 10% of Ni, and not more than 0.003% of B.

By adding 0.007 to 0.03 mass % of N, a high-strength steel sheet will have a large hardened amount of baking painting (hereinafter called amount of BH) without decreasing ductility thereof. As a result, load occurring in the high-strength steel sheet by a collision of parts is increased, and the absorption characteristics of impact energy are further improved. When a steel sheet is heat treated at 170° C. corresponding to a baking painting after the steel sheet is strained, interstitial solid solution elements fix dislocations introduced by processing and inhibit movements of the dislocations, whereby deformation resistance of the steel sheet is increased. This phenomenon is the BH (Bake Hardening) and is effective when a step of baking painting is performed on parts such as automobile parts. A method for measuring the amount of BH is prescribed in an appendix of Japan Industrial Standard (JIS) G3135 (cold-rolled high-strength steel sheet and strip with improved formability for automobile structural uses).

The present inventors have also conducted intensive research regarding a preferable production method for the above high-strength steel sheet. As a result, in order to obtain ultrafine grains by ordinary cold rolling, the inventors found the following. A crystalline structure before cold rolling is formed so as to have a complex structure of soft ferrite and a hard second phase while the ratio of the hard second phase included is set to be in an appropriate range. Cold rolling is performed at necessary rolling reduction in accordance with a distance between the hard second phases, and then annealing is performed at a temperature of more than the transformation point Ac1 and at time so as to inhibit growth of grains. As a result, a high-strength steel sheet including the above mixed structure of micrograms and nanograins as a primary phase and including a hard second phase is obtained.

The production method for the high-strength steel sheet of a first aspect of the present invention includes cold rolling a hot-rolled steel sheet consisting of a metallic structure of a ferrite phase and a hard second phase included at a ratio of 30 to 85% in a condition in which a reduction index D satisfies the following equation (16) on the basis of the following equation (15), and annealing the hot-rolled steel sheet in a condition satisfying the following equations (17) and (18).

$$D = d \times t / t_0 \quad (15)$$

(d: average distance between the hard second phases (μm), t: sheet thickness after cold rolling, $t_0$: sheet thickness between after hot rolling and before cold rolling)

$$0.50 \leqq D \leqq 1.0 \quad (16)$$

$$F_2(T) + 20 \leqq Ts \leqq F_2(T) + 90 \quad (17)$$

$$F_2(T) + 20 \leqq Ts \leqq F_4(G) - 1.3(ts)^{1/2} \quad (18)$$

(ts: maintaining time (sec), Ts: maintaining temperature (° C.), $(ts)^{1/2}$ is the square root of ts)

In such a production method for the high-strength steel sheet, the average distance between the hard second phases is desirably 2.5 to 5 μm in a direction of the sheet thickness of the hot-rolled steel sheet. Moreover, by performing skin-pass rolling on the above high-strength steel sheet at an elongation rate of not more than 2.5%, the yield point of the high-strength steel sheet is decreased, whereby the forming load in press forming is decreased, and the amount of springback is decreased.

The production method for the high-strength steel sheet of a second aspect of the present invention includes cold rolling a hot-rolled steel sheet consisting of a metallic structure of a ferrite phase and a hard second phase included at an area ratio of 10 to 85% in a condition in which a reduction index D satisfies the following equation (20) on the basis of the following equation (19), and annealing the hot-rolled steel sheet in a condition satisfying the following equation (21).

$$D = d \times t / t_0 \quad (19)$$

(d: average distance between the hard second phases (μm), t: sheet thickness after cold rolling, $t_0$: sheet thickness between after hot rolling and before cold rolling)

$$0.50 \leqq D \leqq 1.0 \quad (20)$$

$$650 - (ts)^{1/2} < Ts < 750 - (ts)^{1/2} \quad (21)$$

(ts: maintaining time (sec), Ts: maintaining temperature (° C.), $(ts)^{1/2}$ is the square root of ts)

If the area ratio of the hard second phase is small, accumulative roll-bonding is desirably performed as cold rolling by repeatedly accumulating and rolling the material after rolling. If the area ratio of the hard second phase in the hot-rolled steel sheet is 30 to 85%, sufficient effects can be obtained by ordinary cold rolling. In addition, by processing the steel sheet at an elongation rate of 1 to 10% after annealing, overall elongation of the steel sheet at rapid deformation is improved, and stress at static deformation is decreased. Skin-pass rolling is suitably used as such processing.

EFFECTS OF THE INVENTION

According to the present invention, the ratio of the hard second phase included in the steel sheet with a mixed structure of nanograins and micrograms, and a structure other than the hard second phase, are appropriately adjusted, whereby a high-strength steel sheet having high strength and high ductility is obtained. According to the first aspect of the production method for the high-strength steel sheet of the present invention, the crystalline structure before rolling is formed so as to have a complex structure of soft ferrite and a hard second phase. Then, cold rolling is performed at necessary rolling reduction in accordance with a distance between the hard second phases, and annealing is performed in a temperature range which is more than the transformation point and inhibits the growth of grains. As a result, a high-strength steel sheet including a mixed structure of micrograms and nanograins as a primary phase and including a hard second phase is produced. In the high-strength steel sheet of the present invention obtained in this way, the strength is improved by decreasing the addition amounts of alloying elements and refining the ferrite grains, and the balance of strength and ductility required in press forming, and the absorption characteristics required in crash deformation, are superior.

Moreover, according to the second aspect of the production method for the high-strength steel sheet of the present invention, the ratio of the hard second phase included in the steel sheet with a mixed structure of nanograins and micrograms, and the structure other than the hard second phase, are appropriately adjusted. Accordingly, a high-strength steel sheet, in which low strength is obtained because the effects of the nanograins are reduced during static deformation, and the effects of the nanograins are obtained at dynamic deformation, is obtained.

BEST MODE FOR CARRYING OUT THE INVENTION

1. First Embodiment

Figure 1:
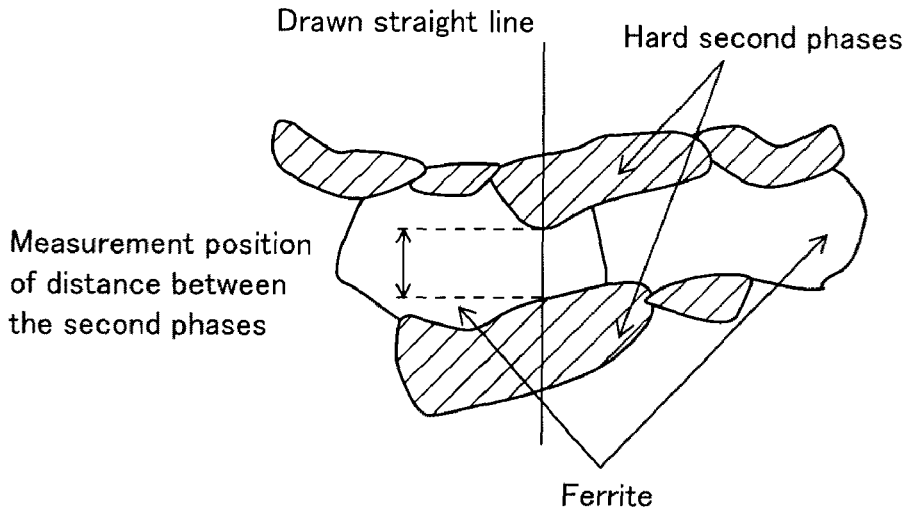
FIG. 1 is a drawing showing a frame format of a method for measuring a distance between hard second phases in a hot-rolled steel sheet.

A preferred embodiment of the present invention will be described hereinafter. First, the reasons for defining various setting equations in the high-strength steel sheet of the present invention are described. It should be noted that all of the content of each element shown in the following are in the unit of "mass %", and this is expressed only by "%" for convenience.

The amount of solid-solved carbon of the high-strength steel sheet of the present invention is desirably adjusted to be 0.07 to 0.45%. At least one selected from a first element group consisting of Si, Mn, Cr, Mo, Ni, and B is included in the carbon steel in order to increase the strength of the steel by improving the quenchability and solid solution strengthening. Moreover, at least one selected from a second group consisting of Nb, Ti, and V is included as necessary, in order to increase the strength of the steel by the refining of grains and precipitation strengthening. Furthermore, at least one selected from a third group consisting of P and Al is included as necessary, in order to increase the strength of the steel by solid solution strengthening.

The steel obtained should satisfy all of the following equations (8) to (10), (13), and (14) on the basis of the following equations (4) to (7), (11), and (12). The chemical symbols in the following equations represent component ratios (mass %) of each element, and for example, "Cr" represents a component ratio (mass %) of Cr.

$$F_1(Q)=0.65\mathrm{Si}+3.1\mathrm{Mn}+2\mathrm{Cr}+2.3\mathrm{Mo}+0.3\mathrm{Ni}+2000\mathrm{B} \quad (4)$$

$$F_2(T)=735+19\mathrm{Si}-31\mathrm{Mn}-12\mathrm{Ni}+17\mathrm{Mo}+20\mathrm{Cr}+30\mathrm{V}-800\mathrm{N} \quad (5)$$

$$F_3(S)=112\mathrm{Si}+98\mathrm{Mn}+218\mathrm{P}+317\mathrm{Al}+9\mathrm{Cr}+56\mathrm{Mo}+8\mathrm{Ni}+1417\mathrm{B} \quad (6)$$

$$F_4(G)=620+300\mathrm{C}+0.5\times F_3(S) \quad (7)$$

$$F_1(Q)\geqq 6.0 \quad (8)$$

$$F_2(T)\leqq F_4(G)-20 \quad (9)$$

$$0.07\leqq \mathrm{C}(ss)\leqq 0.45 \quad (10)$$

$$F_3(S)=112\mathrm{Si}+98\mathrm{Mn}+218\mathrm{P}+317\mathrm{Al}+9\mathrm{Cr}+56\mathrm{Mo}+8\mathrm{Ni}+1417\mathrm{B} \quad (11)$$

$$F_5(P)=500\times\mathrm{Nb}+1000\times\mathrm{Ti}+250\times\mathrm{V} \quad (12)$$

$$F_3(S)\leqq 600 \quad (13)$$

$$F_5(P)\leqq 130 \quad (14)$$

The meanings of marks in the equations and the reasons for defining each equation are described below.

Equations (4) and (8)

$F_1(Q)$ represents an index of quenchability of a steel, which is defined as shown in the equation (4) and is calculated from the component ratio (mass %) of each addition element. It is important that the metallic structure before cold rolling have a complex structure of soft ferrite and a hard second phase (at least one of martensite, bainite, and residual austenite) in the production method for the high-strength steel sheet of the present invention, which is described hereinafter.

These structures may be obtained by slowly cooling the steel until the steel has a two-phase region of ferrite and austenite after hot rolling and then rapidly cooling the steel, or by cooling the steel to room temperature after hot rolling, heating and maintaining the steel at the two-phase region of ferrite and austenite, and then rapidly cooling the steel. However, there are two problems in obtaining these structures.

First, the hard second phase is difficult to obtain because of low quenchability when the amount of C is small. Accordingly, addition of elements of the above first element group for improving the quenchability is required in order to obtain the hard second phase easily. Second, pearlite transformation tends to occur during cooling after hot rolling when the amount of C is large, and the necessary hard second phase is difficult to obtain. In order to solve these problems, the necessary amounts of the elements for improving the quenchability are added to the steel according to the equation (8). The amount of C represents the amount of solid-solved carbon calculated by subtracting the amount of C combined with Ti, Nb, and V from the total amount of C, which is described in detail hereinafter.

Equations (5) to (7) and (9)

The transformation point Ac1 of a steel material is defined by the equation (5) and is changed by the amounts of alloying elements in the steel as shown by the equation (5). The coefficient of each alloying element was selected by the present inventors according to experiments. The high-strength steel sheet is strengthened by solid solution strengthening effects of the first element group and the second element group, and the equation (6) indicates the strengthening amount by MPa and also indicates resisting power with respect to grain boundary migration of solid-solved elements during annealing.

The equation (7) indicates a lower limit of temperature for obtaining predetermined ratio of nanograins while inhibiting coarsening of grains during annealing of a steel sheet, and the above $F_3(S)$ multiplied by a coefficient and the amount of C multiplied by a coefficient are totaled. 300 C in the right-hand side is a term representing effects of C, and $0.5\times F_3(S)$ is a term representing effects of solid-solved elements other than C. The equation (9) indicates that the value of the transformation point Ac1 of a steel plus 20° C. must be not more than $F_4(G)$. As described hereinafter, in order to obtain a metallic structure of the present invention, a steel must be annealed at a temperature of not less than the transformation point Ac1 depending on the compositions of a steel plus 20° C. On the other hand, if the temperature is more than $F_4(G)$, that is, the upper limit of the temperature for inhibiting coarsening of grains, there may be no annealing conditions for obtaining ultrafine grains of the present invention. Therefore, the compositions of the steel are adjusted to satisfy the equation (9).

Equation (10)

C(ss) represents the amount of solid-solved carbon calculated by subtracting the amount of C combined with the second element group (Nb, Ti, and V) from the total amount of C, and the value thereof is calculated by the following equation (22). Component ratios (mass %) of the addition elements are substituted for each of the addition elements in the equation (22).

$$C(ss)=(\text{total amount of C})-(12/92.9\times Nb+12/47.9\times Ti+12/50.9\times V) \quad (22)$$

Each coefficient of 92.9, 47.9, and 50.9 in the equation (22) represents the atomic weight of Nb, Ti, or V, and (12/92.9×Nb+12/47.9×Ti+12/50.9×V) represents the amount of C (mass %) combined with Nb, Ti, and V and forming carbides. Therefore, the amount of solid-solved carbon is calculated by subtracting the amount of C combined with Nb, Ti, and V from the total amount of C.

The equation (10) defines an upper limit and a lower limit of the amount of the solid-solved carbon in order to produce the metallic structure in the range of the optional amount before cold rolling. The lower limit is defined as 0.07% because the hard second phase is not sufficiently produced even if the elements for improving the quenchability are added to the steel when the amount of C is less than 0.07%. If the content of the hard second phase is insufficient, grains of the steel cannot be refined on the order of nanometers unless a special method such as the above-described accumulative roll-bonding is repeatedly performed.

The upper limit is defined as 0.45% because the predetermined complex structure of ferrite and the hard second phase is not obtained when the upper limit is more than 0.45%. The nose of pearlite transformation in the CCT diagram stays on the side of the shorter time even if the elements for improving the quenchability are added when the amount of C is more than 0.45%. In this case, the nose of pearlite transformation is experienced at any cooling rate among the rapid cooling from the two-phase region of ferrite and austenite, whereby the metallic structure before cold rolling becomes a complex structure of ferrite and pearlite or a pearlite.

The pearlite has a lamellar structure including ferrite and cementite that is a compound of C and Fe, and the cementite is so brittle against deformation that the energy of cold rolling is spent on fracturing the cementite. Therefore, the soft ferrite phase, which is a feature of the production method of the present invention, cannot have a large strain when pearlite is included in the structure of the steel. Accordingly, the upper limit of the amount of C is defined as 0.45% in order to avoid pearlite transformation by adding the elements for improving the quenchability.

Equations (6), and (11) to (13)

The high-strength steel sheet is strengthened by solid solution strengthening effects of the first element group and the third element group, and $F_3(S)$ in the equation (6) represents the strengthening amount by MPa, which is calculated from mass % of the addition elements according to the equation (6). The coefficient for multiplying each element in the equation (6) is calculated by the following equation (23) on the basis of the following concept.

$$(\text{Coefficient of each element})=|r(X)-r(Fe)|/r(Fe)\times M(Fe)/M(X)\times 1000 \quad (23)$$

r(X) represents the atomic radius of each element, r(Fe) represents the atomic radius of iron, M(X) represents the atomic weight of each element, and M(Fe) represents the atomic weight of iron.

The points of the equation (23) are described as follows. That is, the difference in atomic radius between a certain element and iron is divided by the atomic radius of iron, and the quotient is proportional to the amount of solid solution strengthening with respect to the one element. In order to convert the unit of the quotient into a unit with respect to mass % of the element, the quotient is multiplied by the ratio of the atomic weight of iron to the element, and the quotient is also multiplied by 1000 to convert the unit into MPa. Physical constants of each element used and coefficients of the equation (23) calculated by using the physical constants are shown in Table 1.

TABLE 1

| | Chemical symbol | | | | | | | | |
|---|---|---|---|---|---|---|---|---|---|
| | Fe | Si % | Mn % | P % | Al % | Cr % | Mo % | Ni % | B % |
| Atomic radius r(X) | 1.24 | 1.17 | 1.12 | 1.09 | 1.43 | 1.25 | 1.36 | 1.25 | 0.9 |
| (r(X) − r(Fe))/r(Fe) | — | 0.0565 | 0.0968 | 0.1210 | 0.1532 | 0.0081 | 0.0968 | 0.0081 | 0.2742 |
| Atomic weight M(X) | 55.8 | 28.1 | 54.9 | 31.0 | 27.0 | 52.0 | 95.9 | 58.7 | 10.8 |
| M(Fe)/M(X) | — | 1.99 | 1.02 | 1.80 | 2.07 | 1.07 | 0.58 | 0.95 | 5.17 |
| Coefficient of equation (23) | — | 112 | 98 | 218 | 317 | 9 | 56 | 8 | 1417 |

The steel is strengthened by precipitation strengthening with carbides that are made from the above second element group and C in the steel, and $F_5(P)$ represents an index of the strengthening amount and is defined as shown in the above equation (12). The points of the equation (12) are described as follows. Nb, Ti, and V easily form carbides in a steel, and for example, both the solubility product of Nb and C in the steel and the solubility product (mass %)$^2$ of Ti and C are on the order of 10 to the −6th power at 700° C., and the solubility product of V and C (mass %)$^2$ is on the order of 10 to the −4th power at 700° C. Ti, Nb, and V scarcely exist as solid solutions in the high-strength steel sheet of the present invention, but may exist as carbides combined with C one-to-one, that is, NbC, TiC, or VC. Therefore, the amount of precipitation strengthening proportional to the added amounts of Nb, Ti, and V is expected.

This case is applicable when C that is not combined with Nb, Ti, or V still remains, and the expected amount of precipitation cannot be obtained if a greater amount of Nb, Ti, or V is added when all carbons are combined with Nb, Ti, or V. Moreover, the amount of precipitation strengthening varies due to sizes of the precipitates. Generally, the precipitation strengthening effect is decreased when the precipitates are coarse. As described below, the present invention does not expect to maintain the high-strength steel sheet in a high temperature range, in which the carbides tend to grow, for a long time in annealing after cold rolling. Therefore, carbides of Nb, Ti, or V are dispersed uniformly and finely in the steel, and the amount of precipitation strengthening is determined only by the addition amounts of these elements. The above equation (12) indicates this effect.

Each coefficient of 500, 1000, and 250 in the equation (12) represents the amount of precipitation strengthening with respect to 1 mass % of Nb, Ti, or V and was obtained from experiments. The total of the amounts of the precipitation strengthening of Nb, Ti, and V is represented as $F_5(P)$, that is, the total amount of precipitation strengthening. With such technical findings, the equation (13) indicates that the strengthening amount of ferrite performed by solid solution strengthening and precipitation strengthening should be 600 MPa or less. In addition, the equation (14) indicates that the strengthening amount of ferrite performed by precipitation strengthening and precipitation strengthening should be 130 MPa or less.

This is because high ductility, which is a feature of the present invention, is not obtained when the strengthening amount of the steel sheet is too large. As described above, when ferrite is greatly strengthened by adding large amounts of alloying elements, the purity of the ferrite is decreased, and the balance of strength and ductility of the ferrite is deteriorated. In the metallic structure of the high-strength steel sheet of the present invention, ductility that is higher than that of a conventional steel is obtained when the purity of the ferrite is not less than a certain degree; however, the high ductility cannot be produced when the purity of the ferrite is too low.

The present inventors have researched regarding the quantification of the purity of the ferrite necessary for producing high ductility. As a result, the inventors experimentally demonstrated that the degree of the negative effect of each addition element on the ductility is proportional to the strengthening amount of ferrite (solid solution strengthening and precipitation strengthening) with respect to unit addition amount (mass %). The inventors have conducted intensive research based on these results and have found that the upper limit of the strengthening amount of ferrite necessary for producing high ductility is 500 MPa by solid solution strengthening and is 130 MPa by precipitation strengthening. The above equations (13) and (14) define this result.

In the high-strength steel sheet of the present invention, by adding an appropriate amount of N, the amount of BH of the steel sheet will be large. The amount of BH depends on amounts of interstitial solid solution elements as represented by C and N. In the high-strength steel sheet of the present invention, there is a limit in increasing of C. As described above, when the amount of C is increased, pearlite is easily produced in the metallic structure, and a predetermined metallic structure is not easily obtained.

The present inventors have focused on N as an interstitial solid solution elements other than C. N can be included in a solid-solved state without greatly changing the metallic structure as long as the content of N is within a range in which N does not produce a compound with iron, and N effectively affects strain aging, whereby the amount of BH will be large. In the high-strength steel sheet of the present invention, the amount of BH is greater than that of a conventional steel sheet. The reason for this is not obvious, but the amount of BH may be affected by the following. The high-strength steel sheet of the present invention includes ferrite grains, most of which are nanograins of not more than 1.2 μm, and areas of grain boundaries and interfaces between ferrite and second phase are extremely large.

The grains holding grain boundaries and interfaces therebetween prevent each other from deforming, whereby the vicinities of the grain boundaries and interfaces tend to have a large dislocation density in deforming. The high-strength steel sheet of the present invention has such grain boundaries and interfaces over the entirety of the material structure, whereby the overall material has a uniform high dislocation density. Therefore, strain aging of N occurs over the entirety of the material in baking painting, and the amount of BH is thereby large.

Reasons for Defining Each Chemical Composition

The reasons for defining each chemical composition in the high-strength steel sheet of the present invention will be described hereinafter. It should be noted that all of the content of each element shown in the following have units of "mass %", but this is written as "%" for convenience. Carbon is individually defined by the equation (10), the other elements are individually defined by the equations (8), (9), (13), and (14) for the upper and lower limit in most cases, and moreover, the upper and lower limits are individually set.

C: 0.07 to 0.45% as Solid-Solved Carbon

A mixed structure of ferrite and austenite is formed at high temperature by adding carbon after hot rolling, and the hard second phase of martensite, bainite, and residual austenite is formed by rapidly cooling the mixed structure. This effect of C is also obtained in annealing after cold rolling. Therefore, carbon is the most important element in the present invention.

In the high-strength steel sheet of the present invention, Nb, Ti, and V may be added, and carbons may be precipitated as carbides. Accordingly, the addition amount of C is adjusted so that solid-solved carbon, other than the carbons precipitated as carbides, satisfies the equation (10). The metallic structure before cold rolling does not have a sufficient amount of hard second phase when the amount of the solid-solved carbon is less than 0.07% and is transformed into pearlite when the amount of the solid-solved carbon is more than 0.45%, both of which are not suitable for the production method for the high-strength steel sheet of the present invention.

The First Element Group: Si, Mn, Cr, Mo, Ni, and B

The following elements are added to the steel in order to improve the quenchability and improve the strength by solid solution strengthening. The addition amount is adjusted to satisfy the equations (8), (9), and (13). The reasons for defining the upper limit and lower limit of the addition amount of each element are described hereinafter.

Si: 0.2 to 5%

The quenchability is not greatly improved when the addition amount of Si is less than 0.2%. Therefore, the lower limit is defined as 0.2%. When the addition amount of Si is more than 5%, Si is combined with Fe, and $Fe_3Si$, which is an intermetallic compound having a crystalline structure type of D03 or B2, is produced as a stabilized phase. Since $Fe_3Si$ decreases the ductility of the steel, the upper limit is defined as 5%.

Mn: 0.1 to 5%

The quenchability is not greatly improved when the addition amount of Mn is less than 0.1%. Therefore, the lower limit is defined as 0.1%. When the addition amount of Mn is more than 5%, austenite exists as a stabilized phase at room temperature. The austenite of the stabilized phase is undesirable because austenite has low strength and decreases the strength of overall steel. Therefore, the upper limit is defined as 5%.

Cr: 0.1 to 1.5%

The quenchability is not greatly improved when the addition amount of Cr is less than 0.1%. Therefore, the lower limit is defined as 0.1%. When the addition amount of Cr is more than 1.5%, carbon in the steel and Cr combine to form carbides, whereby solid-solved chromium is not obtained in an amount corresponding to the addition amount, and quenchability may not be improved. Therefore, the upper limit is defined as 1.5% at which Cr is able to exist in a solid-solved state.

Mo: 0.1 to 0.7%

The quenchability is not greatly improved when the addition amount of Mo is less than 0.1%. Therefore, the lower limit is defined as 0.1%. When the addition amount of Mo is greater than 0.7%, carbon in the steel and Mo combine to form carbides, whereby solid-solved molybdenum is not obtained in an amount corresponding to the addition amount, and quenchability may not be improved. Therefore, the upper limit is defined as 0.7% at which Mo is able to exist in a solid-solved state.

Ni: 0.2 to 10%

The quenchability is not greatly improved when the addition amount of Ni is less than 0.2%. Therefore, the lower limit is defined as 0.2%. When the addition amount of Ni is more than 10%, austenite exists as a stabilized phase besides ferrite at room temperature. The austenite is undesirable because the austenite has low strength and decreases the strength of overall steel. Therefore, the upper limit is defined as 10%.

B: 0.0005 to 0.003%

The quenchability is not greatly improved when the addition amount of B is less than 0.0005%. Therefore, the lower limit is defined as 0.0005%. The solid solubility limit of B into the ferrite is extremely small, and B mainly segregates in the grain boundary of the steel when the addition amount of B is small. On the other hand, the areas of grain boundaries are not sufficient for B to exist when the addition amount of B is more than 0.003%, whereby $Fe_2B$, which is an intermetallic compound, is produced and decreases the ductility of the steel. Therefore, the upper limit is defined as 0.003%.

The Second Element Group: Nb, Ti, and V

The elements of the second element group are added as necessary in order to refine the grains and strengthen the steel by precipitation strengthening. The reasons for defining the upper limit and lower limit of the addition amount of each element are described hereinafter.

Nb: 0.01 to 0.26%

Nb must be added at not less than 0.01% in order to obtain the effects of refining and precipitation strengthening. When the addition amount of Nb is more than 0.26%, the amount of precipitation strengthening comes to 130 MPa only for NbC, and the equation (14) is not satisfied, whereby the upper limit of Nb is defined as 0.26%.

Ti: 0.01 to 0.13%

When the addition amount of Ti is more than 0.13%, the amount of precipitation strengthening comes to 130 MPa only for TiC, and the equation (14) is not satisfied, whereby the upper limit of Ti is defined as 0.13%.

V: 0.1 to 0.52%

When the addition amount of V is less than 0.1%, refinement of grains is not greatly performed, and when the addition amount of V is more than 0.52%, the amount of precipitation strengthening comes to 130 MPa only for VC, and the equation (14) is not satisfied, whereby the upper limit of V is defined as 0.52%.

The Third Element Group: P and Al

The elements of the third element group are added as necessary as elements for strengthening the steel. The reasons for defining the upper limit and lower limit of the addition amount of each element are described hereinafter.

P: 0.03 to 2%

Addition of P is effective as an element for solid solution strengthening of the steel, and the solid solution strengthening is not greatly performed when the addition amount of P is less than 0.03%. Therefore, the lower limit is defined as 0.03%. When the addition amount of P is more than 2%, $Fe_3P$, which is an intermetallic compound, is produced and decreases the ductility of the steel. Therefore, the upper limit is defined as 2%.

Al: 0.01 to 18%

Al is an element for solid solution strengthening and is effective as a deoxidizing agent, whereby Al is used for making a killed steel from a steel. Al combines with dissolved oxygen in the steel in the process of steelmaking and emerges as an alumina, and the ductility and the toughness of a steel is improved by removing the alumina. The functions as a deoxidizing agent and as an element for solid solution strengthening are not obtained when the addition amount is less than 0.01%. Therefore, the lower limit is defined as 0.01%. On the other hand, when the addition amount of Al is more than 18%, $Fe_3Al$, which is an intermetallic compound, is produced and decreases the ductility of the steel. Therefore, the upper limit is defined as 18%.

N: 0.007 to 0.03%

N is an element necessary for increasing the amount of BH in the high-strength steel sheet of the present invention, and N effectively increases strength of a part when a step of baking painting is performed after the high-strength steel sheet is formed into a shape of the part. Accordingly, N is added as necessary. When the addition amount of N is less than 0.007%, bake hardenability is not greatly obtained. Therefore, the lower limit of N is defined as 0.007%. On the other hand, when the addition amount of N is more than 0.03%, $Fe_4N$, which is a cubic crystal, tends to precipitate, whereby the amount of BH is not increased according to the addition amount of N. Therefore, the upper limit of N is defined as 0.03%.

Reasons for Defining the Structure

The metallic structure of the high-strength steel sheet of the present invention is described in detail.

The metallic structure of the high-strength steel sheet of the present invention should satisfy all the requirements described in the following paragraphs 1, 2, 3, and 4.

1. The metallic structure consists of a ferrite phase and a second phase (at least one or more selected from a group consisting of martensite, bainite, and residual austenite). The area ratio of the second phase is 30 to 70%, which is measured from the secondary electron image (hereinafter called a SEM image) photographed at a magnification ratio of 5000 by a scanning electron microscope, after a cross section parallel to the rolling direction of a steel sheet is cut out and is etched with a solution of nitric acid and ethanol.

2. The hard second phase is uniformly dispersed in the ferrite phase of the metallic structure, and satisfies the following requirement. That is, A(ave) as an average of Ai (i=1, 2, 3, . . . ) which is an area ratio of hard second phases at each area, and standard deviation s, preferably satisfy the following equation (24) when not less than 9 pieces of 3 μm square area are optionally selected in a SEM image of a cross section which is parallel to a rolling direction of the steel sheet and is photographed at a magnification ratio of 5000.

$$s/A(ave) \leqq 0.6 \quad (24)$$

3. In a SEM image photographed at a magnification ratio of 5000 of a cross section parallel to a rolling direction of the steel sheet, the area ratio of nanograins in ferrite portion in which the hard second phase is excluded from the total area is 15 to 90%.

4. An average grain size dS of nanograins and an average grain size dL of micrograms satisfy the following equation (25).

$$dL/dS \geqq 3 \quad (25)$$

The average grain size corresponds to a diameter of a circle measured from each area of ferrite grains, all of which are measured by image analysis in a SEM image photographed at a magnification ratio of 5000 in a cross section parallel to a rolling direction of the steel sheet. Specifically, when the area of ferrite grains measured by image analysis is defined as Si (i=1, 2, 3, . . . ), Di (i=1, 2, 3, . . . ) corresponding to a diameter of a circle is calculated by the following equation (26).

$$Di=2(Si/3.14)^{1/2} \quad (26)$$

The reasons for defining the above requirements 1 to 4 are described hereinafter. That is, by dispersing and precipitating an appropriate amount of the hard second phase uniformly, solid solution elements such as carbon are extracted from the ferrite portion to the second phase, the purity of the ferrite is increased, and the ductility of the steel is thereby increased. When the area ratio of the hard second phase is too low, characteristics of a complex structure steel cannot be obtained, and ductility is thereby low. Also, when the area ratio of the hard second phase is too high, the material characteristics of the hard second phase are obtained at a greater amount than that of the ferrite, and ductility is thereby low.

The hard second phase in the structure of the high-strength steel sheet of the present invention includes a transformed phase produced by cooling a phase that has equilibrated with ferrite during annealing, a residual phase that is not transformed, and a transformed structure obtained by annealing the transformed phase or the residual phase. Specifically, the hard second phase consists of at least one or more selected from the group consisting of martensite, bainite, and residual austenite.

The tempered bainite is included as bainite, and the tempered martensite is included as martensite. The reasons therefor are described hereinafter. The tempered bainite is a toughened structure formed by annealing bainite at 300 to 400° C. and is a mixed structure of ferrite and cementite with high dislocation density, and the mixed structure is not substantially different from bainite, whereby the tempered bainite is included as bainite in the present invention.

The tempered martensite is a toughened structure formed by annealing martensite and decreasing the hardness thereof, and the tempered martensite is included as martensite in the present invention. Tempering of martensite is a process of decomposing martensite with a supersaturated solid-solved carbon into ferrite and carbides. For example, as shown in Steel Materials, Modern Metallurgy Course, Material Volume 4, p. 39, compiled by the Japan Institute of Metals, ferrite has a high dislocation density, and a composition of packets and blocks which are characteristics of lath martensite is not changed, even though the ferrite is tempered at 300 to 500° C. Therefore, the annealed martensite still has a high degree of hardness and does not lose characteristics of martensite.

Moreover, as shown in Steel Materials, Modern Metallurgy Course, Material Volume 4, p. 39, solid-solved carbons that are supersaturated in martensite right after quenching are extremely easy to diffuse, whereby carbon migrates and starts a preparatory step of precipitation from about −100° C. Accordingly, as-quenched martensite and a tempered martensite are difficult to distinguish clearly. In view of the above circumstances, martensite and tempered martensite are included as the same structure in the present invention.

A ferrite portion except for the second phase is described hereinafter. The ferrite portion is formed so as to have a mixed structure of nanograins and micrograms that are different in sizes, whereby a steel has a superior balance of high strength and high ductility required in press forming and in collisions after the steel is made into a part.

The reason for defining the ultrafine ferrite to be not more than 1.2 μm in grain size is described below. That is, for example, as shown in "Iron and Steel" (The Iron and Steel Institute of Japan), Vol. 88 (2002), No. 7, p. 365, FIG. 6b, the material characteristics, specifically, the elongation discontinuously varies when a grain size of ferrite reaches about 1.2 μm. When the grain size of ferrite is less than 1.2 μm, the overall elongation is greatly decreased, and specifically, the uniform elongation is not performed.

The reasons for defining various kinds of equations, chemical compositions, and structures relating to the high-strength steel sheet of the present invention are mentioned above. The functions regarding effects of the high-strength steel sheet of the present invention are described in detail hereinafter.

Function Regarding Effects of the High-Strength Steel Sheet of the Present Invention Hereinafter, a function for producing high strength and high ductility is described, and the high strength and high ductility are produced by forming a primary phase so as to have a mixed structure of nanograins and micrograins of ferrite, and also by adding a hard second phase into the primary phase.

The primary phase of the high-strength steel sheet of the present invention includes a predetermined amount of nanograins, in which strength is very high and grain sizes are not more than 1.2 μm, and the primary phase exhibits extremely high deforming stress. The high-strength steel sheet has high strength but has low ductility, such as those of steels disclosed in the above-described Japanese Unexamined Patent Application Publication No. 2000-73152 and Japanese Unexamined Patent Application Publication No. 2002-285278. Accordingly, a certain rate of hard second phase is introduced to the steel other than ferrite, and not only the ultrafine grains but also a predetermined amount of micrograms having ordinary strength, are mixed with the ferrite of the primary phase.

First, the reason for introducing the hard second phase will be described. The structure of the high-strength steel sheet of the present invention is a complex structure basically including a soft primary phase and a hard second phase, and the structure may be deformed in a similar manner as that of an ordinary complex structure steel. In deforming a steel sheet including a complex structure, ferrite of a soft primary phase is preferentially deformed. When the steel sheet is further deformed, since the hard second phase dispersed in the structure is not easily deformed, most of the macro strain of the material is received by the ferrite of the primary phase, whereby the ferrite is further deformed and is greatly work hardened.

If the amount of work hardening is large, strain spreads to a wide area, and a local neck is thereby not easily produced, whereby ductility is increased. The present invention is based on such phenomenon of deformation of a complex structure steel and provides a high-strength steel sheet having the following two characteristics according to a new concept. In the high-strength steel sheet of the present invention, ferrite of a primary phase is strengthened by minimizing amounts of alloying elements and refining grains, and the ferrite of the primary phase is a mixed structure of nanograins, which have very high strength and grain sizes of 1.2 μm, and micrograins which have ordinary strength and grain sizes of more than 1.2 μm.

First, the effects of the former characteristic, that is, minimizing amounts of alloying elements, will be described. When an element for solid solution strengthening (as represented by Mn, Si, and P) or an element for precipitation strengthening (as represented by Nb and Ti) is added to an ordinary complex structure steel, the strength of ferrite is increased, and strength of the steel is thereby increased. On the other hand, dislocations introduced by deformation tend to localize at interfaces of iron in the primary phase and alloying element and interfaces of the primary phase and precipitates, which will be a starting point for rupture. As a result, the balance of strength and ductility of the steel is not much improved.

The latter characteristic in which the primary phase is a mixed structure of nanograins and micrograins is a distinctive feature of the present invention. The inventors have researched a relationship between a structure of ultrafine grains having a complex structure and mechanical characteristics by using an original method for producing a structure of nanograins by ordinary rolling annealing that will be described hereinafter. The inventors have found that when ferrite of a primary phase consists only of nanograins having grain sizes of not more than 1.2 μm, ductility will be improved more than that of a material of ultrafine grains having ferrite single phase, but the effects are small. In addition, when micrograms having ordinary strength are added to the primary phase in certain amounts, steels have highly preferable balances of strength and ductility.

As described above, the structure of ultrafine grains exhibits high strength but exhibits small amount of work hardening, whereby ductility of a steel is low, and specifically, uniform elongation is scarcely obtained. When a hard second phase is added to such a structure, the effects of the primary phase having small ductility are large, and the ductility of overall steel is not greatly improved. This is because the primary phase consisting only of ultrafine grains is bound by grain boundaries and cannot be greatly deformed, and strain localizes in the vicinity of the grain boundaries less often than localization of strain at interfaces of precipitates and the primary phase and interfaces of iron and solid solution elements, which will be a starting point for rupture.

On the other hand, by adding micrograms to the ferrite of the primary phase in a certain range, the ductility of the steel was extremely improved. The reason for this is not obvious, but the following may be assumed. Since micrograms do not greatly improve the strength, but do exhibit high deformability, when the micrograms exist in the ferrite of the primary phase, the micrograms may compensate for small deformability in the vicinity of nanograin portions. Therefore, the primary phase is macroscopically deformed, and micrograms are greatly work hardened by concentration of strain. As a result, generation of voids, which will be a starting point for rupture, is inhibited, and the strain spreads to the entirety of crystal structure.

The above phenomenon occurs when the ratio of nanograins in the ferrite of the primary phase is 15 to 90%, and the area ratio of the hard second phase in the structure of the steel is 30 to 70%. When the ratio of nanograins in the ferrite of the primary phase is more than 90%, the ductility is not much improved as described above, and when the ratio of nanograins in the ferrite of the primary phase is less than 15%, the ferrite is not sufficiently improved by refining of grains and is not greatly strengthened.

When the area ratio of the hard second phase in the structure of the steel is less than 30%, the characteristics of the complex structure cannot be greatly obtained and are not superior to the characteristics of the structure consisting of the ferrite single phase (ductility of the steel is decreased). On the other hand, when the area ratio of the hard second phase in the structure of the steel is greater than 70%, the deformation characteristics of the hard second phase becomes obvious, whereby the yield point is raised, and the ductility is decreased.

The above descriptions are regarding the high-strength steel sheet of the present invention, and a first embodiment of a method for suitably producing high-strength steel sheets will be described hereinafter. The first example of the production method for the high-strength steel sheet of the present invention is produced by an ordinary production process for cold-rolled steel sheets, that is, steps of slab ingot, hot rolling, cold rolling, and annealing.

Slab Ingot

Slab ingot is performed by an ordinary method using predetermined compositions. Industrially, ingot irons are directly used, or cold iron sources such as commercial scraps and intermediate scraps yielded in a production process for steels are melted in an electric furnace or a steel converter and then refined in oxygen, and they are cast by continuous casting or batch casting. In small facilitates such as a pilot plant or a laboratory, raw materials of iron such as electrolytic iron and scraps are melted in a heating furnace in a vacuum or in air, and they are cast into a mold after adding certain alloying elements, thereby yielding raw materials.

Hot Rolling

Hot rolling is a first important step in the first example of the production method for the high-strength steel sheet of the present invention. In the production method for the present invention, the crystalline structures after hot rolling are made to have a complex structure of a main phase of ferrite and a hard second phase of which the area ratio is in a range of 30 to 85%, and the average distance between the hard second phases measured in the direction of sheet thickness is 2.5 to 5 μm. The hard second phase mentioned here is a hard second phase of a final structure of the high-strength steel sheet of the present invention without cementite, and the hard second phase is at least one of martensite, bainite, and residual austenite. When the hard second phase consists of cementite or pearlite, the metallic structure of the high-strength steel sheet of the present invention cannot be obtained The reasons for selecting the above hard second phase are described below.

The metallic structure of the high-strength steel sheet of the present invention has nanograins of which the area ratio is 15 to 90% in the ferrite phase. The following treatments are performed in order to obtain the metallic structure. That is, the metallic structure before cold rolling is formed so as to have a complex structure of ferrite and the hard second phase. Then, a large shear strain is applied to the soft ferrite by cold rolling. Finally, the soft ferrite is annealed to have nanograins of which grain sizes are not more than 1.2 μm.

The hard second phase (at least one of martensite, bainite, and residual austenite), which existed before cold rolling, is transformed by cold rolling, but shear strain in the second hard phase is not so large as that in the ferrite portion. Therefore, nanograins are not produced in the annealing step after cold rolling. The hard second phase transforms into ferrite precipitating cementite or goes through an ordinary process of static recrystallization in which cores of new ferrite grains with little strain are produced and grown, whereby the hard second phase becomes micrograms in which grain sizes are on the order of micrometers. Thus, a mixed structure of nanograins and micrograms is obtained.

The hard second phase should have higher hardness than that of ferrite in the matrix and have a structure so as to be transformed into ferrite after cold rolling and annealing. That is, the hard second phase required in the present invention is not a simple structure of carbide such as cementite, but is a structure with a high degree of hardness, which is mainly made of ferrite or austenite.

The reason that martensite, bainite, and residual austenite are suitable for the hard second phase of the present invention is described below. Martensite is ferrite comprising supersaturated carbon, and the degree of hardness is high because the dislocation density is high due to the strain in the crystal area applied by carbon. The content of carbon in the martensite is up to about 0.8%, which is the carbon concentration at the eutectic of Fe and $Fe_3C$ in a phase equilibrium diagram of Fe—C, and which is less than that of cementite represented by the chemical formula $Fe_3C$. Therefore, in an annealing step after cold rolling, the martensite is transformed into ferrite precipitating cementite. Accordingly, martensite satisfies the requirement for the hard second phase of the present invention that the structure be mainly made of ferrite and have a high degree of hardness.

Bainite is a structure transformed at a slightly higher temperature than the temperature at which martensitic transformation starts, and bainite has a mixed structure of feather or acicular ferrite and fine cementite. Bainite includes a large amount of dislocation in the ferrite portion, which is not as great as that in martensite (see Steel Materials, Modern Metallurgy Course, Material Volume 4, p. 35, compiled by the Japan Institute of Metals), and not only the cementite but also the ferrite portion with high dislocation density has a high degree of hardness. Accordingly, bainite satisfies the requirement for the hard second phase of the present invention that the structure be mainly made of ferrite and have a high degree of hardness.

Bainite is a mixed structure of ferrite and cementite, which is clearly described in the above, and the whole structure of the cementite and the ferrite portion with high dislocation density may be regarded as a hard second phase, thereby clearly being differentiated from cementite which exists alone as a hard second phase in the ferrite matrix with low dislocation density.

Bainite and cementite are clearly distinguished by observation of metallic structure. When a cross section of a steel is observed through a light microscope after polishing and etching, in the bainite structure, portions of acicular ferrite are observed to be dark because of high dislocation density, and a ferrite matrix with low dislocation density around the acicular ferrite is observed to be light. On the other hand, the structure with only cementite is observed as a spherical precipitation phase of gray in a light ferrite matrix.

The residual austenite is transformed into martensite by strain-induced transformation due to the strain applied in the step of rolling, and the residual austenite has the same effect as that of the martensite. Moreover, the transformation of the structure of the residual austenite during an annealing step after cold rolling is the same as that of the martensite. Accordingly, the residual austenite satisfies the requirement for the hard second phase of the present invention.

A case in which the hard second phase consists only of cementite or pearlite is described. The pearlite is a mixed structure including ferrite and cementite in the form of laminae, and the lamellar cementite functions as a hard second phase. Therefore, the case of the hard second phase consisting of cementite and the case of the hard second phase consisting of pearlite are substantially the same. When the hard second phase consists of cementite, the soft ferrite portion, which is a feature of the present invention, is difficult to have large shear strain by cold rolling. This is because the cementite is extremely brittle against deformation, and the energy of cold rolling is used for rupturing the cementite, whereby the ferrite is not effectively applied with strain.

Nanograins are produced by cold rolling at high reduction such that the rolling reduction is 85% or more. In this case, however, because the transformation at the step of annealing after cold rolling greatly differs from the case in which the second hard phase includes martensite, bainite, or residual austenite, a mixed structure of nanograins and micrograms, which is a feature of the present invention, is not obtained. When the annealing temperature is not more than the transformation temperature Ac1 in the annealing step after cold rolling with high reduction, the cementite existing as a metastable phase is transformed into a spherical shape in the case in which the cementite is lamellar, but it still remains as cementite. Therefore, the structure after annealing is ferrite of nanograins and cementite, and a mixed structure that is a feature of the steel of the present invention is not obtained. Accordingly, the steel exhibits high strength but does not exhibit good ductility.

When the annealing temperature is not less than the transformation temperature Ac1, the cementite portion having an extremely high concentration of carbon is preferentially transformed into austenite, and it is then transformed into a mixed structure of at least one selected from the group consisting of pearlite, martensite, bainite, and residual austenite in the following cooling step. As a result, a mixed structure of ferrite, which is nanograins, and of the above transformation structure, is produced, and high ductility, which is a feature of the steel of the present invention, is not obtained. In the final metallic structure of the steel of the present invention, it is important that the ferrite phase be a mixed structure of nanograins and micrograins.

In order to form the ferrite phase to be such a mixed structure, the hard second phase in a hot-rolled steel sheet must be appropriately selected, the area ratio of the hard second phase must be set to be 30 to 85%, and the average distance between the hard second phases must be set to be 2.5 to 5 μm. Then, as described hereinafter, cold rolling is performed at a predetermined rolling reduction corresponding to the distance between the hard second phases, and then annealing is performed at a temperature, which is higher than the transformation point Ac1 and inhibits growth of grains, for a certain time. Thus, a high-strength steel sheet including the above mixed structure of micrograms and nanograins as a primary phase and including a hard second phase is obtained.

Reasons for defining the area ratio of the hard second phase in the hot-rolled steel sheet will be described. When the area ratio of the hard second phase is less than 30% or is more than 85%, sufficient amount of nanograins cannot be obtained after cold rolling and annealing. The inventors have researched the function of the production of nanograins, which occurs when cold rolling and annealing are performed on a hot-rolled steel sheet including ferrite and hard second phase, by the EBSD (Electron Backscatter Diffraction) method using a SEM with high resolution. As a result, the inventors have found that tiny grains having an isometric shape of not more than 300 nm were nucleated in the vicinity of interfaces of the hard second phase and the ferrite phase in the cold rolled structure, and the grains grew invading the surrounding ferrite structure as the annealing proceeded. The inventors also found that new grains were nucleated in some of the hard second phases, and some of the hard second phases were changed to isometric micrograms without greatly changing the original shape thereof while strain was recovered. Moreover, the inventors have analyzed crystal orientation in detail and have found that the origins of the nanograins in the mixed structure were isometric ferrite grains nucleated in the vicinities of interfaces of the initial ferrite and the hard second phase, and the origins of the micrograms were portions, which were not very shear strained in the initial ferrite, and the initial hard second phases.

According to these findings, when the amount of the hard second phase in the hot-rolled steel sheet is small, the nucleation density of nanograins is small because the amount of the interfaces of the hard second phase and the ferrite phase is small, and the final structure is mainly made of micrograms because there is a large amount of ferrite phase with small strain. As a result, the ferrite phase is not greatly strengthened by the nanograins, and the steel does not have a difference from an ordinary complex structure steel. On the other hand, when the amount of the hard second phase in the hot-rolled steel sheet is large, although large strain is applied to the ferrite phase, the amount of the ferrite phase is small, and the structure is mainly made of micrograms that are structures of the hard second phase after rolling and annealing. As a result, the nanograins cannot be sufficiently obtained. In view of the above findings, the inventors have systematically performed experiments by cold rolling and annealing hot-rolled steel sheets while varying the area ratio of the hard second phase in each of the steel and have found that the appropriate range of the area ratio of the hard second phase is 30 to 85%.

The method for measuring the hard second phase in the hot-rolled steel sheet is described as follows. A cross section parallel to the rolling direction of the hot-rolled steel sheet is photographed at a magnification ratio of 400 to 1000 by a light microscope. Then, three straight lines are drawn at optional positions in the direction of sheet thickness as shown in FIG. 1 (only one straight line was drawn as an example in FIG. 1). A distance from an interface of a first hard second phase and a ferrite to a next interface through a ferrite grain on the straight line is measured by a scale and is converted into the unit of μm. This operation is carried out on all the hard second phases cut in the image, and all measured values are averaged to determine an average distance of the hard second phase.

Figure 2:
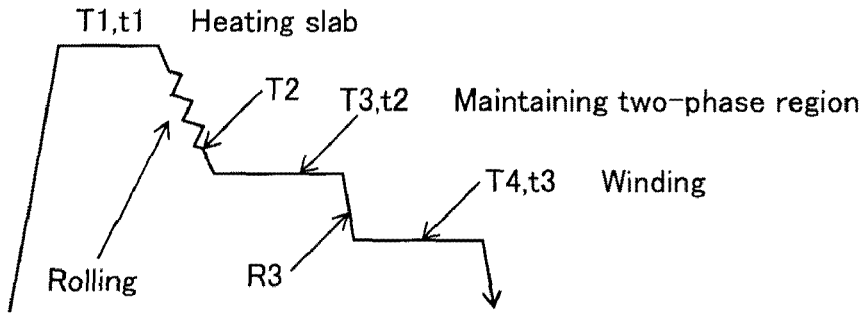
FIG. 2 is a diagram showing a heat history of hot rolling.

A method of hot rolling for obtaining objective structures is described. FIG. 2 is a diagram showing a heat history of hot rolling. As shown in FIG. 2, a slab is heated to the austenite region, that is, not less than the transformation point Ac3, and is final rolled after rough rolling. The final rolling is performed at just above the transformation point Ar3, that is, the range in which ferrite does not precipitate and the austenite region which is as low as possible, in order to inhibit the growth of grains during rolling. Afterward, the slab is cooled to the two-phase region of ferrite and austenite, whereby a mixed structure of ferrite and austenite is obtained. By inhibiting the growth of austenite grains during rolling, the nucleation density of ferrite, which nucleates from the grain boundary of austenite, is increased, and the grain size of the structure is fined. The processed ferrite directly remains at room temperature if the ferrite is precipitated at rolling, whereby the effect of precipitating fine ferrite by transformation decreases.

Then, the steel is maintained at the two-phase region and then cooled rapidly, or the steel is cooled rapidly without being maintained at the two-phase region. The austenite portion is transformed into the hard second phase in the step of rapid cooling, and refinement of grains in the step of maintaining the two-phase region is effective for decreasing the distance between the hard second phases. The rapid cooling from the two-phase region is performed at or above a specific cooling rate. The specific cooling rate is a critical cooling rate depending on compositions of a steel, in which a temperature of a steel sheet reaches an Ms point (a starting temperature of martensitic transformation) without crossing a nose of starting points of pearlite transformation in the continuous cooling transformation diagram (CCT).

The cooling may not be performed by a rapid cooling that is generally used, and the cooling may be performed at a cooling rate that is sufficient for the steel. If the cooling rate is high enough not to cross a nose of starting points of bainite transformation in the CCT diagram, the second phase becomes martensite. If the steel is cooled to not more than the Ms point by crossing the nose of starting points of bainite transformation, the second phase becomes a mixed structure of martensite and bainite. Moreover, if the cooling is intermitted, and the steel is maintained at just above the Ms point and then cooled to room temperature, the second phase becomes bainite.

If the cooling is intermitted, and the steel is maintained at just above the Ms point and then cooled to room temperature in a condition in which Si or Al is increased as a composition of a high-strength steel sheet, the hard second phase includes residual austenite besides the bainite. The important point is avoiding pearlite transformation so as not to produce cementite in the second phase other than the ferrite.

In such a production method for high-strength steel sheets, the hot-rolled steel sheet is preferably formed so that an average distance between the hard second phases is 2.5 to 5 μm, which is measured in the direction of the sheet thickness in a metallic structure observed in a cross section parallel to the rolling direction. The reason therefor is described hereinafter.

Cold Rolling

When an average distance between the hard second phases of a structure after hot rolling is expressed as d (μm), a sheet thickness after hot rolling (before cold rolling) is expressed as $t_0$, and a sheet thickness after cold rolling is expressed as t, cold rolling is performed in a condition in which a reduction index D represented by the following equation (27) satisfies the following equation (28).

$$D=d\times t/t_0 \quad (27)$$

(d: average distance between the hard second phases (μm), t: sheet thickness after cold rolling, $t_0$: sheet thickness between after hot rolling and before cold rolling)

$$0.50\leqq D\leqq 1.0 \quad (28)$$

When the rolling reduction is small, and the value of D in the equation (28) is more than 1.0, the ferrite phase is not sufficiently shear strained, whereby nanograins are not sufficiently produced after annealing, and only ordinary metallic structures consisting of micrograms are produced. On the other hand, when a rolling is performed at high rolling reduction, and the value of D is less than 0.5, entire portions of the ferrite phase are uniformly shear strained, whereby the ferrite of the primary phase does not consist of a mixed structure of nanograins and micrograms after annealing, but consist of nanograins. In each case, the steel cannot have high ductility which is a feature of the high-strength steel sheet of the present invention.

The above d is set to be 2.5 to 5 μm in the present invention. When d is more than 5 μm, large load must be applied to a rolling machine in order to roll a high-strength steel sheet of the present invention, because t/to should be not more than 0.2, that is, high reduction rolling should be performed at more than 80% of rolling reduction according to the equation (27). Even if rolling reduction with respect to one pass of rolling is decreased by using a tandem mill with 4 or more steps, the necessary rolling reduction is not obtained by one rolling, and rolling is required to be performed twice. Therefore, in the present invention, in order to obtain a structure of nanograins even though the rolling reduction is not more than 80%, which may be actually achieved by one rolling, the distance between the hard second phases of the hot-rolled steel sheet is limited to not more than 5 μm.

If d is less than 2.5 μm, the initial distance between the hard second phases are very small, whereby entire portions of the ferrite phase are uniformly strongly strained even when rolling is performed under any conditions, and the ferrite of the primary phase does not consist of a mixed structure of nanograins and micrograms, but consist of nanograins. Therefore, as described above, the steel cannot have high ductility, which is a feature of the high-strength steel sheet of the present invention.

Annealing

Annealing is a step for eliminating processing strain and forming a predetermined metallic structure by heat treatment of a material after cold rolling. Annealing includes steps of heating, maintaining, and cooling a material after cold rolling, and the maintaining temperature Ts (° C.) and the maintaining time ts (sec) at Ts satisfy the following equations (29) and (30).

$$F_2(T)+20 \leqq Ts \leqq F_2(T)+90 \quad (29)$$

$$F_2(T)+20 \leqq Ts \leqq F_4(G)-1.3(ts)^{1/2} \quad (30)$$

(ts: maintaining time (sec), Ts: maintaining temperature (° C.), $(ts)^{1/2}$ is the square root of ts)

Figure 3:
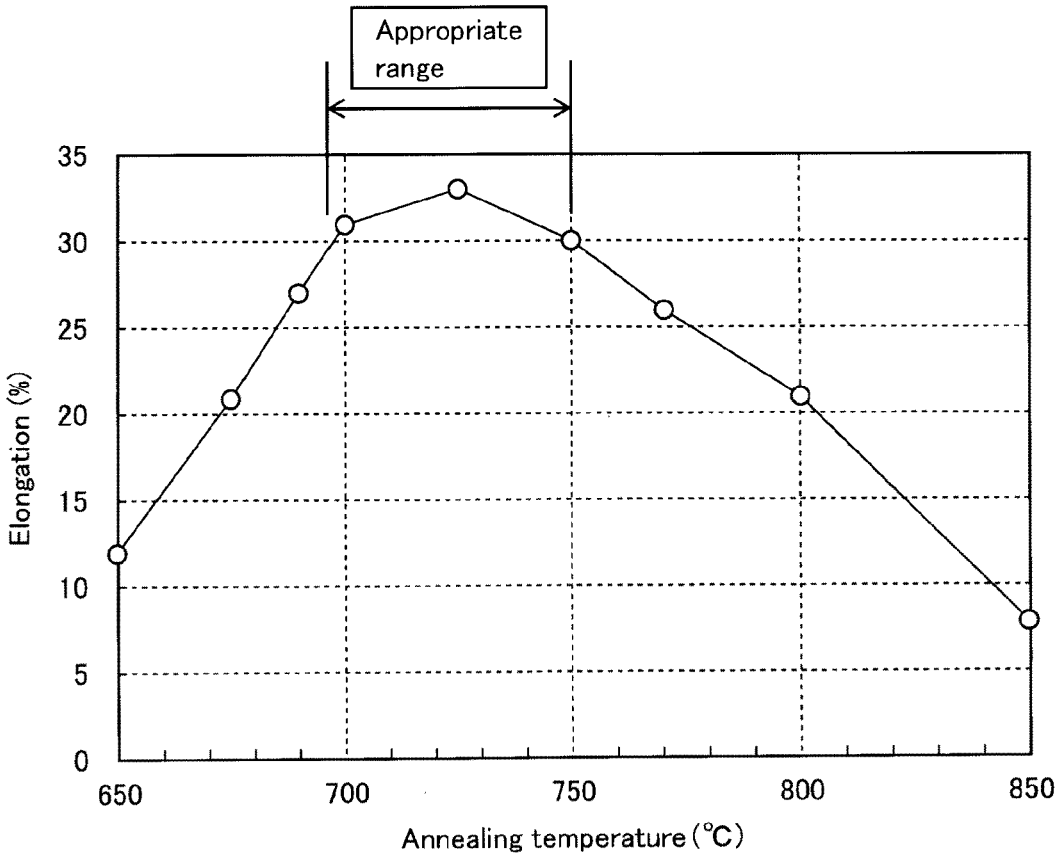
FIG. 3 is a graph showing a relationship between annealing temperature and elongation in an embodiment.

FIG. 3 is a graph showing elongations of steel sheets that were formed under the same conditions until the step of cold rolling and then annealed at different temperatures. FIG. 3 includes data of an invention example 1, comparative examples 7 to 10, and examples that are not shown in Table 5. The elongation was maximum when Ts was between 694° C. corresponding to $F_2(T)+20$ and 750° C. corresponding to $F_4(G)-1.3(ts)^{1/2}$. In contrast, the steel does not have a complex structure but has a ferrite single phase when Ts is smaller than $F_2(T)$, the steel has two phase of ferrite and austenite during annealing when Ts is higher than $F_2(T)$ and not more than $F_2(T)+20$. In this case, the ratio of the austenite is small, and the rate of the hard second phase finally obtained is small, whereby the features of the present invention cannot be substantially obtained. On the other hand, when the annealing temperature is higher than $F_4(G)-1.3(ts)^{1/2}$, grains grow extremely, whereby a structure in an appropriate range of the present invention cannot be obtained, and ductility is decreased.

When the annealing temperature is higher than $F_2(T)+90$, the area ratio of the hard second phase in the metallic structure becomes too large, and high yield point and low ductility, which are deformation characteristic of the hard second phase, greatly affect, whereby the ductility of the steel sheet is decreased. As described above, the range specified by the equations (29) and (30) is used as an appropriate range of the annealing temperature.

Figure 4:
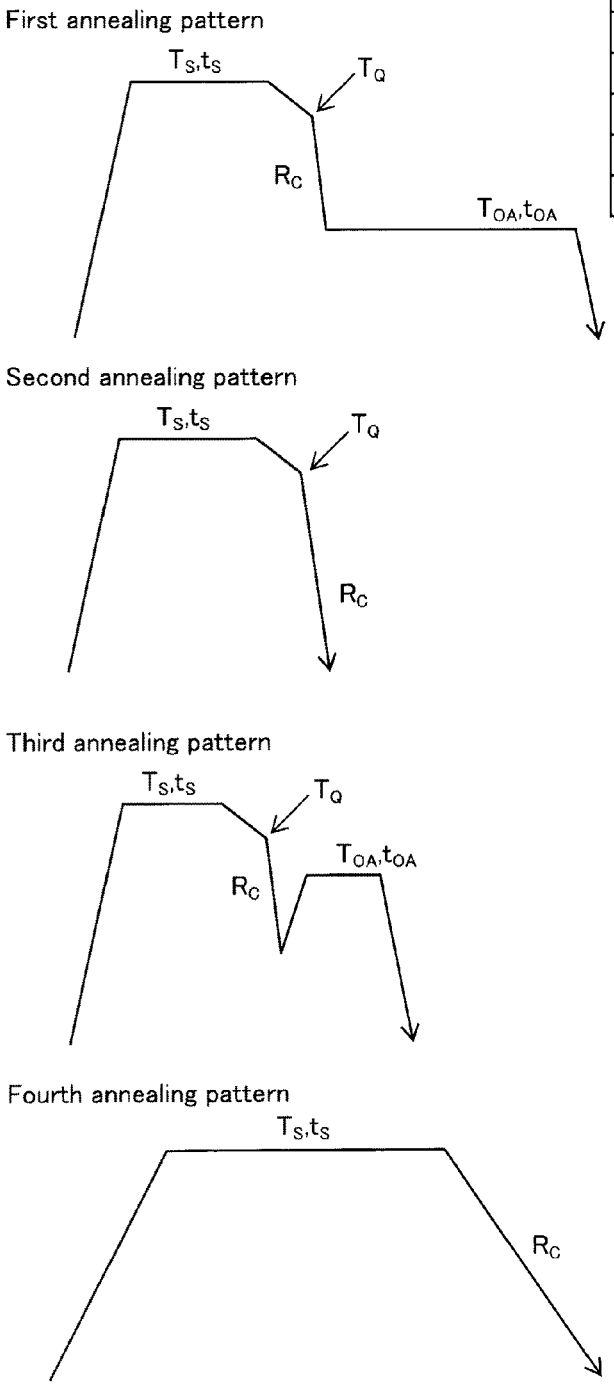
FIG. 4 shows diagrams of heat histories of four annealing patterns.

The hard second phase in a metallic structure after annealing varies in accordance with the chemical compositions and the annealing pattern. FIG. 4 shows diagrams of various annealing patterns. FIG. 4 shows patterns 1 and 2 which are a case of a CAL (continuous annealing line), pattern 3 which is a case of a CGL (continuous galvanizing line), and pattern 4 which is a case of box annealing. As described above, the annealing temperature Ts is set to be in the range satisfying the equations (29) and (30) so as to inhibit the growth of the grains and form two-phase structure of ferrite and austenite. The austenite changes into various phases during a step of cooling to room temperature, and a complex structure including a ferrite phase and appropriate amount and appropriate kind of hard second phase is formed by appropriately selecting the cooling conditions. In this case, as described above, the hard second phase may include martensite, bainite, and residual austenite.

Next, a cooling method after annealing is described. Cooling is performed by using gas, by spraying with water or a mixture of water and gas, by quenching (WQ) in a water tank, or by contact cooling with a roll. The gas may be selected from the group consisting of air, nitrogen, hydrogen, gas mixtures of nitrogen and hydrogen, helium, and argon.

Four kinds of patterns shown in FIG. 4 are applicable for temperature history according to the structure of annealing line after cooling. In a line including a cooling zone and an overaging zone in succession after an annealing zone, such as the first pattern, cooling may be intermitted at about a predetermined temperature and overaging treatment may be successively performed, or reheating and overaging treatment may be performed after cooling may be applied. The second pattern has a line composition without an overaging zone, and the third pattern corresponds to CGL (continuous galvanizing line) and is the same as the first pattern except that a final temperature of cooling is defined as a temperature of a molten zinc bath. The fourth pattern corresponds to a box annealing line.

In the above cooling step, since the austenite is transformed into pearlite or ferrite when the cooling rate is too small, the cooling rate must be larger than a certain degree. The cooling rate is preferably not less than the critical cooling rate depending on compositions of a steel, in which pearlite transformation and ferrite transformation can be avoided. When the cooling rate is high, and a steel is cooled to a temperature of the Ms point or lower without crossing noses of ferrite transformation and bainite transformation in the CCT diagram, martensite is obtained as the hard second phase. In the first and third patterns having an averaging zone, martensite is more exactly tempered martensite. As described above, the tempered martensite is included in martensite without distinction in the present invention.

When cooling is performed at the cooling rate such that temperature thereof crosses the nose of bainite transformation and the final temperature of cooling is set to the Ms point or lower, the hard second phase consists of a complex structure of martensite and bainite. When cooling is intermitted and overaging treatment is followed at just above the Ms point in the first and third pattern having averaging zone, the hard second phase consists of bainite or a mixed structure of residual austenite and bainite. Whether the residual austenite is produced or not depends on the stability of austenite at annealing. That is, by increasing the amount of an alloying element (Si, Al) or by increasing the time of overaging treatment so as to accelerate condensation of carbon into austenite and stabilize the austenite, residual austenite is obtained.

Specifically, a hard second phase obtained by the first pattern includes at least one or more selected from the group consisting of martensite, bainite, and residual austenite. A factory line without an overaging zone, such as a second annealing pattern, finishes when cooling is performed to 100° C. or less after annealing. In this case, the hard second phase includes as least one of martensite and bainite.

The third annealing pattern corresponds to CGL (continuous galvanizing line). The surface of a steel is plated with zinc in a molten zinc bath after rapid cooling from the annealing temperature. Afterward, the galvanized layer may be alloyed by reheating, or may not be alloyed by skipping the reheating. The kind of the hard second phase is the same as in the case of the first pattern when reheating is performed, and the kind of the hard second phase is the same as the case of the second pattern when reheating is not performed.

The fourth annealing pattern is box annealing. The coil is generally not removed from the furnace casing after annealing and is cooled in the furnace casing. Therefore, the compositions of a steel are limited to compositions that have extremely high quenchability so as to obtain a predetermined hard second phase in furnace cooling. Specifically, an invention example 6 corresponds to a steel having such compositions.

In the high-strength steel sheet of the present invention, skin-pass rolling may be performed to the steel at an elongation rate of 2.5% or less after cold rolling and annealing. In a production process of a cold-rolled steel sheet, the step of the skin-pass rolling is generally used so as to finally correct the shape of the steel. In the first aspect of the production method for the high-strength steel sheet of the present invention, besides the modification of the shape, decreasing of the yield point, decreasing of forming load in press forming, and decreasing of the amount of springback occur. In this case, ductility of the material is undesirably greatly decreased when the elongation rate is more than 2.5%, whereby the upper limit of the elongation rate is set to be 2.5%.

2. Second Embodiment

The high-strength steel sheet produced by the present invention has a metallic structure consisting of a ferrite phase and a hard second phase dispersed in the ferrite phase. The area ratio of the hard second phase in the metallic structure is 3 to 30%, and the area ratio of nanograins in the ferrite phase is 15 to 90%. In the ferrite phase, dS as an average grain size of nanograins, and dL as an average grain size of micrograms, satisfy the following equation (31).

$$dL/dS \geqq 3 \quad (31)$$

In such a high-strength steel sheet, A(ave) as an average of Ai (i=1, 2, 3, . . . ) which is an area ratio of the hard second phase at each area, and standard deviation s, preferably satisfy the following equation (32), and an average grain size dp of the hard second phase and an average grain diameter df of the whole ferrite satisfy the following equation (33), when 9 pieces or more of 3 μm square area are optionally selected in a cross section parallel to a rolling direction of the steel sheet.

$$s/A(ave) \leqq 0.6 \quad (32)$$

$$df/dp \geqq 3 \quad (33)$$

In such a high-strength steel sheet, C and at least one selected from the group consisting of Si, Mn, Cr, Mo, Ni and B are included, and C(ss) (amount of solid-solved carbon calculated by subtracting the amount of C combined with Nb, Ti, and V from the total amount of C) preferably satisfies the following equations (35) to (37) on the basis of the following equations (34). Component ratios (mass %) of the addition elements are substituted for each of the addition elements in the equations.

$$F_1(Q)=0.65Si+3.1Mn+2Cr+2.3Mo+0.3Ni+2000B \quad (34)$$

$$F_1(Q) \geqq -40C+6 \quad (35)$$

$$F_1(Q) \leqq 25C-2.5 \quad (36)$$

$$0.02 \leqq C(ss) \leqq 0.3 \quad (37)$$

Moreover, in the high-strength steel sheet, compositions preferably satisfy the following equation (40) on the basis of the following equations (38) and (39). Component ratios (mass %) of the addition elements are substituted for each of the addition elements in the equations.

$$F_2(S)=112Si+98Mn+218P+317Al+9Cr+56Mo+8Ni+1417B \quad (38)$$

$$F_3(P)=500\times Nb+1000\times Ti+250\times V \quad (39)$$

$$F_2(S)+F_3(P) \leqq 360 \quad (40)$$

Such a high-strength steel sheet desirably includes, by mass %, at least one of not more than 0.72% of Nb, not more than 0.36% of Ti, and not more than 1.44% of V, and desirably includes, by mass %, at least one of not more than 2% of P and not more than 18% of Al. The high-strength steel sheet more desirably includes, by mass %, not more than 5% of Si, not more than 3.5% of Mn, not more than 1.5% of Cr, not more than 0.7% of Mo, not more than 10% of Ni, and not more than 0.003% of B.

By adding 0.007 to 0.03 mass % of N, a high-strength steel sheet will have a large hardened amount of baking painting without decreasing ductility thereof. As a result, load occurring in the high-strength steel sheet by a collision of parts is increased, and the absorption characteristics of impact energy are further improved. Bake hardening occurs when a step of baking painting is performed after the steel sheet is formed into a shape of a part, and interstitial solid solution elements fix dislocations introduced by forming process and inhibit movements of the dislocations, whereby the steel exhibits large deformation resistance when deformation is performed on the part. This characteristic is called BH (Bake Hardening), and a method for measuring the amount of BH is prescribed in an appendix of JIS G3135. Hereinafter, the bake hardenability is called the BH characteristic, and the amount of bake hardening is called the amount of BH.

The inventors have conducted intensive research regarding a method for suitably producing the above high-strength steel sheet. As a result, in order to obtain ultrafine grains by ordinary cold rolling, the inventors have found the following. A crystalline structure before cold rolling is formed so as to have a complex structure of soft ferrite and a hard second phase. Cold rolling is performed at necessary rolling reduction in accordance with a distance between the hard second phases, and then annealing is performed at a temperature which inhibits growth of grains, for a certain time. As a result, a high-strength steel sheet including the above mixed structure of micrograms and nanograins is obtained.

According to the present invention, the crystalline structure before rolling is formed so as to have a complex structure of soft ferrite and a hard second phase, cold rolling is performed at necessary rolling reduction according to a distance between the hard second phases, and annealing is performed in a temperature range which inhibits the growth of grains. Therefore, a high-strength steel sheet including the above mixed structure of micrograms and nanograins is produced. The high-strength steel sheet of the present invention obtained in this way is strengthened by decreasing the addition amount of alloying elements and refining the ferrite grains and has a superior balance of strength and elongation required in press forming, and the difference between static and dynamic strengths is 170 MPa or more.

A preferred embodiment of the present invention is described hereinafter with reference to the drawings. First, the reasons for defining various setting equations in the high-strength steel sheet of the present invention are mentioned. It should be noted that all of the content of each element shown in the following is in the unit of "mass %", and this is expressed only by "%" for convenience.

A carbon steel is used as a raw material of the high-strength steel sheet of the present invention, and the solid-solved carbon C(ss) calculated by subtracting the amount of C combined with Nb, Ti, and V from the total amount of C must be adjusted to be 0.02 to 0.3%, as described hereinafter. At least one selected from a first element group consisting of Si, Mn, Cr, Mo, Ni and B is included in the carbon steel in order to increase the strength of the steel by improving the quenchability and solid solution strengthening. Moreover, at least one selected from a second group consisting of Nb, Ti and V is included as necessary in order to increase the strength of the steel by refining of grains and precipitation strengthening. Furthermore, at least one selected from a third group consisting of P and Al is included as necessary in order to increase the strength of the steel by solid solution strengthening.

The steel obtained should satisfy all of the following equations (34) to (40). Chemical symbols in the following equations represent component ratios (mass %) of each element, and for example, "Cr" represents a component ratio (mass %) of Cr.

$$F_1(Q)=0.65\mathrm{Si}+3.1\mathrm{Mn}+2\mathrm{Cr}+2.3\mathrm{Mo}+0.3\mathrm{Ni}+2000\mathrm{B} \quad (34)$$

$$F_1(Q)\geqq -40\mathrm{C}+6 \quad (35)$$

$$F_1(Q)\geqq 25\mathrm{C}-2.5 \quad (36)$$

$$0.02\leqq \mathrm{C}(ss)\leqq 0.3 \quad (37)$$

$$F_2(S)=112\mathrm{Si}+98\mathrm{Mn}+218\mathrm{P}+317\mathrm{Al}+9\mathrm{Cr}+56\mathrm{Mo}+8\mathrm{Ni}+1417\mathrm{B} \quad (38)$$

$$F_3(P)=500\times\mathrm{Nb}+1000\times\mathrm{Ti}+250\mathrm{V} \quad (39)$$

$$F_2(S)+F_3(P)\leqq 360 \quad (40)$$

The meanings of marks in the equations and the reasons for defining each equation are described as follows.

Reasons for Defining the Equations (34) to (36)

$F_1(Q)$ represents an index of quenchability of steel, which is defined as shown in the equation (34) and is calculated from the component ratio (mass %) of each addition element.

It is important that the metallic structure, prior to cold rolling, have a complex structure of soft ferrite and a hard second phase (at least one of martensite, bainite, and residual austenite) in the production method for the high-strength steel sheet of the present invention, which is described hereinafter. These structures may be obtained by rapidly cooling the steel from the two-phase region of ferrite and austenite after hot rolling, by cooling the steel to room temperature after hot rolling and then heating, or by cold rolling the steel after hot rolling, heating and maintaining the steel at the two-phase region of ferrite and austenite, and then rapidly cooling the steel. However, there are two problems in obtaining these structures.

First, the hard second phase is difficult to obtain because of low quenchability when the amount of C is small. Accordingly, addition of elements of the above first element group for improving the quenchability is required in order to obtain the hard second phase easily. In this case, since the necessary quenchability is inversely proportional to the amount of C, the addition amount of the elements for improving the quenchability can be small when the amount of C is large. The above equation (35) indicates this function, and necessary amount of the elements for improving the quenchability is added according to the equation (35). The amount of C represents the amount of solid-solved carbon calculated by subtracting the amount of C combined with Ti, Nb, and V from the total amount of C, which is described in detail hereinafter.

Second, pearlite transformation tends to occur during cooling from the two-phase region of ferrite and austenite when the amount of C is large, and the necessary hard second phase is difficult to obtain. The addition of the first element group is effective for avoiding this phenomenon. That is, the nose of a starting point of pearlite transformation in the continuous cooling transformation diagram (hereinafter simply called "CCT diagram") shifts toward the side of longer time by adding the element for improving the quenchability. Therefore, a complex structure of ferrite and hard second phase is formed without producing pearlite. When the amount of C is large, since the pearlite transformation tends to occur, large amounts of the elements for improving the quenchability are required. The above equation (36) shows this function, and necessary amounts of the elements for improving the quenchability are added according to the above equation (36). The amount of C represents the amount of solid-solved carbon as described above.

Description of C and Reason for Defining the Equation (37)

C represents the amount of solid-solved carbon calculated by subtracting the amount of C combined with the second element group (Nb, Ti, and V) from the total amount of C and a value calculated by the following equation (41). Component ratios (mass %) of the addition elements are substituted for each of the addition elements in the equation (41).

$$\mathrm{C}(ss)=(\text{total amount of C})-(12/92.9\times\mathrm{Nb}+12/47.9\times\mathrm{Ti}+12/50.9\times\mathrm{V}) \quad (41)$$

Each coefficient of 92.9, 47.9, and 50.9 in the equation (41) represents the atomic weight of Nb, Ti, and V, and (12/92.9×Nb+12/47.9×Ti+12/50.9×V) represents the amount of C (mass %) combined with Nb, Ti, or V and forming carbides. Therefore, the amount of solid-solved carbon is calculated by subtracting the amount of C combined with Nb, Ti, or V from the total amount of C.

The equation (37) defines an upper limit and a lower limit of the amount of the solid-solved carbon in order to produce the metallic structure in the range of the optional amount before cold rolling. The lower limit is defined as 0.02% because the hard second phase is not produced but a single phase of ferrite is produced even if the elements for improving the quenchability are added to the steel, when the amount of C is less than 0.02%. The grain size of steel having a single phase of ferrite cannot be refined to the order of nanometers, which is smaller than 1 μm, unless a special method such as the above-described accumulative roll-bonding is repeatedly performed.

The upper limit is defined as 0.3% because the predetermined complex structure of ferrite and the hard second phase is not obtained if the upper limit is more than 0.3%. The nose of pearlite transformation in the CCT diagram stays on the side of the shorter time even if the elements for improving the quenchability are added when the amount of C is more than 0.3%. In this case, the nose of pearlite transformation is experienced at any of the cooling rates in the rapid cooling from the two-phase region of ferrite and austenite, whereby the metallic structure before cold rolling becomes a complex structure of ferrite and pearlite.

The pearlite has a lamellar structure including ferrite and cementite that is a compound of C and Fe, and the cementite is so brittle when subjected to deformation that the energy of cold rolling is spent on fracturing the cementite. Therefore, the soft ferrite phase, which is a feature of the production method of the present invention, cannot have a large strain when pearlite is included in the structure of the steel. Accordingly, the upper limit of the amount of C is defined as 0.3% in order to avoid pearlite transformation by adding the elements for improving the quenchability.

Reasons for Defining the Equations (38) to (40)

The high-strength steel sheet is strengthened by solid solution strengthening effects of the first element group and the third element group, and $F_2(S)$ represents the strengthening amount by MPa, which is calculated from mass % of the addition elements according to the equation (38). The coefficient for multiplying each element in the equation (38) is calculated by the following equation (42) on the basis of the following concept.

$$(\text{Coefficient of each element})=|r(X)-r(Fe)|/r(Fe)\times M(Fe)/M(X)\times 1000 \quad (42)$$

r(X) represents the atomic radius of each element, r(Fe) represents the atomic radius of iron, M(X) represents the atomic weight of each element, and M(Fe) represents the atomic weight of iron.

The points of the equation (42) are described as follows. That is, the difference in atomic radius between a certain addition element and iron is divided by the atomic radius of iron, and the quotient is proportional to the amount of solid solution strengthening with respect to the one element. In order to convert the unit of the quotient into a unit with respect to mass % of the element, the quotient is multiplied by the ratio of the atomic weight of iron to the element, and the quotient is also multiplied by 1000 to convert the unit into MPa. Physical constants of each element used and coefficients of the equation (42) calculated by using the physical constants are shown in Table 2.

The steel is strengthened by precipitation strengthening with carbides that are made from the above second element group and C in the steel, and $F_3(P)$ represents an index of the strengthening amount and is defined as shown in the above equation (39).

The points of the equation (39) are described as follows. Nb, Ti, and V easily form carbides in a steel, and for example, both the solubility product of Nb and C in the steel and the solubility product $(\text{mass }\%)^2$ of Ti and C are on the order of 10 to the −6th power at 700° C., and the solubility product of V and C $(\text{mass }\%)^2$ is on the order of 10 to the −4th power at 700° C. Ti, Nb, and V scarcely exist as solid solutions in the high-strength steel sheet of the present invention, but they may exist as carbides combined with C one-to-one, that is, NbC, TiC, or VC. Therefore, the amount of precipitation strengthening proportional to the added amounts of Nb, Ti, and V is expected. This case is applicable when C that is not combined with Nb, Ti, or V still remains, and the expected amount of precipitation cannot be obtained if a greater amount of Nb, Ti, or V is added when all carbons are combined with Nb, Ti, or V. Moreover, the amount of precipitation strengthening varies due to sizes of the precipitates.

Generally, the precipitation strengthening effect is decreased when the precipitates are coarse. As described below, the present invention does not expect to maintain the high-strength steel sheet in a high temperature range, in which the carbides tend to grow, for a long time in annealing after cold rolling. Therefore, carbides of Nb, Ti, or V are dispersed uniformly and finely in the steel, and the amount of precipitation strengthening is determined only by the addition amounts of these elements. The above equation (39) indicates this effect.

Each coefficient of 500, 1000, and 250 in the equation (39) represents the amount of precipitation strengthening with respect to 1 mass % of Nb, Ti, or V and was obtained from experiments. The total of the amounts of the precipitation strengthening of Nb, Ti, and V is represented as $F_3(P)$, that is, the total amount of precipitation strengthening.

With such technical findings, the equation (40) indicates that the total of the strengthening amount of ferrite performed by solid solution strengthening and precipitation strengthening should be 360 MPa or less. This is because a large difference between static and dynamic strengths, which is a feature of the present invention, is not obtained when the strengthening amount of the steel sheet is too large. As described above, when ferrite is greatly strengthened by adding large amounts of alloying elements, the purity of the ferrite is decreased, and deformation stress of ferrite does not largely depend on strain rate. In the metallic structure of the high-strength steel sheet of the present invention, the difference between static and dynamic strengths is larger than that of a conventional steel

TABLE 2

| | Chemical symbol | | | | | | | | |
|---|---|---|---|---|---|---|---|---|---|
| | Fe | Si % | Mn % | P % | Al % | Cr % | Mo % | Ni % | B % |
| Atomic radius r(X) | 1.24 | 1.17 | 1.12 | 1.09 | 1.43 | 1.25 | 1.36 | 1.25 | 0.9 |
| (r(X) − r(Fe))/r(Fe) | — | 0.0565 | 0.0968 | 0.1210 | 0.1532 | 0.0081 | 0.0968 | 0.0081 | 0.2742 |
| Atomic weight M(X) | 55.8 | 28.1 | 54.9 | 31.0 | 27.0 | 52.0 | 95.9 | 58.7 | 10.8 |
| M(Fe)/M(X) | — | 1.99 | 1.02 | 1.80 | 2.07 | 1.07 | 0.58 | 0.95 | 5.17 |
| Coefficient of equation (42) | — | 112 | 98 | 218 | 317 | 9 | 56 | 8 | 1417 |

when the purity of the ferrite is not less than a certain degree; however, large difference between static and dynamic strengths cannot be produced when the purity of the ferrite is too low.

The inventors have researched regarding the quantification of the purity of the ferrite necessary for producing large difference in static and dynamic strengths. As a result, the inventors have experimentally demonstrated that the degree of the negative effect of each addition element on the difference between static and dynamic strengths of ferrite is proportional to the strengthening amount of ferrite (solid solution strengthening and precipitation strengthening) with respect to unit addition amount (mass %). The inventors have conducted intensive research based on these results and have found that the upper limit of the strengthening amount of ferrite necessary for producing large difference in static and dynamic strengths is 360 MPa. The above equation (40) defines this result.

In the high-strength steel sheet obtained by the present invention, by adding appropriate amount of N, the steel will exhibit large amount of BH. Carbon included in the high-strength steel sheet of the present invention exists in the hard second phase, carbides of Nb, Ti, or V, or ferrite of the primary phase, in a solid-solved state. The solid-solved carbon in the ferrite of the primary phase strengthens the BH characteristic. If the amount of C is increased as an element of the chemical compositions, since the carbon is used for forming a hard second phase and carbides, increasing the amount of C may not result in increasing of the amount of BH. Therefore, the inventors have focused on N as an interstitial solid solution element other than C. N can be included in a solid-solved state without greatly changing the metallic structure as long as the content of N is within a range in which N does not produce a compound with iron, and N effectively affects strain aging, whereby the amount of BH will be large.

In the high-strength steel sheet obtained by the present invention, the amount of BH is substantially large. The reason for this is not obvious, but the following may be assumed. The ferrite of the primary phase of the high-strength steel sheet of the present invention has a complex structure of nanograins with high strength and micrograms with relatively low strength, and great amount of dislocation occurs in the vicinity of interfaces of micrograms and nanograins by binding of nanograins when the steel is press formed. This large amount of dislocation facilitates strain aging of N in baking painting, and the amount of BH is thereby increased.

Reasons for Defining Each Chemical Composition

The reasons for defining each chemical composition in the high-strength steel sheet of the present invention are given hereinafter. It should be noted that all of the content of each element shown in the following are in the unit of "mass %", and this is expressed only by "%" for convenience. Carbon is individually defined by the equation (37), the other elements are individually defined by the equations (35) and (36) for the lower limit and the equations (40), (43), and (44) for the upper limit in most cases, and moreover, the upper limits are individually set.

$$Cr \leqq 1.5 \tag{43}$$

$$Mo \leqq 0.7 \tag{44}$$

C: 0.02 to 0.3% as Solid-Solved Carbon

A mixed structure of ferrite and austenite is formed at high temperatures by adding carbon, and the hard second phase of martensite, bainite, and residual austenite is formed by rapidly cooling the mixed structure. Therefore, carbon is the most important element in the present invention.

In the high-strength steel sheet of the present invention, Nb, Ti, and V may be added, and carbons may be precipitated as carbides. Accordingly, the addition amount of C is adjusted so that solid-solved carbon other than the carbons precipitated as carbides satisfies the equation (37). The metallic structure before cold rolling is transformed into ferrite when the amount of the solid-solved carbon is less than 0.02%, and is transformed into ferrite and pearlite when the amount of the solid-solved carbon is more than 0.3%, both of which are not suitable for the production method for the high-strength steel sheet of the present invention.

The First Element Group: Si, Mn, Cr, Mo, Ni, and B

The elements of the first element group are added to the steel in order to improve the quenchability and improve the strength by solid solution strengthening. The addition amount is adjusted to satisfy the equations (35), (36), (40), (43), and (44). The reasons for defining the upper limit and lower limit of the addition amount of each element are described hereinafter.

Si: 0.2 to 5%

The quenchability is not greatly improved when the addition amount of Si is less than 0.2%. Therefore, the lower limit is defined as 0.2%. When the addition amount of Si is more than 5%, Si is combined with Fe, and $Fe_3Si$, which is an intermetallic compound having a crystalline structure type of D03 or B2, is produced. Since $Fe_3Si$ decreases the ductility of the steel, the upper limit is defined as 5%.

Mn: 0.1 to 3.5%

The quenchability is not greatly improved when the addition amount of Mn is less than 0.1%. Therefore, the lower limit is defined as 0.1%. When the addition amount of Mn is more than 3.5%, austenite besides ferrite exists as a stabilized phase at room temperature. Austenite is undesirable because austenite has low strength and decreases the strength of overall steel. Therefore, the upper limit is defined as 3.5%.

Cr: 0.1 to 1.5%

The quenchability is not greatly improved when the addition amount of Cr is less than 0.1%. Therefore, the lower limit is defined as 0.1%. When the addition amount of Cr is more than 1.5%, carbon in the steel and Cr combine to form carbides, whereby solid-solved chromium is not obtained in an amount corresponding to the addition amount, and quenchability may not be improved. Therefore, the upper limit is defined as 1.5% at which Cr is able to exist in a solid-solved state.

Mo: 0.1 to 0.7%

The quenchability is not greatly improved when the addition amount of Mo is less than 0.1%. Therefore, the lower limit is defined as 0.1%. When the addition amount of Mo is greater than 0.7%, carbon in the steel and Mo combine to form carbides, whereby solid-solved molybdenum is not obtained in an amount corresponding to the addition amount, and quenchability may not be improved. Therefore, the upper limit is defined as 0.7% at which Mo is able to exist in a solid-solved state.

Ni: 0.2 to 10%

The quenchability is not greatly improved when the addition amount of Ni is less than 0.2%. Therefore, the lower limit is defined as 0.2%. When the addition amount of Ni is more than 10%, austenite exists as a stabilized phase besides ferrite at room temperature. The austenite is undesirable because the austenite has low strength and decreases the strength of overall steel. Therefore, the upper limit is defined as 10%.

B: 0.0005 to 0.003%

The quenchability is not greatly improved when the addition amount of B is less than 0.0005%. Therefore, the lower limit is defined as 0.0005%. The solid solubility limit of B into the ferrite is extremely small, and B mainly segregates at the grain boundary of the steel when the addition amount of B is small. On the other hand, the areas of grain boundaries are not sufficient for B to exist when the addition amount of B is more than 0.003%, whereby $Fe_2B$, which is an intermetallic compound, is produced and decreases the ductility of the steel. Therefore, the upper limit is defined as 0.003%.

The Second Element Group: Nb, Ti, and V

The elements of the second element group are added as necessary in order to refine the grains and strengthen the steel by precipitation strengthening. The reasons for defining the upper limit and lower limit of the addition amount of each element are described hereinafter.

Nb: 0.01 to 0.72%

The effects of refining and precipitation strengthening are not greatly obtained when the addition amount of Nb is less than 0.01%. Therefore, the lower limit is defined as 0.01%. As shown by the equation (39), when the addition amount of Nb is more than 0.72%, the amount of precipitation strengthening comes to 360 MPa only for NbC, and the above equation (40) is not satisfied. Therefore, the upper limit of Nb is defined as 0.72%.

Ti: 0.01 to 0.36%

The effects of refining and precipitation strengthening are not greatly obtained when the addition amount of Ti is less than 0.01%. Therefore, the lower limit is defined as 0.01%. As shown by the equation (39), when the addition amount of Ti is more than 0.36%, the amount of precipitation strengthening comes to 360 MPa only for TiC, and the above equation (40) is not satisfied. Therefore, the upper limit of Ti is defined as 0.36%.

V: 0.1 to 1.44%

The effects of refining and precipitation strengthening are not greatly obtained when the addition amount of V is less than 0.1%. Therefore, the lower limit is defined as 0.1%. As shown by the equation (39), when the addition amount of V is more than 1.44%, the amount of precipitation strengthening comes to 360 MPa only for VC, and the above equation (40) is not satisfied. Therefore, the upper limit of V is defined as 1.44%.

N: 0.007 to 0.03%

N is an element necessary for obtaining bake hardenability in the high-strength steel sheet of the present invention, and N effectively increases the yield strength of a part by the effect of strain aging when a step of baking painting is performed after the high-strength steel sheet is formed into a shape of the part. Accordingly, N is added as necessary. When the addition amount of N is less than 0.007%, bake hardenability is not greatly obtained. Therefore, the lower limit of N is defined as 0.007%. On the other hand, when the addition amount of N is more than 0.03%, $Fe_4N$, which is a cubic crystal, tends to precipitate, and the amount of BH is not increased according to the addition amount of N. Therefore, the upper limit of N is defined as 0.03%.

The Third Element Group: P and Al

The elements of the third element group are added as necessary as elements for strengthening the steel. The reasons for defining the upper limit and lower limit of the addition amount of each element are described hereinafter.

P: 0.03 to 2%

Addition of P is effective as an element for solid solution strengthening of the steel, and the solid solution strengthening is not greatly performed when the addition amount of P is less than 0.03%. Therefore, the lower limit is defined as 0.03%. When the addition amount of P is more than 2%, $Fe_3P$, which is an intermetallic compound, is produced and decreases the ductility of the steel. Therefore, the upper limit is defined as 2%.

Al: 0.01 to 18%

Al is an element for solid solution strengthening and is effective as a deoxidizing agent, thereby making "killed steel" from a steel. Al combines with dissolved oxygen in the steel in the process of steelmaking and emerges as an alumina, and the ductility and the toughness of a steel is improved by removing the alumina. Accordingly, Al is added as necessary. The functions as a deoxidizing agent and as an element for solid solution strengthening are not obtained when the addition amount is less than 0.01%. Therefore, the lower limit is defined as 0.01%. On the other hand, when the addition amount of Al is more than 18%, $Fe_3Al$, which is an intermetallic compound, is produced and decreases the ductility of the steel. Therefore, the upper limit is defined as 18%.

Reasons for Defining the Structure

The metallic structure of the high-strength steel sheet of the present invention is described in detail.

The metallic structure of the high-strength steel sheet of the present invention should satisfy all the requirements described in the following paragraphs 1, 2, 3, 4, and 5.

1. The metallic structure consists of a ferrite phase and a hard second phase (at least one selected from a group consisting of cementite, martensite, bainite, and residual austenite). The area ratio of the hard second phase is 3 to 30%, which is measured on a SEM image photographed at a magnification ratio of 5000 by a scanning electron microscope, after a cross section parallel to the rolling direction of a steel sheet is cut out and is etched with solution of nitric acid and ethanol.

2. The hard second phase is uniformly dispersed in the ferrite phase of the metallic structure, and satisfies the following requirement. That is, A(ave) as an average of Ai (i=1, 2, 3, . . . ) which is an area ratio of hard second phases at each area, and standard deviation s, preferably satisfy the following equation (32) when not less than 9 pieces of 3 μm square area are optionally selected in a SEM image of a cross section parallel to a rolling direction of the steel sheet and is photographed at a magnification ratio of 5000.

$$s/A(ave) \leqq 0.6 \quad (32)$$

3. In a SEM image photographed at a magnification ratio of 5000 of a cross section parallel to a rolling direction of the steel sheet, the area ratio of nanograins in ferrite portion in which the hard second phase is excluded from the total area is 15 to 90%.

4. An average grain size dS of nanograins and an average grain size dL of micrograms satisfy the following equation (31).

$$dL/dS \geqq 3 \quad (31)$$

5. An average grain size dp of the hard second phase and an average grain size df of whole ferrite satisfy the following equation (33).

$$df/dp \geqq 3 \quad (33)$$

The average grain size corresponds to a diameter of a circle measured from each area of ferrite grains, all of which are measured by image analysis in a SEM image photographed at a magnification ratio of 5000 of a cross section parallel to a rolling direction of the steel sheet. Specifically, when the area of ferrite grains measured by image analysis is defined as Si (i=1, 2, 3, . . . ), Di (i=1, 2, 3, . . . ) corresponding to a diameter of a circle is calculated by the following equation (45).

$$Di = 2(Si/3.14)^{1/2} \quad (45)$$

The reasons for defining the above requirements 1 to 5 are described hereinafter. That is, by dispersing and precipitating an appropriate amount of the hard second phase uniformly, solid solution elements such as carbon are extracted from the ferrite portion to the hard second phase, and the purity of the ferrite is increased, whereby the ductility of steel is increased, and the difference between static and dynamic strengths is increased. When the hard second phases are nonuniformly dispersed, the purity of the ferrite portion having small density of the hard second phase is lowered, whereby high ductility and large difference between static and dynamic strengths cannot be obtained.

The reason for defining the area ratio of the hard second phase as 3 to 30% is described below. That is, when the area ratio of the hard second phase is less than 3%, the purity of ferrite is not high enough, whereby the difference between static and dynamic strengths is not increased. On the other hand, when the area ratio of the hard second phase is more than 30%, the negative effect of the hard second phase having low purity and having low difference between static and dynamic strengths is strengthened, whereby the difference between static and dynamic strengths in the overall material is not improved.

The hard second phase must be fine and be uniformly dispersed, which is specified by the equations (32) and (33). The equation (32) indicates that a standard deviation of the area ratio measured at a very small area that is 3 μm square area is small, that is, the second phase is uniformly dispersed, and the equation (33) indicates that the grain diameter of the second phase with respect to the grain size of ferrite is smaller than a certain degree.

The hard second phase in the structure of the high-strength steel sheet of the present invention includes a phase equilibrated with ferrite, a transformed structure produced by cooling the equilibrium phase, and structures transformed by annealing the equilibrium phase and the transformed structure. Specifically, the hard second phase consists of at least one or more selected from the group consisting of cementite, martensite, bainite, and residual austenite. Cementite exists as a phase equilibrated with ferrite in a steel, and martensite, bainite, and residual austenite are structures transformed from the equilibrium phases. The residual austenite is untransformed austenite that exists as an equilibrium phase only at high temperature and remains at room temperature, and the structure of the residual austenite is included as a transformed structure since the structure is obtained at room temperature by cooling austenite, although the residual austenite is practically not transformed. The pearlite is not appropriate for the hard second phase in the metallic structure of the high-strength steel sheet of the present invention. The second phase may include pearlite only when the annealing temperature after cold rolling is in the two-phase region of ferrite and austenite or in the single phase region of austenite, and the cooling rate is low. In such a case, growth of ferrite grains cannot be avoided, and nanograins cannot be included in the steel at a predetermined area ratio, which is a feature of the high-strength steel sheet of the present invention.

In addition to these phases and structures, tempered bainite, tempered martensite, troostite, sorbite, and a structure that has spheroidized cementite formed by annealing pearlite, exist. These structures are included as any of the hard second phase of which names are specifically described above. The tempered bainite and the tempered martensite are described in the first embodiment.

Troostite, which is not often used now, is categorized as tempered troostite and quenched troostite in "JIS G 0201 Glossary of Terms Used in Iron and Steel (Heat Treatment)". Tempered troostite, which is a structure produced when martensite is tempered, consists of fine ferrite and cementite, but is practically tempered martensite. Quenched troostite is a structure of fine pearlite produced by quenching and is included as pearlite in the present invention.

Sorbite, which is also not often used now, is categorized as tempered sorbite and quenched sorbite in "JIS G 0201 Glossary of Terms Used in Iron and Steel (Heat Treatment)". Tempered sorbite is a mixed structure of cementite and ferrite, which are precipitated and grown spherically by tempering of martensite, but the tempered sorbite is practically tempered martensite. Quenched sorbite is a structure of fine pearlite produced by quenching and is included as pearlite in the present invention.

A structure which has spheroidized cementite formed by annealing of pearlite is a mixed structure of ferrite and cementite, that is, the second hard phase is regarded as cementite.

A ferrite portion except for the hard second phase is described hereinafter. The structure of a ferrite portion is a mixed structure having nanograins and micrograms which are different in sizes. Therefore, the ferrite portion has a relatively low strength and a superior balance of the strength and the ductility in press forming, whereas the ferrite portion exhibits superior strength in rapid deformation such as in collisions after the ferrite portion is manufactured into a product. Accordingly, the formability and the absorption characteristics of impact energy are balanced to a high degree by the structure of ferrite portion.

The reason for defining the grain size of nanograins to be not more than 1.2 μm is described below. That is, for example, as shown in "Iron and Steel" (The Iron and Steel Institute of Japan, Vol. 88 (2002), No. 7, p. 365, FIG. 6*b*), the material characteristics, specifically, the ductility discontinuously varies when a grain size of ferrite reaches a region of about 1.2 μm. Specifically, when the grain sizes of ferrite are less than 1.2 μm, the overall elongation is suddenly decreased, and the uniform elongation is not performed.

In the high-strength steel sheet of the present invention, by processing the steel so as to have a strain amount of 1 to 10%, the ductility of the steel in rapid deformation is improved. The method for processing the steel is not limited, but it is most convenient that skin-pass rolling is performed on the steel at an elongation rate within the above range because there is a step of skin-pass rolling in an ordinary production process of cold-rolled steel sheet. Other method, such as a method for processing the steel by a leveler while applying tensile force and a method for applying strain by tensile force after the steel is cut into a sheet, may be used.

Hereinafter, a reason of the importance of ductility of a material, specifically, uniform elongation, will be described by using frames having the shape of a hat in cross section as specific examples. In a part such as a crush box in which the length of member is large relative to the size of the cross section, buckling characteristics are stable with respect to impact compression due to the shape, whereby the part has good absorption characteristics of impact energy regardless of the work hardenability of the material. On the other hand, in a part having a member that is long relative to the size of the cross section, and in a part such as a side frame in which a direction of load of impact does not coincide with the axial direction of the member, buckling characteristics tend to be unstable with respect to impact compression, which must be compensated for by material characteristics. That is, a part having unstable buckling characteristic is desirably made of a material that exhibits a large uniform elongation in rapid deformation, that is, a material that exhibits a large amount of work hardening. The high-strength steel sheet of the present invention satisfies such requirement, and the amount of work hardening in rapid deformation, that is, the uniform elongation of the steel, is improved by processing the steel so as to have a predetermined amount of strain after cold rolling and annealing.

The reasons for defining various kinds of equations, chemical compositions, and structures relating to the high-strength steel sheet of the present invention are described above. The functions regarding effects of the high-strength steel sheet of the present invention are described in detail hereinafter.

First Function Regarding Effects of the High-Strength Steel Sheet of the Present Invention By forming ferrite into mixed structures of nanograins and micrograms, a large difference between static and dynamic strengths is obtained as follows. The high-strength steel sheet of the present invention is a steel sheet with a complex structure including an extremely high-strength portion of nanograins in which grain sizes are not more than 1.2 μm and including an ordinary strength portion of micrograins in which grain sizes are more than 1.2 μm. The high-strength steel sheet of the present invention statically deforms in the same manner as an ordinary steel sheet with a complex structure does, and the static deformation first starts from the most deformable portion of the material, specifically, the inside of micrograms or the interfaces of nanograins in micrograms. Subsequently, the deformation proceeds slowly, primarily by micrograms. Therefore, the deformation proceeds by a stress equal to the stress required when the deformation proceeds only by micrograms, and the strength and the ductility are balanced at a general level.

On the other hand, in rapid deformation performed at a strain rate of approximately 1000/s, the high-strength steel sheet of the present invention deforms in a different manner from the manner of deformation of an ordinary steel sheet. The rapid deformation rate is approximately 100,000 times as fast as that of the static deformation, and the deformation that proceeds primarily by soft micrograms is thereby difficult to follow. Therefore, deformations of the insides of nanograins are required in addition to the deformation of micrograms. Accordingly, the effect of the nanograins having extremely high strength greatly increases, and high deformation stress is required.

This phenomenon occurs when the ratio of nanograins is in the range of 15 to 90%. When the ratio of nanograins is less than 15%, the effect of the nanograins is small, and both static deformation and dynamic deformation proceed primarily by the soft micrograms, whereby the difference between static and dynamic strengths is not increased. On the other hand, when the ratio of nanograins is greater than 90%, since the structure is almost entirely made of nanograins, the effect of the nanograins is large at static deformation, whereby the steel has high strength but has low ductility and is thereby not suitably used in press forming. Accordingly, when the ratio of nanograins is less than 15% or is more than 90%, superior strength and superior absorption characteristics of impact energy at rapid deformation, and superior workability, cannot be simultaneously obtained.

The above descriptions regard the high-strength steel sheet of the present invention, and a method for suitably producing the high-strength steel sheet is described hereinafter. The second embodiment of the production method for the high-strength steel sheet of the present invention is the same as that of the first embodiment of the production method except a step of hot rolling and a step of annealing, and therefore, only the steps of hot rolling and annealing will be described.

Hot Rolling

In the second embodiment of the production method for the high-strength steel sheet of the present invention, crystalline structures after hot rolling must be made to have a complex structure including ferrite as a primary phase and including a hard second phase at an area ratio of 10 to 85%. In addition, the average distance between the hard second phases measured in the direction of sheet thickness must be 2.5 to 5 μm. Then, as described hereinafter, cold rolling is performed at a predetermined rolling reduction corresponding to the distance between the hard second phases, and annealing is performed at a temperature that inhibits growth of grains, for a certain time. As a result, a high-strength steel sheet including the above mixed structure of micrograms and nanograins as a primary phase and including a hard second phase is obtained.

The hard second phase in the second embodiment is the same as the hard second phase in the first embodiment, and the definition and compositions thereof are described in the first embodiment. Therefore, a reason for defining an area ratio of the hard second phase in a hot-rolled steel sheet, which is different from the case of the first embodiment, will be described. When the area ratio of the hard second phase is less than 10% or is more than 85%, sufficient amount of nanograins cannot be obtained after cold rolling and annealing.

When the area ratio of the hard second phase is relatively small, and the area ratio is not less than 10% and is less than 30%, rolling must be performed at a large rolling reduction, which is difficult to perform by ordinary cold rolling. The large rolling reduction can be achieved by repeatedly performing the above-described accumulative roll-bonding, and the structure is ultrarefined in a lower number of cycles than the number of cycles required when a ferrite single phase steel is used as a raw material. When the area ratio of the hard second phase is in a range of 30 to 85%, cold rolling can be performed at a rolling reduction of not more than 80%, which can be performed by ordinary cold rolling. Therefore, the area ratio of the hard second phase is preferably 30 to 85%.

Annealing

A step of annealing will be described hereinafter. Annealing is a step for eliminating processing strain by heat treatment of a material after cold rolling and for forming a predetermined metallic structure. Annealing includes steps of heating, maintaining, and cooling a material after cold rolling, and the maintaining temperature Ts (° C.) and the maintaining time ts (sec) at Ts satisfy the following equation (46).

$$650-(ts)^{1/2} \leqq Ts \leqq 750-(ts)^{1/2} \quad (46)$$

(ts: maintaining time (sec), Ts: maintaining temperature (° C.), $(ts)^{1/2}$ is the square root of ts)

Figure 5:
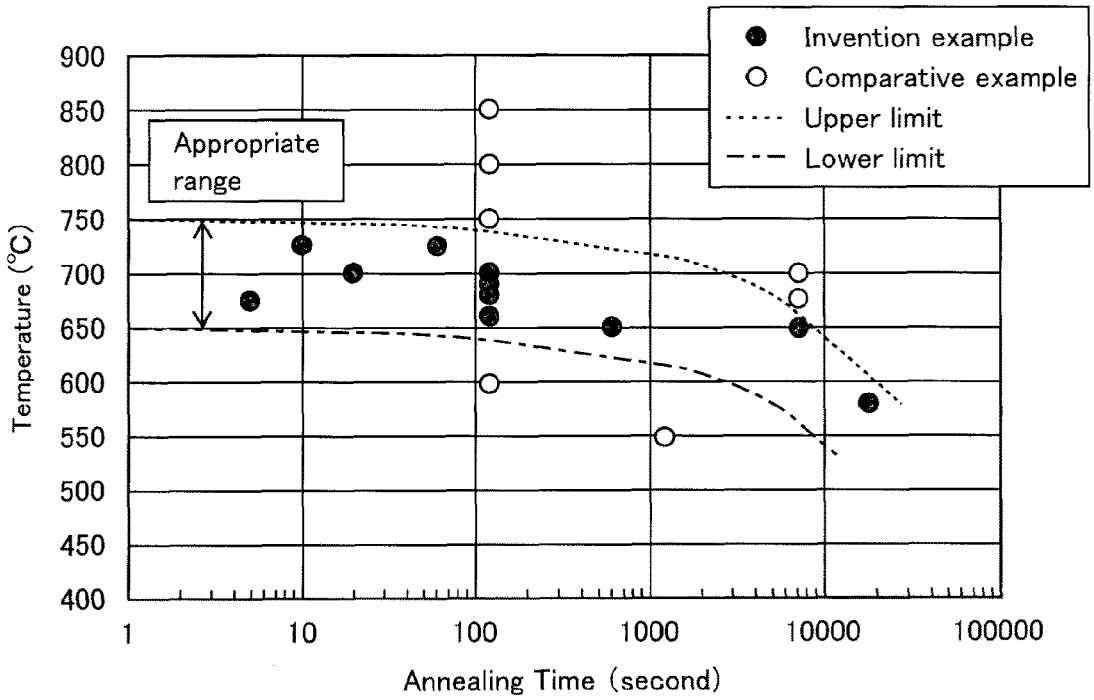
FIG. 5 is a graph showing a relationship between maintaining time and maintaining temperature of annealing.

FIG. 5 is a graph showing an appropriate range of the above maintaining temperature and maintaining time. When the annealing temperature Ts is higher than a value of $(750-(ts)^{1/2})$, the area ratio of nanograins undesirably exceeds 90% which is the upper limit. On the other hand, when the annealing temperature Ts is less than a value of $(650-(ts)^{1/2})$, the area ratio of nanograins is undesirably less than 15% which is the lower limit.

The hard second phase in a metallic structure after annealing varies in accordance with the annealing pattern. FIG. 4 shows diagrams of various annealing patterns. FIG. 4 shows patterns 1 and 2 which are a case of a CAL (continuous annealing line), pattern 3 which is a case of a CGL (continuous galvanizing line), and pattern 4 which is a case of box annealing. The structures obtained by applying each annealing pattern shown in FIG. 4 are listed in Table 3.

TABLE 3

| Annealing pattern | TS | TQ | Kind of second phase | Notes |
|---|---|---|---|---|
| 1 CAL with overaging | Not less than transformation point Ac1<br>Not more than transformation point Ac1 | Not less than transformation point Ac1<br>No set condition | M, B, A<br>C | Continuous annealing line |
| 2 CAL without overaging | Not less than transformation point Ac1<br>Not more than transformation point Ac1 | Not less than transformation point Ac1<br>No set condition | M, B<br>C | Continuous annealing line |
| 3 CGL | Not less than transformation point Ac1<br>Not more than transformation point Ac1 | Not less than transformation point Ac1<br>No set condition | M, B, A<br>C | Continuous galvanizing line |
| 4 Box annealing | Not more than transformation point Ac1 | No set condition | C | |

M: martensite,
B: bainite,
A: residual austenite,
C: cementite

First, the annealing temperature is described. By setting the annealing temperature Ts to be not more than the transformation point Ac1, a complex structure of ferrite and cementite may be obtained. By setting the annealing temperature Ts and the starting temperature of rapid cooling $T_Q$ to be not less than the transformation point Ac1, a mixed structure may include ferrite as a matrix and include at least one (the hard second phase) of transformation structures from austenite and annealed structures after annealing the transformation structures.

The transformation structures from austenite include martensite, bainite, and residual austenite. The residual austenite is actually not transformed, but the residual austenite is included in a transformation structure since the structure is obtained at room temperature by cooling austenite. The annealed structures after annealing the transformation structures are annealed structures of the above transformation structures, and the annealed structures are included in any of the above transformation structures as described above.

Even if the annealing temperature Ts and the starting temperature of rapid cooling $T_Q$ are not less than the transformation point Ac1, when the rate of temperature rise is high and maintaining time is short, carbon in a steel is not sufficiently condensed into austenite, and supersaturated carbon may remain in ferrite, whereby the carbon may precipitate as cementite during cooling. Therefore, in this case, a mixed structure includes ferrite as a matrix and includes at least one (the hard second phase) of transformation structures from austenite and annealed structures after annealing the transformation structures, and there may be a case in which cementite is included in the ferrite.

The transformation point Ac1 depends on compositions of a material and heating rate and is approximately between 600 to 750° C. in the present invention.

Next, a cooling method after annealing is described. Cooling is performed by using gas, by spraying with water or a mixture of water and gas, by quenching (WQ) in a water tank, or by contact cooling with a roll. The gas is selected from the group consisting of air, nitrogen, hydrogen, gas mixtures of nitrogen and hydrogen, helium, and argon.

When the cooling rate is too low during the above cooling step, ferrite grains grow substantially, and an area ratio of nanograins is thereby decreased. Therefore, the cooling rate is set to be not less than 10° C./s when a temperature of a steel sheet is in a range of not less than 600° C. The reason for defining the cooling rate only when a temperature of the steel sheet is in a range of not less than 600° C. is that the effect of the cooling rate may be substantially negligible because grains grow extremely slowly when the temperature of the steel sheet is less than 600° C.

Four kinds of patterns shown in FIG. 4 are applicable as an annealing pattern after cooling according to the structure of annealing line. In a line including a cooling zone and an overaging zone in succession after an annealing zone, the first pattern in which cooling is intermitted at about predetermined temperature and averaging treatment is performed may be applied. The third pattern corresponds to CGL (continuous galvanizing line) and is the same as the first pattern, except that a final temperature of cooling is defined as a temperature of a molten zinc bath.

The hard second phase only includes cementite when the annealing temperature Ts is not more than the transformation point Ac1 as is described above. Next, a case in which the annealing temperature Ts and the starting temperature of rapid cooling $T_Q$ are not less than the transformation point Ac1 is described in detail hereinafter. When the cooling rate is large, and a steel is cooled to not more than Ms point without crossing a nose of ferrite transformation and a nose of bainite transformation in the CCT diagram, martensite is obtained as the hard second phase. The martensite is, more exactly, tempered martensite in the first and third pattern having an overaging zone. As described above, the tempered martensite has a high degree of hardness due to the high dislocation density thereof and has large effects on the strengthening of a steel, thereby included in martensite without distinction in the present invention.

When cooling is performed at a cooling rate such that temperature thereof crosses the nose of bainite transformation and the final temperature of cooling is set to be not more than the Ms point, the hard second phase is a complex structure of martensite and bainite. When cooling is intermitted, and overaging treatment is followed at just above the Ms point in the first and third pattern having an overaging zone, the hard second phase is bainite or a mixed structure of residual austenite and bainite. Whether the residual austenite is produced or not depends on the stability of austenite during annealing. That is, residual austenite is obtained by increasing alloying elements (Si, Al) or increasing time of averaging treatment so as to accelerate condensation of carbon into austenite in order to stabilize the austenite.

The hard second phase includes pearlite when the cooling rate is small and temperature thereof crosses a nose of pearlite transformation. In this case, the pearlite is not appropriate for the structure of the high-strength steel sheet of the present invention. When the cooling rate is small to such a degree that pearlite is produced, ferrite grains grow, whereby nanograins may not sufficiently remain in the ferrite structure, and the steel does not have a large difference between static and dynamic strengths.

Specifically, in the first pattern, when the annealing temperature Ts and the starting temperature of rapid cooling $T_Q$ are not less than the transformation point Ac1, the hard second phase includes at least one selected from the group consisting of martensite, bainite, and residual austenite. The hard second phase only includes cementite when the annealing temperature Ts is less than the transformation point Ac1.

A factory line without an averaging zone such as the second annealing pattern finishes when cooling is performed to 100° C. or less after annealing. In this case, when the annealing temperature Ts and the starting temperature of rapid cooling $T_Q$ are not less than the transformation point Ac1, the hard second phase includes at least one of martensite and bainite. When the annealing temperature Ts is less than the transformation point Ac1, the hard second phase only includes cementite.

The third annealing pattern corresponds to CGL (continuous galvanizing line). The surface of a steel is plated with zinc in a molten zinc bath after rapid cooling from annealing temperature. Afterward, the galvanized layer may be alloyed by reheating as shown in FIG. 4, or may not be alloyed by skipping the reheating. The kinds of the hard second phase obtained are the same as the case of the first pattern when reheating is performed, and are the same as the case of the second pattern when reheating is not performed.

The fourth annealing pattern is box annealing. If a coil is removed from a furnace casing after box annealing, the annealing temperature is not limited in a condition in which a cooling rate reaches 10° C./s or higher by forced cooling operation. However, generally, the coil is not removed from the furnace casing after annealing and is cooled in the furnace casing. Therefore, the annealing temperature is required to be limited to less than 600° C. because the cooling rate does not reach 10° C./s or higher. Then, processing such as skin-pass rolling is performed so that the steel is strained at 1 to 10%.

Second Function Regarding Effects of the High-Strength Steel Sheet of the Present Invention A function of obtaining a structure of nanograins by ordinary cold rolling is described hereinafter.

Repeating of accumulative roll-bonding described in the beginning, which has been conventionally used, is described. Repeating of accumulative roll-bonding is an effective method for producing a large strain in a plate-like sample and obtaining a structure of nanograins. For example, an example of aluminum is disclosed in the Journal of The Japan Society for Technology of Plasticity (vol. 40, No. 467, p. 1190). A subgrain structure having a small difference in orientation is only obtained when rolling is performed with a lubricated mill roll, and nanograins are obtained when an unlubricated mill roll is used.

This phenomenon occurs because a larger strain is produced when the shear deformation is performed by an unlubricated mill roll than by a lubricated mill roll, and because shear strain is introduced to the inside of a material as a result of a portion, which was a surface in a previous cycle, comes to the inside of the material by repeating a cycle of accumulating and rolling. That is, although accumulative roll-bonding is repeated, grains are not ultrarefined unless a large shear strain is introduced to the inside of a material by unlubricated rolling.

The inventors have researched methods for introducing a shear strain to the inside of a material by ordinary oil lubricated rolling without repeating accumulative roll-bonding at low production efficiency and without performing unlubricated rolling in which a large load is applied to the mill roll. As a result, the inventors have found that a structure before rolling should have a complex structure consisting of a soft portion and a hard portion. That is, by cold rolling a steel sheet with a complex structure of a soft ferrite and a hard second phase, the ferrite portion between the hard second phases is shear-deformed by constraint of the hard second phase. Thus, shear strain is introduced to a large area of the inside of a material.

The inventors have conducted further research and have found that shear deformation is introduced to the inside of a material in the same way as the above when rolling is performed until the distances between the second hard phases have a certain value after rolling even though the distances between the hard second phases before cold rolling vary. That is, the inventors have found that cold rolling should be performed in conditions in which a reduction index D satisfies the following equation (47). In this case, an average distance between the hard second phases of a structure after hot rolling is expressed as d (μm), a sheet thickness after hot rolling (before cold rolling) is expressed as $t_0$, and a sheet thickness after cold rolling is expressed as t.

$$D=d\times t/t_0\leqq 1 \quad (47)$$

The uniform elongation in rapid deformation is increased by processing, and this may occur by adjusting the dislocation density of ferrite grains to be not less than a certain degree. The present inventors have experimented with cold-rolled steel sheets, which were produced by the above-described method, by changing rolling reduction of skin-pass rolling, and the inventors have observed thin films of the inside of the steel by TEM and have observed dislocation structures in detail. For observation by TEM, cross sections parallel to the rolling direction of the steel sheet were cut, mechanically polished, and then electropolished so as to obtain a thin film. Then, a bright-field image of the thin film was photographed by TEM, and dislocation density was measured by drawing a circle on the image and counting the number of dislocations inside the circle.

In the high-strength steel sheet of the present invention after cold rolling and annealing, the dislocation density of the ferrite grain was very small and was only approximately $10^{13}/m^2$. When a high-speed tensile test was performed on the steel, the pulling load was decreased after the steel exhibited large deformation strength at first, and then the steel was not greatly work hardened and was ruptured. In observation of dislocations in the steel after the high-speed tensile test, dislocations occurred in the ferrite grains and were randomly dispersed. A dislocation structure after an IF steel was fast deformed is shown on page 171 of the above-described "Report of Workshop on Fast Deformation of Automobile Materials" compiled by The Iron and Steel Institute of Japan, and the IF steel did not have an obvious dislocation cell structure even when the IF steel was strained at 20%. The above phenomenon was similar to the case of the IF steel. That is, the steel of the present invention was not easily work hardened and was not thereby greatly work hardened, whereby uniform elongation was small, and overall elongation was small.

On the other hand, when skin-pass rolling was performed on the steel at rolling reduction of 1% or more after cold rolling and annealing, the dislocation density was increased to approximately 5 to 30 times as much as the dislocation density of the steel after cold rolling and annealing. When skin-pass rolling was performed at rolling reduction of 5%, a dislocation cell was generated in the steel. Then, a high-speed tensile test was performed on this steel, dislocation density was increased besides the dislocations introduced by the skin-pass rolling, and the cell structure of the dislocation became definite. That is, when some number of dislocations is introduced by skin-pass rolling, the initial dislocations may function as dislocation sources that are effective in rapid deformation and facilitate increasing of dislocations, whereby dislocation cell structure tends to occur, and the amount of work hardening, that is, uniform elongation is increased. The curve in a stress-strain diagram obtained by high-speed tensile test was actually changed, and work hardening occurred after yielding, and the uniform elongation was increased. In this case, when the skin-pass rolling was performed at rolling reduction of more than 10%, the ductility of the material was greatly decreased in static deformation, whereby the ductility in rapid deformation was also decreased. In the present invention, in view of these findings, the appropriate range of the amount of strain is set to be 1 to 10% so that the uniform elongation is greatly increased, and the ductility of the material is not greatly decreased.

PRACTICAL EXAMPLES

1. First Example

Slabs (invention slabs 1 to 8 and comparative slabs 1 to 9) having chemical compositions shown in Table 4 were ingoted. Then, hot-rolled steel sheets were produced by using these slabs under conditions shown in Table 5, and steel sheets including annealed structures shown in Table 7 were obtained by cold rolling and annealing under conditions shown in Table 6. Test specimens having a shape shown in FIG. 14 were cut out from each steel sheet so as to have a tension axis parallel to the rolling direction, and a tensile test was preformed. Yield point, tensile strength, amount of bake hardening (amount of BH), and overall elongation were determined by nominal stress-nominal strain diagram that was obtained, and the value of tensile strength multiplied by elongation was calculated. These results are also shown in Table 5. The comparative example 4 was obtained by machining both surfaces of a hot-rolled steel sheet, which was the same as the steel sheet used in the comparative example 3, so as to have a sheet thickness of 1 mm and by performing accumulative roll-bonding (ARB) for 3 cycles, and total rolling reduction thereof corresponded to 88%. In this case, the ratio of nanograins after cold rolling and annealing was larger than the ratio of nanograins of the steel obtained by ordinary cold rolling, whereby characteristics of the steel sheet were good. This indicates that a predetermined structure can be obtained by ARB even when the area ratio of the second phase of the hot-rolled steel sheet is approximately 10% and is small.

TABLE 4

| | Composition C % | Si % | Mn % | P % | S % | Al % | Nb % | Ti % | V % | Cr % | Mo % | Ni % | B % | N % |
|---|---|---|---|---|---|---|---|---|---|---|---|---|---|---|
| Invention slab 1 | 0.099 | 0.01 | 2.01 | 0.058 | 0.002 | 0.021 | 0.023 | 0.002 | 0.001 | 0.01 | 0.15 | 0.01 | 0.0022 | 0.013 |
| Invention slab 2 | 0.104 | 0.02 | 3.02 | 0.002 | 0.003 | 0.022 | 0.002 | 0.002 | 0.001 | 0.54 | 0.001 | 0.01 | 0.0002 | 0.003 |
| Invention slab 3 | 0.198 | 0.03 | 3.04 | 0.003 | 0.004 | 0.026 | 0.052 | 0.002 | 0.001 | 0.01 | 0.001 | 0.01 | 0.0001 | 0.003 |
| Invention slab 4 | 0.151 | 0.02 | 1.99 | 0.065 | 0.002 | 0.028 | 0.022 | 0.033 | 0.28 | 0.01 | 0.15 | 2.99 | 0.0001 | 0.012 |
| Invention slab 5 | 0.152 | 0.02 | 2.04 | 0.056 | 0.002 | 0.043 | 0.075 | 0.09 | 0.001 | 0.01 | 0.14 | 3.01 | 0.0001 | 0.005 |
| Invention slab 6 | 0.14 | 0.02 | 2.41 | 0.005 | 0.002 | 0.023 | 0.021 | 0.015 | 0.001 | 0.01 | 0.32 | 5.03 | 0.0001 | 0.021 |
| Invention slab 7 | 0.298 | 1.51 | 3.95 | 0.003 | 0.002 | 0.018 | 0.002 | 0.001 | 0.001 | 0.01 | 0.001 | 1.02 | 0.0001 | 0.015 |
| Invention slab 8 | 0.402 | 1.48 | 1.51 | 0.051 | 0.002 | 0.025 | 0.023 | 0.001 | 0.001 | 0.01 | 0.001 | 2.02 | 0.0001 | 0.013 |
| Comparative slab 1 | 0.550 | 0.20 | 0.35 | 0.016 | 0.007 | 0.028 | 0.002 | 0.001 | 0.001 | 0.01 | 0.001 | 0.02 | 0.0002 | 0.005 |
| Comparative slab 2 | 0.105 | 0.01 | 0.98 | 0.002 | 0.004 | 0.035 | 0.001 | 0.001 | 0.001 | 0.01 | 0.001 | 0.01 | 0.0001 | 0.003 |
| Comparative slab 3 | 0.35 | 0.20 | 0.72 | 0.01 | 0.008 | 0.032 | 0.001 | 0.001 | 0.001 | 1.05 | 0.22 | 0.01 | 0.0001 | 0.006 |
| Comparative slab 4 | 0.16 | 1.51 | 2.33 | 0.008 | 0.007 | 0.023 | 0.001 | 0.001 | 0.001 | 0.01 | 0.001 | 0.01 | 0.0001 | 0.003 |
| Comparative slab 5 | 0.36 | 1.52 | 1.19 | 0.008 | 0.007 | 0.023 | 0.001 | 0.001 | 0.001 | 0.01 | 0.001 | 0.01 | 0.0001 | 0.003 |
| Comparative slab 6 | 0.028 | 0.319 | 1.18 | 0.003 | 0.001 | 0.022 | 0.053 | 0.001 | 0.001 | 0.52 | 0.001 | 0.02 | 0.0025 | 0.002 |
| Comparative slab 7 | 0.132 | 0.31 | 0.19 | 0.014 | 0.007 | 0.032 | 0.001 | 0.001 | 0.001 | 0.02 | 0.31 | 0.01 | 0.0045 | 0.005 |
| Comparative slab 8 | 0.101 | 1.55 | 5.05 | 0.122 | 0.002 | 0.058 | 0.023 | 0.002 | 0.001 | 0.35 | 0.68 | 0.02 | 0.0001 | 0.004 |
| Comparative slab 9 | 0.152 | 0.02 | 2.01 | 0.002 | 0.002 | 0.024 | 0.022 | 0.088 | 0.65 | 0.01 | 0.001 | 1.02 | 0.0002 | 0.003 |

| | $F_1(Q)$ | | $F_2(T)$ | | $F_3(S)$ | | $F_5(P)$ | | C(ss) | |
|---|---|---|---|---|---|---|---|---|---|---|
| | Standard ≧ 6 | Result | Standard ≦ $F_4(G)$ −20 | Result | Standard ≦ 600 | Result | Standard ≦ 130 | Result | Standard 0.07~0.45 | Result |
| Invention slab 1 | 11.01 | OK | 674 | OK | 230 | OK | 14 | OK | 0.095 | OK |
| Invention slab 2 | 10.86 | OK | 652 | OK | 312 | OK | 3 | OK | 0.103 | OK |
| Invention slab 3 | 9.67 | OK | 641 | OK | 312 | OK | 28 | OK | 0.191 | OK |
| Invention slab 4 | 7.64 | OK | 649 | OK | 253 | OK | 114 | OK | 0.074 | OK |

TABLE 4-continued

| | | | | | | | | | | |
|---|---|---|---|---|---|---|---|---|---|---|
| Invention slab 5 | 7.78 | OK | 635 | OK | 260 | OK | 128 | OK | 0.120 | OK |
| Invention slab 6 | 9.95 | OK | 606 | OK | 304 | OK | 26 | OK | 0.133 | OK |
| Invention slab 7 | 13.75 | OK | 629 | OK | 572 | OK | 2 | OK | 0.297 | OK |
| Invention slab 8 | 6.47 | OK | 692 | OK | 349 | OK | 13 | OK | 0.399 | OK |
| Comparative slab 1 | 1.64 | NG | 728 | OK | 70 | OK | 2 | OK | 0.549 | NG |
| Comparative slab 2 | 3.27 | NG | 705 | NG | 109 | OK | 2 | OK | 0.104 | OK |
| Comparative slab 3 | 5.17 | NG | 741 | OK | 127 | OK | 2 | OK | 0.349 | OK |
| Comparative slab 4 | 8.43 | OK | 692 | OK | 408 | OK | 2 | OK | 0.159 | OK |
| Comparative slab 5 | 4.90 | NG | 727 | OK | 297 | OK | 2 | OK | 0.359 | OK |
| Comparative slab 6 | 9.91 | OK | 713 | NG | 168 | OK | 28 | OK | 0.021 | NG |
| Comparative slab 7 | 10.55 | OK | 737 | NG | 91 | OK | 2 | OK | 0.131 | OK |
| Comparative slab 8 | 19.59 | OK | 630 | OK | 768 | NG | 14 | OK | 0.097 | OK |
| Comparative slab 9 | 6.97 | OK | 680 | OK | 216 | OK | 262 | NG | — | NG |

TABLE 5

| | | Hot rolling | | | | | |
|---|---|---|---|---|---|---|---|
| | Compositions Symbols | Heating temperature T1 ° C. | Heating time t1 minute | Temperature when rolling is finished T2 ° C. | Maintaining temperature T3 ° C. | Maintaining time t3 second | Cooling rate R ° C./s |
| | Standard | | | | | | |
| Invention example 1 | Invention slab 1 | 1200 | 120 | 880 | 550 | 5 | 122 |
| Invention example 2 | Invention slab 2 | 1000 | 60 | 820 | 620 | 5 | 135 |
| Invention example 3 | Invention slab 3 | 1200 | 60 | 850 | — | — | 138 |
| Invention example 4 | Invention slab 4 | 1200 | 60 | 860 | — | — | 28 |
| Invention example 5 | Invention slab 4 | 1200 | 60 | 860 | — | — | 28 |
| Invention example 6 | Invention slab 4 | 1200 | 60 | 860 | — | — | 28 |
| Invention example 7 | Invention slab 4 | 1200 | 60 | 860 | — | — | 28 |
| Invention example 8 | Invention slab 5 | 1200 | 60 | 860 | — | — | 115 |
| Invention example 9 | Invention slab 6 | 1200 | 60 | 820 | — | — | 123 |
| Invention example 10 | Invention slab 7 | 1200 | 60 | 885 | — | — | 25 |
| Invention example 11 | Invention slab 8 | 1200 | 60 | 905 | — | — | 3 |
| Comparative example 1 | Invention slab 1 | 1200 | 120 | 920 | 780 | 10 | 25 |
| Comparative example 2 | Invention slab 1 | 1200 | 120 | 880 | — | — | 107 |
| Comparative example 3 | Invention slab 1 | 1200 | 120 | 880 | 515 | 2 | 128 |
| Comparative example 4 | Invention slab 1 | 1200 | 120 | 880 | 515 | 2 | 128 |
| Comparative example 5 | Invention slab 1 | 1200 | 120 | 880 | 550 | 5 | 122 |
| Comparative example 6 | Invention slab 1 | 1200 | 120 | 880 | 550 | 5 | 122 |
| Comparative example 7 | Invention slab 1 | 1200 | 120 | 880 | 550 | 5 | 122 |
| Comparative example 8 | Invention slab 1 | 1200 | 120 | 880 | 550 | 5 | 122 |
| Comparative example 9 | Invention slab 1 | 1200 | 120 | 880 | 550 | 5 | 122 |
| Comparative example 10 | Invention slab 1 | 1200 | 120 | 880 | 550 | 5 | 122 |
| Comparative example 11 | Invention slab 1 | 1200 | 120 | 880 | 550 | 5 | 122 |
| Comparative example 12 | Invention slab 4 | 1200 | 60 | 860 | — | — | 115 |
| Comparative example 13 | Comparative slab 1 | 1200 | 60 | 857 | — | — | 3 |
| Comparative example 14 | Comparative slab 2 | 1200 | 60 | 860 | — | — | 135 |
| Comparative example 15 | Comparative slab 3 | 1200 | 60 | 873 | — | — | 3 |
| Comparative example 16 | Comparative slab 4 | 1200 | 120 | 880 | — | — | 35 |
| Comparative example 17 | Comparative slab 5 | 1200 | 120 | 880 | — | — | 42 |
| Comparative example 18 | Comparative slab 5 | 1200 | 120 | 880 | — | — | 42 |
| Comparative example 19 | Comparative slab 6 | 1000 | 60 | 785 | 740 | 2 | 115 |
| Comparative example 20 | Comparative slab 7 | 1200 | 60 | 820 | 550 | 2 | 32 |
| Comparative example 21 | Comparative slab 8 | 1200 | 60 | 880 | 657 | 5 | 92 |
| Comparative example 22 | Comparative slab 9 | 1200 | 60 | 865 | 548 | 5 | 91 |

TABLE 5-continued

| | Hot rolling | | | | | | |
|---|---|---|---|---|---|---|---|
| | Winding temperature T4 ° C. | Maintaining time t4 minute | Final sheet thickness mm | Structure Primary phase | Structure Second phase | Distance between second phases d μm | Area ratio of second phase % |
| | | | | F | M, B, A | | |
| Invention example 1 | Room temperature | — | 5 | F | M | 4.2 | 44 |
| Invention example 2 | Room temperature | — | 5 | F | M | 3.3 | 32 |
| Invention example 3 | 730 (reheating) | 60 | 5 | F | M | 2.8 | 68 |
| Invention example 4 | Room temperature | 60 | 5 | F | M | 3.5 | 54 |
| Invention example 5 | Room temperature | 60 | 5 | F | M | 3.5 | 54 |
| Invention example 6 | Room temperature | 60 | 5 | F | M | 3.5 | 54 |
| Invention example 7 | Room temperature | 60 | 5 | F | M | 3.5 | 54 |
| Invention example 8 | 735 (reheating) | 60 | 5 | F | M | 3.3 | 74 |
| Invention example 9 | 650 (reheating) | 60 | 5 | F | M | 2.6 | 82 |
| Invention example 10 | 660 | 60 | 5 | F | M, B, A | 3.2 | 36 |
| Invention example 11 | Room temperature | — | 4.5 | F | M, B, A | 2.9 | 67 |
| Comparative example 1 | Room temperature | — | 5 | F | B, M | 12.2 | 18 |
| Comparative example 2 | Room temperature | — | 5 | F | C, M | 2.6 | 92 |
| Comparative example 3 | Room temperature | — | 5 | F | M | 4.7 | 13 |
| Comparative example 4 | Room temperature | — | 1* | F | M | 4.7 | 13 |
| Comparative example 5 | Room temperature | — | 5 | F | M | 4.2 | 44 |
| Comparative example 6 | Room temperature | — | 5 | F | M | 4.2 | 44 |
| Comparative example 7 | Room temperature | — | 5 | F | M | 4.2 | 44 |
| Comparative example 8 | Room temperature | — | 5 | F | M | 4.2 | 44 |
| Comparative example 9 | Room temperature | — | 5 | F | M | 4.2 | 44 |
| Comparative example 10 | Room temperature | — | 5 | F | M | 4.2 | 44 |
| Comparative example 11 | Room temperature | — | 5 | F | M | 4.2 | 44 |
| Comparative example 12 | 735 (reheating) | 60 | 5 | F | M | 2.2 | 49 |
| Comparative example 13 | Room temperature | — | 5 | P | | | |
| Comparative example 14 | 800 (reheating) | 60 | 5 | F | B, M | 5.6 | 22 |
| Comparative example 15 | 580 | 60 | 5 | F | P | 5.6 | 75 |
| Comparative example 16 | 550 | 120 | 5 | F | P | 8.9 | 11 |
| Comparative example 17 | 550 | 120 | 5 | F | P | 6.7 | 19 |
| Comparative example 18 | 550 | 120 | 5 | F | P | 6.7 | 19 |
| Comparative example 19 | Room temperature | — | 7 | F | C | 15.6 | 3 |
| Comparative example 20 | Room temperature | — | 6 | F | B, C | 4.2 | 36 |
| Comparative example 21 | Room temperature | — | 5 | F | M | 4.5 | 32 |
| Comparative example 22 | Room temperature | — | 5 | F | C | 8.8 | 2 |

P: pearlite
C: cementite
M: martensite
B: bainite
A: residual austenite

TABLE 6

| | | Cold rolling conditions | | | Annealing conditions | | |
|---|---|---|---|---|---|---|---|
| | Compositions Symbols | Sheet thickness | Rolling reduction % | Index of workability D | Pattern | Annealing temperature Ts ° C. | Maintaining time ts second |
| | Standard | | | ≦1.0 | | | |
| Invention example 1 | Invention slab 1 | 1.0 | 80 | 0.84 | 2 | 725 | 120 |
| Invention example 2 | Invention slab 2 | 1.0 | 80 | 0.86 | 2 | 700 | 120 |
| Invention example 3 | Invention slab 3 | 1.5 | 70 | 0.84 | 2 | 700 | 180 |
| Invention example 4 | Invention slab 4 | 1.0 | 80 | 0.70 | 1 | 675 | 120 |
| Invention example 5 | Invention slab 4 | 1.0 | 80 | 0.70 | 2 | 675 | 120 |
| Invention example 6 | Invention slab 4 | 1.0 | 80 | 0.70 | 4 | 675 | 7200 |
| Invention example 7 | Invention slab 4 | 1.0 | 80 | 0.70 | 2 | 700 | 120 |
| Invention example 8 | Invention slab 5 | 1.0 | 80 | 0.66 | 2 | 700 | 120 |
| Invention example 9 | Invention slab 6 | 1.0 | 80 | 0.52 | 1 | 675 | 180 |
| Invention example 10 | Invention slab 7 | 1.5 | 70 | 0.96 | 3 | 725 | 120 |
| Invention example 11 | Invention slab 8 | 1.0 | 78 | 0.64 | 1 | 725 | 120 |
| Comparative example 1 | Invention slab 1 | 0.7 | 86 | 1.71 | 2 | 700 | 120 |
| Comparative example 2 | Invention slab 1 | 1.0 | 80 | 0.52 | 2 | 725 | 120 |
| Comparative example 3 | Invention slab 1 | 0.6 | 88 | 0.56 | 2 | 725 | 120 |
| Comparative example 4 | Invention slab 1 | 1* | 88 | 0.56 | 2 | 725 | 120 |
| Comparative example 5 | Invention slab 1 | 2.3 | 54 | 1.93 | 2 | 725 | 120 |
| Comparative example 6 | Invention slab 1 | 1.0 | 80 | 0.84 | 5 | 700 | 7200 |
| Comparative example 7 | Invention slab 1 | 1.0 | 80 | 0.84 | 2 | 690 | 120 |

TABLE 6-continued

| | | | | | | | |
|---|---|---|---|---|---|---|---|
| Comparative example 8 | Invention slab 1 | 1.0 | 80 | 0.84 | 2 | 770 | 120 |
| Comparative example 9 | Invention slab 1 | 1.0 | 80 | 0.84 | 2 | 800 | 120 |
| Comparative example 10 | Invention slab 1 | 1.0 | 80 | 0.84 | 2 | 850 | 120 |
| Comparative example 11 | Invention slab 1 | 0.5 | 90 | 0.42 | 2 | 700 | 120 |
| Comparative example 12 | Invention slab 4 | 1.2 | 76 | 0.53 | 2 | 700 | 120 |
| Comparative example 13 | Comparative slab 1 | 1.5 | 70 | | 2 | 725 | 120 |
| Comparative example 14 | Comparative slab 2 | 0.8 | 84 | 0.90 | 2 | 700 | 120 |
| Comparative example 15 | Comparative slab 3 | 1.5 | 70 | 1.68 | 2 | 780 | 120 |
| Comparative example 16 | Comparative slab 4 | 1.0 | 80 | 1.78 | 1 | 770 | 60 |
| Comparative example 17 | Comparative slab 5 | 1.0 | 80 | 1.34 | 1 | 790 | 60 |
| Comparative example 18 | Comparative slab 5 | 1.0 | 80 | 1.34 | 1 | 760 | 60 |
| Comparative example 19 | Comparative slab 6 | 1.0 | 86 | 2.23 | 2 | 780 | 60 |
| Comparative example 20 | Comparative slab 7 | 1.0 | 83 | 0.7 | 2 | 750 | 120 |
| Comparative example 21 | Comparative slab 8 | 1.0 | 80 | 0.90 | 2 | 700 | 120 |
| Comparative example 22 | Comparative slab 9 | 1.0 | 80 | 1.76 | 2 | 745 | 120 |

| | Annealing conditions | | | | | Rate of |
|---|---|---|---|---|---|---|
| | Start temperature of cooling $T_O$ | Cooling method | Cooling rate Rc ° C./s | Overaging temperature $T_{OA}$ ° C. | Time $t_{OA}$ second | elongation performed by skin-pass rolling % |
| Invention example 1 | 722 | WQ | 122 | — | — | 0.5 |
| Invention example 2 | 695 | WQ | 115 | — | — | 0.5 |
| Invention example 3 | 695 | Gas | 24 | — | — | 0.5 |
| Invention example 4 | 670 | Gas | 18 | 350 | 120 | 2.0 |
| Invention example 5 | 670 | WQ | 189 | — | — | 0.5 |
| Invention example 6 | 660 | Gas | 12 | — | — | 0.5 |
| Invention example 7 | 690 | Gas | 31 | — | — | 0.5 |
| Invention example 8 | 695 | Gas | 24 | — | — | 0.5 |
| Invention example 9 | 670 | Spraying with water | 85 | 350 | 300 | 1.5 |
| Invention example 10 | 720 | Spraying with water | 112 | 350 | 300 | 0.5 |
| Invention example 11 | 720 | Gas | 28 | 400 | 300 | 1.0 |
| Comparative example 1 | 695 | Gas | 24 | — | — | 0.5 |
| Comparative example 2 | 720 | Gas | 25 | — | — | 0.5 |
| Comparative example 3 | 720 | Gas | 25 | — | — | 0.5 |
| Comparative example 4 | 720 | Gas | 23 | — | — | 0.5 |
| Comparative example 5 | 720 | Gas | 22 | — | — | 0.5 |
| Comparative example 6 | 685 | Gas | 25 | — | — | 0.5 |
| Comparative example 7 | 685 | WQ | 125 | — | — | 0.5 |
| Comparative example 8 | 765 | Gas | 25 | — | — | 0.5 |
| Comparative example 9 | 795 | Gas | 25 | — | — | 0.5 |
| Comparative example 10 | 845 | Gas | 25 | — | — | 0.5 |
| Comparative example 11 | 695 | WQ | 112 | — | — | 0.5 |
| Comparative example 12 | 695 | Gas | 25 | — | — | 0.5 |
| Comparative example 13 | 720 | Gas | 5 | — | — | 10 |
| Comparative example 14 | 695 | Gas | 12 | — | — | 10 |
| Comparative example 15 | 775 | Gas | 24 | — | — | 10 |
| Comparative example 16 | 765 | Spraying with water | 32 | 400 | 300 | 10 |
| Comparative example 17 | 785 | Spraying with water | 33 | 400 | 300 | 10 |
| Comparative example 18 | 755 | Gas | | 300 | 120 | 10 |
| Comparative example 19 | 775 | WQ | 125 | — | — | 10 |
| Comparative example 20 | 745 | Gas | 3 | — | — | 10 |
| Comparative example 21 | 695 | WQ | 125 | — | — | 10 |
| Comparative example 22 | 740 | WQ | 133 | — | — | 10 |

WQ: Water quenching

TABLE 7

| | | Annealed structure | | | | |
|---|---|---|---|---|---|---|
| | | | | Ferrite phase | | |
| | Compositions Symbols | Primary phase | Second phase | Rate of nano ferrite % | Average grain size ds (nanograins) | Average grain size dL (micrograins) |
| | Standard | F | M, B, A | 15~90 | | |
| Invention example 1 | Invention slab 1 | F | M | 15 | 0.53 | 1.62 |
| Invention example 2 | Invention slab 2 | F | M | 57 | 0.57 | 1.98 |
| Invention example 3 | Invention slab 3 | F | M | 88 | 0.52 | 1.75 |

TABLE 7-continued

| | | | | | | |
|---|---|---|---|---|---|---|
| Invention example 4 | Invention slab 4 | F | M, B, A | 83 | 0.42 | 1.94 |
| Invention example 5 | Invention slab 4 | F | M | 73 | 0.46 | 1.62 |
| Invention example 6 | Invention slab 4 | F | M | 37 | 0.56 | 1.76 |
| Invention example 7 | Invention slab 4 | F | M | 75 | 0.43 | 1.65 |
| Invention example 8 | Invention slab 5 | F | M | 48 | 0.56 | 1.73 |
| Invention example 9 | Invention slab 6 | F | M, B, A | 87 | 0.45 | 1.54 |
| Invention example 10 | Invention slab 7 | F | B, A | 67 | 0.58 | 1.88 |
| Invention example 11 | Invention slab 8 | F | B, A | 82 | 0.48 | 1.56 |
| Comparative example 1 | Invention slab 1 | F | M | 0 | — | 5.52 |
| Comparative example 2 | Invention slab 1 | F | M | 2 | 1.08 | 3.55 |
| Comparative example 3 | Invention slab 1 | F | M | 6 | 1.02 | 1.88 |
| Comparative example 4 | Invention slab 1 | F | M | 18 | 0.53 | 1.88 |
| Comparative example 5 | Invention slab 1 | F | M | 0 | — | 8.70 |
| Comparative example 6 | Invention slab 1 | F | M | 0 | — | 3.22 |
| Comparative example 7 | Invention slab 1 | F | M, C | 33 | 0.56 | 1.75 |
| Comparative example 8 | Invention slab 1 | F | M | 14 | 0.98 | 1.62 |
| Comparative example 9 | Invention slab 1 | F | M | 0 | — | 2.85 |
| Comparative example 10 | Invention slab 1 | F | M | 0 | — | 1.45 |
| Comparative example 11 | Invention slab 1 | F | M | 99 | 0.43 | 1.22 |
| Comparative example 12 | Invention slab 4 | F | M | 97 | 0.45 | 1.29 |
| Comparative example 13 | Comparative slab 1 | F | C | 95 | 0.55 | 1.45 |
| Comparative example 14 | Comparative slab 2 | F | C | 12 | 0.89 | 3.55 |
| Comparative example 15 | Comparative slab 3 | F | P | 2 | 0.89 | 2.47 |
| Comparative example 16 | Comparative slab 4 | F | B, A | 0 | — | 4.68 |
| Comparative example 17 | Comparative slab 5 | F | B, A | 4 | 1.02 | 3.25 |
| Comparative example 18 | Comparative slab 5 | F | B, A | 5 | 0.98 | 3.19 |
| Comparative example 19 | Comparative slab 6 | F | B, C | 0 | — | 3.24 |
| Comparative example 20 | Comparative slab 7 | F | M | 2 | 1.06 | 3.45 |
| Comparative example 21 | Comparative slab 8 | F | C | 66 | 0.64 | 1.55 |
| Comparative example 22 | Comparative slab 9 | F | C | 0 | — | 2.55 |

| | Annealed structure | | | | Static material characteristics | | | | |
|---|---|---|---|---|---|---|---|---|---|
| | | Second phase | | | Yield | Tensile | | | |
| | dL/ds | Average area ratio A (ave) % | Standard deviations | s/A (ave) | point (YP) MPa | strength (TS) MPa | Amount of BH MPa | Overall elongation (t-El) % | TSx t-El MPa % |
| | ≧3 | 30~70 | | ≦0.6 | | | | | |
| Invention example 1 | 3.1 | 32 | 13.5 | 0.42 | 525 | 788 | 65 | 33 | 26004 |
| Invention example 2 | 3.5 | 30 | 8.9 | 0.30 | 806 | 918 | 52 | 25 | 22950 |
| Invention example 3 | 3.4 | 36 | 14 | 0.39 | 698 | 1072 | 58 | 28 | 30016 |
| Invention example 4 | 4.7 | 32 | 14 | 0.44 | 952 | 1166 | 88 | 19 | 22163 |
| Invention example 5 | 3.5 | 35 | 9 | 0.26 | 790 | 1122 | 112 | 23 | 25815 |
| Invention example 6 | 3.1 | 38 | 17 | 0.45 | 508 | 1032 | 88 | 19 | 20000 |
| Invention example 7 | 3.8 | 41 | 12 | 0.29 | 996 | 1346 | 103 | 17 | 22886 |
| Invention example 8 | 3.1 | 47 | 14 | 0.30 | 1022 | 1526 | 102 | 15 | 22894 |
| Invention example 9 | 3.5 | 55 | 30 | 0.55 | 770 | 1580 | 135 | 17 | 26855 |
| Invention example 10 | 3.2 | 67 | 18 | 0.27 | 573 | 1326 | 134 | 29 | 38454 |
| Invention example 11 | 3.3 | 53 | 12 | 0.23 | 640 | 1539 | 171 | 21 | 32310 |
| Comparative example 1 | — | 8 | 5.6 | 0.70 | 585 | 670 | 12 | 23 | 15408 |
| Comparative example 2 | 3.3 | 16 | 12 | 0.75 | 495 | 735 | 34 | 25 | 18375 |
| Comparative example 3 | 1.8 | 19 | 14 | 0.75 | 489 | 745 | 23 | 24 | 17880 |
| Comparative example 4 | 3.5 | 21 | 12 | 0.57 | 528 | 785 | 29 | 31 | 24335 |
| Comparative example 5 | — | 12 | 10 | 0.83 | 433 | 688 | 18 | 27 | 18576 |
| Comparative example 6 | — | 22 | 17 | 0.77 | 338 | 555 | 5 | 31 | 17205 |
| Comparative example 7 | 3.1 | 9 | 6.6 | 0.75 | 768 | 729 | 36 | 27 | 19878 |
| Comparative example 8 | 1.6 | 19 | 17 | 0.89 | 459 | 774 | 38 | 26 | 20124 |
| Comparative example 9 | — | 48 | | 0.00 | 556 | 896 | 24 | 21 | 18808 |
| Comparative example 10 | — | 85 | | 0.00 | 1021 | 1174 | 12 | 8 | 9390 |
| Comparative example 11 | 2.8 | 13 | 4 | 0.31 | 790 | 870 | 8 | 21 | 18270 |
| Comparative example 12 | 2.9 | 33 | 11 | 0.33 | 1160 | 1255 | 12 | 8 | 10149 |
| Comparative example 13 | 2.6 | 56 | 23 | 0.41 | 854 | 887 | 2 | 12 | 10644 |
| Comparative example 14 | 4.0 | 4 | 2.3 | 0.66 | 450 | 492 | 22 | 32 | 15547 |
| Comparative example 15 | 2.8 | 33 | 25 | 0.76 | 568 | 888 | 0 | 19 | 13072 |
| Comparative example 16 | — | 25 | 23 | 0.92 | 446 | 806 | 48 | 32 | 25778 |
| Comparative example 17 | 3.2 | 46 | 32 | 0.70 | 729 | 1098 | 53 | 28 | 30744 |
| Comparative example 18 | 3.3 | 38 | 28 | 0.78 | 745 | 1124 | 52 | 24 | 26978 |
| Comparative example 19 | — | 3 | 2.2 | 0.73 | 310 | 465 | 18 | 36 | 16740 |
| Comparative example 20 | 3.3 | 18 | 15 | 0.83 | 455 | 662 | 34 | 24 | 15888 |
| Comparative example 21 | 2.4 | 13 | 5.5 | 0.44 | 1098 | 1236 | 23 | 7 | 8852 |
| Comparative example 22 | — | 2 | 1.5 | 0.75 | 898 | 989 | 14 | 13 | 12597 |

P: pearlite
C: cementite
M: martensite
B: bainite
A: residual austenite

Figure 6:
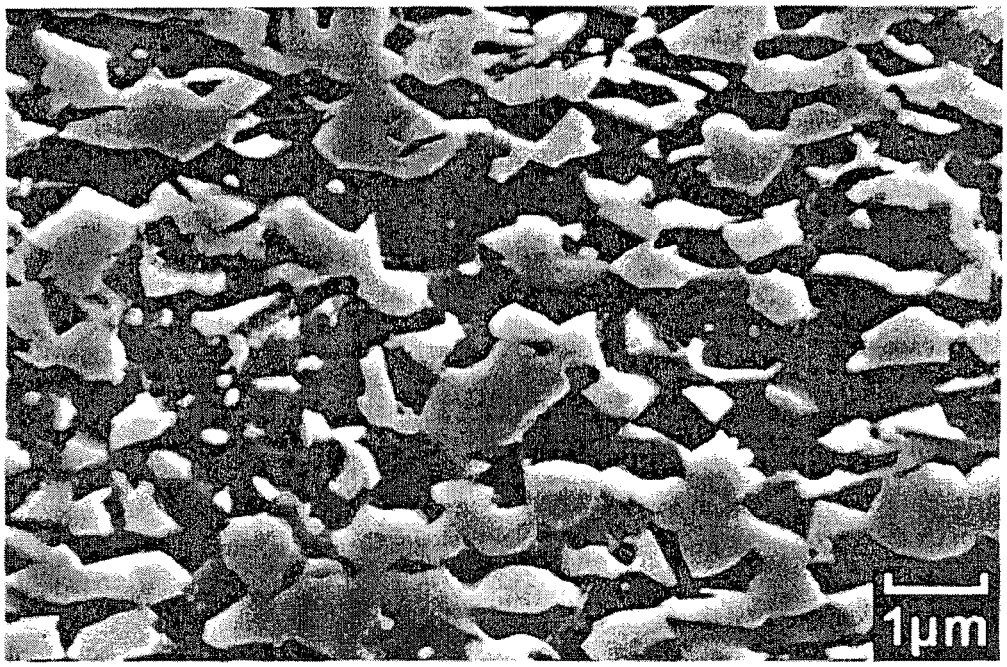
FIG. 6 is a scanning electron microscope (SEM) image showing a structure of a high-strength steel sheet of an example of the present invention.
Figure 7:
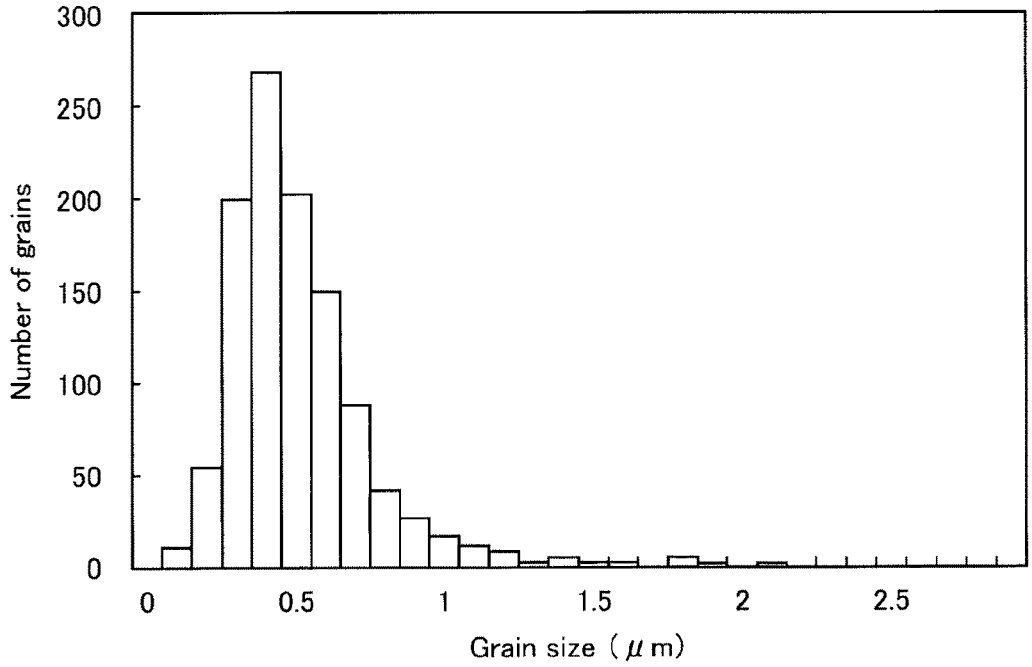
FIG. 7 is a graph showing grain size distribution of ferrite phase of an example of the present invention.

A cross section parallel to the rolling direction was cut out from the steel sheet of invention example 11 and was etched with a solution of 1% of nitric acid and ethanol, so that structure thereof could be observed by SEM. The structure is shown in FIG. 6. The structure shown in FIG. 6 is a two-phase structure consisting of ferrite (black portions) and hard phase (white portions) including residual austenite and bainite, and most of the ferrite phases are nanograins. Grain distribution of the ferrite phases of the invention example 11 was measured, and the result is shown in FIG. 7.

Figure 8:
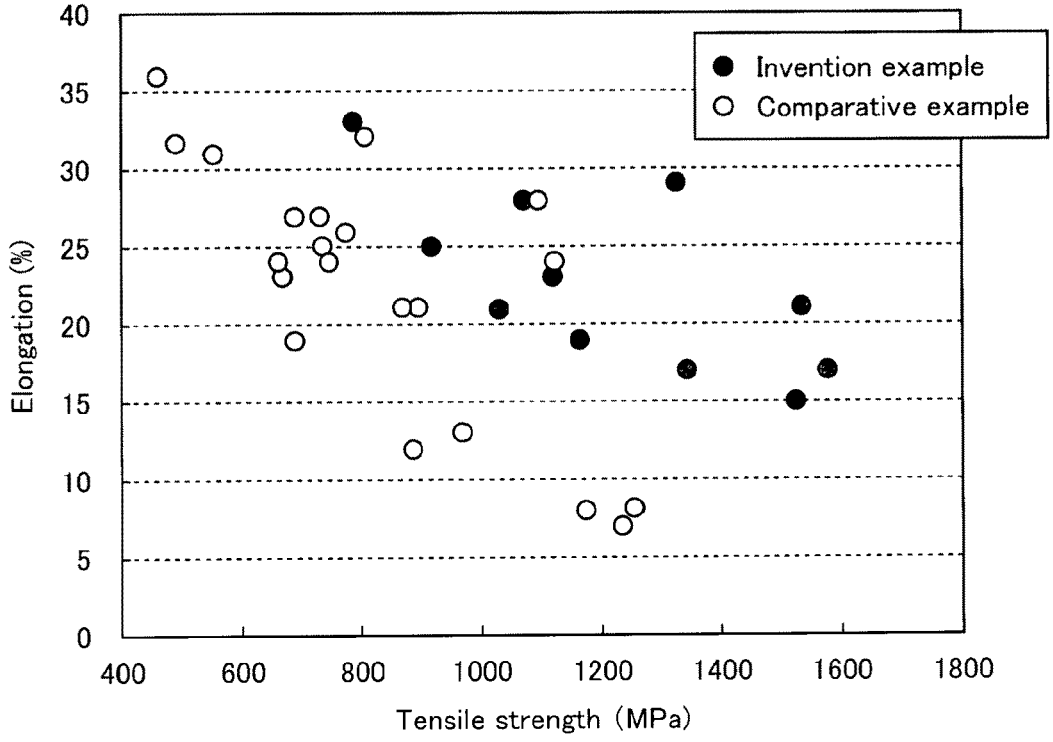
FIG. 8 is a graph showing a relationship between tensile strength and elongation in an example.

FIG. 8 shows a relationship of tensile strength and elongation with respect to invention examples and comparative examples. As shown in FIG. 8, the invention examples have good balance of strength and ductility compared to those of the comparative examples. The three points of comparative examples 16, 17, and 18 at the same positions as the points of the invention examples were obtained by conventional technique, and the steel sheets of the comparative examples have good balance of strength and ductility by adding alloying elements in larger amount than the cases of the invention examples.

The comparative example 16 was produced by conventional method (Japanese Unexamined Patent Application Publication No. 62-182225) using a steel including 0.16% of C, and the steel sheet of the comparative example 16 exhibited tensile strength of around 800 MPa. According to the invention example 1 of the present invention, a steel sheet having strength and ductility comparable to those of the steel sheet of the comparative example 16 can be obtained from a raw material including approximately 0.1% of C.

The comparative examples 17 and 18 were produced by conventional method (Japanese Unexamined Patent Application Publication No. 62-182225) using a steel including 0.36% of C, and the steel sheets of the comparative examples 17 and 18 exhibited tensile strengths of around 1100 MPa. According to the invention examples 3 and 5 of the present invention, a steel sheet having strength and ductility comparable to those of the steel sheets of the comparative examples 17 and 18 can be obtained from a raw material including 0.2% or 0.15% of C.

According to the invention examples 7 to 11, steel sheets having tensile strength of 1300 MPa or more and exhibiting elongation of not less than 15%, which cannot be produced by conventional techniques, can be produced by the method of the present invention.

If the amount of C is large, nugget hardness is greatly increased when spot welding is performed, and notching sensitivity of the steel is increased, whereby CTS (cross tension strength) is not increased according to increase in TSS (tensile shear strength) even when a steel is strengthened. Therefore, in a case in which a high-strength steel sheet is used and the thickness thereof is reduced, the welding point must be increased. Table 8 shows spot welding strength of invention examples 1, 5, and 11 and comparative examples 16 to 18.

TABLE 8

| | TS MPa | Sheet thickness mm | Nugget diameter mm | Tensile shear strength TSS kN | Cross tension strength CTS kN | CTS/TSS |
|---|---|---|---|---|---|---|
| Invention example 1 | 788 | 1 | 6.2 | 16 | 8 | 0.50 |
| Invention example 5 | 1122 | 1 | 6.4 | 21.5 | 9.2 | 0.43 |
| Invention example 11 | 1539 | 1 | 6.3 | 26.3 | 9.1 | 0.35 |
| Comparative example 16 | 806 | 1 | 6.1 | 16.1 | 7.1 | 0.44 |
| Comparative example 17 | 1098 | 1 | 6.2 | 20.7 | 7.5 | 0.36 |
| Comparative example 18 | 1124 | 1 | 6.3 | 21.3 | 7.7 | 0.36 |

Welding was performed by using a D type electrode having a diameter of 6 mm specified by JIS C9304 while applying 350 kgf of pressure and conducting electric current for 18 cycles; nugget diameter of the cross section of the steel was measured according to JIS Z3139. TSS and CTS were measured according to JIS Z3136 and Z3137. The invention examples had small amounts of C, whereby CTS were larger than those of the comparative examples having similar strength, and spot welding strengths were good. When the amount of C was 0.4%, as in the invention example 11, TSS was increased in accordance with the increase in the tensile strength, but CTS was scarcely increased. That is, cross tension strength of spot welding was not easily increased. In this case, laser butt welding or friction stir welding may be used when the amount of the notch shaped portion is small, and a method which may not produce a hardened structure even when there is a notch shaped portion, such as rivet welding, swaging, and spot friction stir welding may be used, whereby good bonding strength can be secured.

The steel sheet of the present invention may be used as a cold rolled steel sheet and may also be used by applying hot dip galvanizing or hot dip galvannealing in the above-described CGL (continuous galvanizing line), electrogalvanizing in an electrogalvanizing line, or organic coating treatment on the plated layer so as to improve corrosion resistance.

2. Second Example

Slabs (invention slabs 9 to 19 and comparative slabs 10 to 14), having chemical compositions shown in Table 9, were ingoted. "Invention slab" indicates a material that exhibits characteristics in the above-described preferable range, and "comparative slab" represents the other material.

TABLE 9

| | Composition C % | Si % | Mn % | P % | S % | Al % | Nb % | Ti % | V % | Cr % | Mo % | Ni % | B % | N % |
|---|---|---|---|---|---|---|---|---|---|---|---|---|---|---|
| Invention slab 9 | 0.050 | 0.49 | 1.22 | 0.002 | 0.005 | 0.051 | 0.022 | 0.001 | 0.01 | 0.01 | 0.19 | 0.02 | 0.0012 | 0.004 |
| Invention slab 10 | 0.151 | 0.01 | 2.01 | 0.05 | 0.002 | 0.021 | 0.023 | 0.002 | 0.01 | 0.01 | 0.15 | 0.01 | 0.0002 | 0.013 |
| Invention slab 11 | 0.102 | 0.01 | 2.02 | 0.001 | 0.002 | 0.025 | 0.02 | 0.002 | 0.01 | 0.01 | 0.001 | 0.01 | 0.0002 | 0.003 |
| Invention slab 12 | 0.099 | 0.01 | 2.01 | 0.001 | 0.002 | 0.021 | 0.05 | 0.002 | 0.01 | 0.01 | 0.001 | 0.01 | 0.0018 | 0.004 |
| Invention slab 13 | 0.098 | 0.02 | 2.99 | 0.002 | 0.003 | 0.045 | 0.02 | 0.001 | 0.01 | 0.01 | 0.001 | 0.01 | 0.0001 | 0.004 |

TABLE 9-continued

| | | | | | | | | | | | | | | |
|---|---|---|---|---|---|---|---|---|---|---|---|---|---|---|
| Invention slab 14 | 0.221 | 0.03 | 3.04 | 0.003 | 0.004 | 0.02 | 0.05 | 0.001 | 0.01 | 0.01 | 0.001 | 1.03 | 0.0001 | 0.003 |
| Invention slab 15 | 0.098 | 0.01 | 2.01 | 0.02 | 0.003 | 0.024 | 0.023 | 0.002 | 0.01 | 0.01 | 0.001 | 0.01 | 0.0002 | 0.021 |
| Invention slab 16 | 0.151 | 0.01 | 1.98 | 0.002 | 0.003 | 0.02 | 0.01 | 0.032 | 0.3 | 0.01 | 0.15 | 0.01 | 0.0002 | 0.004 |
| Invention slab 17 | 0.15 | 0.03 | 2.51 | 0.005 | 0.002 | 0.035 | 0.021 | 0.012 | 0.01 | 0.01 | 0.16 | 2.02 | 0.0001 | 0.026 |
| Invention slab 18 | 0.13 | 0.01 | 0.37 | 0.014 | 0.007 | 0.051 | 0.001 | 0.002 | 0.01 | 0.01 | 0.001 | 0.01 | 0.0028 | 0.004 |
| Invention slab 19 | 0.146 | 1.6 | 1.53 | 0.002 | 0.0009 | 0.028 | 0.019 | 0.001 | 0.01 | 0.01 | 0.001 | 0.01 | 0.0001 | 0.007 |
| Comparative slab 10 | 0.35 | 0.2 | 0.7 | 0.01 | 0.008 | 0.02 | 0.001 | 0.001 | 0.01 | 1.02 | 0.21 | 0.01 | 0.0001 | 0.005 |
| Comparative slab 11 | 0.251 | 0.2 | 0.7 | 0.01 | 0.008 | 0.02 | 0.001 | 0.001 | 0.01 | 0.01 | 0.001 | 0.01 | 0.0001 | 0.004 |
| Comparative slab 12 | 0.028 | 0.319 | 1.18 | 0.003 | 0.001 | 0.022 | 0.053 | 0.001 | 0.01 | 0.52 | 0.001 | 0.02 | 0.0024 | 0.002 |
| Comparative slab 13 | 0.101 | 1.05 | 2.51 | 0.188 | 0.002 | 0.137 | 0.023 | 0.002 | 0.01 | 0.01 | 1.030 | 0.02 | 0.0001 | 0.004 |
| Comparative slab 14 | 0.152 | 0.02 | 3.03 | 0.002 | 0.002 | 0.024 | 0.02 | 0.03 | 0.65 | 0.01 | 0.001 | 1.02 | 0.0038 | 0.003 |

| | $F_1(Q)$ | | | $F_2(S) + F_3(P)$ | | C(ss) | |
|---|---|---|---|---|---|---|---|
| | | ≧−40 C. | ≧25 C. | | | | |
| | Standard | +6.0 Result | −2.5 Result | Standard | ≦360 Result | Standard | 0.02~0.3 Result |
| Invention slab 9 | 6.96 | OK | OK | 219 | OK | 0.045 | OK |
| Invention slab 10 | 7.01 | OK | OK | 241 | OK | 0.145 | OK |
| Invention slab 11 | 6.69 | OK | OK | 223 | OK | 0.097 | OK |
| Invention slab 12 | 9.86 | OK | OK | 238 | OK | 0.090 | OK |
| Invention slab 13 | 9.51 | OK | OK | 325 | OK | 0.093 | OK |
| Invention slab 14 | 9.97 | OK | OK | 346 | OK | 0.212 | OK |
| Invention slab 15 | 6.66 | OK | OK | 227 | OK | 0.092 | OK |
| Invention slab 16 | 10.17 | OK | OK | 324 | OK | 0.070 | OK |
| Invention slab 17 | 8.99 | OK | OK | 312 | OK | 0.142 | OK |
| Invention slab 18 | 6.78 | OK | OK | 66 | OK | 0.127 | OK |
| Invention slab 19 | 6.01 | OK | OK | 353 | OK | 0.141 | OK |
| Comparative slab 10 | 5.03 | OK | NG | 125 | OK | 0.347 | NG |
| Comparative slab 11 | 2.53 | OK | NG | 104 | OK | 0.248 | OK |
| Comparative slab 12 | 9.71 | OK | OK | 198 | OK | 0.019 | NG |
| Comparative slab 13 | 11.06 | OK | OK | 523 | NG | 0.095 | OK |
| Comparative slab 14 | 17.33 | OK | OK | 524 | NG | 0 | NG |

Hot-rolled steel sheets were produced by using these slabs under conditions shown in Table 10, and then steel sheets (invention examples 12 to 29 and comparative examples 23 to 41) including annealed structures shown in Table 12 were obtained by cold rolling, annealing, and skin-pass rolling the hot-rolled steel sheets under conditions shown in Table 11. After two marking-off lines were formed on the steel sheet so as to have a distance of 200 mm therebetween and be perpendicular to the rolling direction of the steel sheet, skin-pass rolling was performed. The distance between the marking-off lines before rolling was subtracted from the distance between the marking-off lines after rolling, and the result was divided by the distance between the marking-off lines before rolling, whereby rate of elongation performed by skin-pass rolling shown in Tables 6 and 11 was calculated. The invention example 12 was obtained by machining both sides of a hot-rolled steel sheet to have a sheet thickness of 1.2 mm and performing accumulative roll-bonding for 3 cycles. Total rolling reduction of this accumulative roll-bonding corresponded to 88%.

TABLE 10

| | | Hot rolling | | | | | |
|---|---|---|---|---|---|---|---|
| | Compositions Symbol | Heating temperature T1 ° C. | Heating time t1 minute | Temperature when rolling is finished T2 ° C. | Maintaining temperature T3 ° C. | Maintaining time t3 second | Cooling rate R3 ° C./s |
| | Standard | | | | | | |
| Invention example 12 | Invention slab 9 | 1200 | 120 | 880 | 650 | 5 | 88 |
| Invention example 13 | Invention slab 10 | 1200 | 120 | 860 | 550 | 10 | 122 |
| Invention example 14 | Invention slab 10 | 1200 | 120 | 860 | 550 | 10 | 122 |
| Invention example 15 | Invention slab 10 | 1200 | 120 | 860 | 550 | 10 | 122 |
| Invention example 16 | Invention slab 11 | 1200 | 120 | 880 | 660 | 5 | 122 |
| Invention example 17 | Invention slab 11 | 1200 | 120 | 880 | 750 | 5 | 134 |
| Invention example 18 | Invention slab 12 | 1200 | 120 | 880 | 600 | 5 | 104 |
| Invention example 19 | Invention slab 12 | 1200 | 120 | 880 | 600 | 5 | 104 |
| Invention example 20 | Invention slab 12 | 1200 | 120 | 880 | 600 | 5 | 104 |
| Invention example 21 | Invention slab 12 | 1200 | 120 | 880 | 600 | 5 | 104 |
| Invention example 22 | Invention slab 13 | 1200 | 60 | 840 | 620 | 5 | 135 |
| Invention example 23 | Invention slab 14 | 1200 | 60 | 820 | 500 | 2 | 112 |
| Invention example 24 | Invention slab 15 | 1000 | 120 | 860 | 670 | 10 | 78 |
| Invention example 25 | Invention slab 15 | 1000 | 120 | 860 | 670 | 10 | 78 |
| Invention example 26 | Invention slab 16 | 1200 | 120 | 880 | 680 | 5 | 118 |
| Invention example 27 | Invention slab 17 | 1200 | 120 | 880 | — | — | 118 |
| Invention example 28 | Invention slab 18 | 1200 | 60 | 860 | — | — | 135 |

TABLE 10-continued

| | | | | | | | |
|---|---|---|---|---|---|---|---|
| Invention example 29 | Invention slab 19 | 1200 | 60 | 830 | 680 | 5 | 125 |
| Comparative example 23 | Invention slab 12 | 1200 | 120 | 880 | 600 | 5 | 104 |
| Comparative example 24 | Invention slab 12 | 1200 | 120 | 880 | 600 | 5 | 104 |
| Comparative example 25 | Invention slab 18 | 1200 | 60 | 860 | — | — | 135 |
| Comparative example 26 | Invention slab 9 | 1200 | 120 | 880 | 600 | 5 | 122 |
| Comparative example 27 | Invention slab 9 | 1200 | 120 | 880 | 780 | 10 | 25 |
| Comparative example 28 | Invention slab 10 | 1200 | 120 | 860 | 550 | 10 | 115 |
| Comparative example 29 | Invention slab 10 | 1200 | 120 | 860 | 550 | 10 | 122 |
| Comparative example 30 | Invention slab 10 | 1200 | 120 | 860 | 550 | 10 | 117 |
| Comparative example 31 | Invention slab 10 | 1200 | 120 | 860 | 550 | 10 | 122 |
| Comparative example 32 | Invention slab 10 | 1200 | 120 | 860 | 550 | 10 | 107 |
| Comparative example 33 | Invention slab 10 | 1200 | 120 | 860 | 550 | 10 | 122 |
| Comparative example 34 | Invention slab 17 | 1200 | 120 | 700 | 600 | 10 | 104 |
| Comparative example 35 | Invention slab 15 | 1000 | 120 | 860 | 670 | 10 | 78 |
| Comparative example 36 | Invention slab 11 | 1200 | 120 | 860 | 550 | 10 | 122 |
| Comparative example 37 | Comparative slab 10 | 1200 | 60 | 873 | — | — | 3 |
| Comparative example 38 | Comparative slab 11 | 1200 | 60 | 870 | 600 | 5 | 35 |
| Comparative example 39 | Comparative slab 12 | 1200 | 60 | 880 | 657 | 5 | 92 |
| Comparative example 40 | Comparative slab 13 | 1200 | 60 | 885 | 548 | 5 | 91 |
| Comparative example 41 | Comparative slab 14 | 1000 | 60 | 785 | 740 | 2 | 115 |

| | Hot rolling | | | | | | |
|---|---|---|---|---|---|---|---|
| | Winding temperature | Maintaining time | Final sheet | Structure | | Distance between second | Area ratio of |
| | T4 ° C. | t4 minute | thickness mm | Primary phase | Second phase | phases d μm | second phase % |
| | | | | F | M, B, A | 2.5~5 | 10~85 |
| Invention example 12 | Room temperature | — | 6 | F | M | 4.8 | 12 |
| Invention example 13 | Room temperature | — | 5 | F | M | 4.2 | 44 |
| Invention example 14 | Room temperature | — | 5 | F | M | 4.2 | 44 |
| Invention example 15 | Room temperature | — | 5 | F | M | 4.2 | 44 |
| Invention example 16 | Room temperature | — | 5 | F | M | 4.2 | 34 |
| Invention example 17 | Room temperature | — | 5 | F | M | 2.7 | 85 |
| Invention example 18 | Room temperature | — | 5 | F | M | 4.6 | 34 |
| Invention example 19 | Room temperature | — | 5 | F | M | 4.6 | 34 |
| Invention example 20 | Room temperature | — | 5 | F | M | 4.6 | 34 |
| Invention example 21 | Room temperature | — | 5 | F | M | 4.6 | 34 |
| Invention example 22 | Room temperature | — | 5 | F | M | 3.3 | 32 |
| Invention example 23 | Room temperature | — | 5 | F | M | 3.1 | 48 |
| Invention example 24 | Room temperature | — | 4 | F | M | 4.7 | 48 |
| Invention example 25 | Room temperature | — | 4 | F | M | 4.7 | 48 |
| Invention example 26 | Room temperature | — | 5 | F | M | 3.6 | 56 |
| Invention example 27 | 680 | 60 | 5 | F | M | 3.6 | 68 |
| Invention example 28 | 800 (reheating) | 60 | 4 | F | B, M | 4.9 | 33 |
| Invention example 29 | Room temperature | — | 5 | F | B, A | 4.8 | 37 |
| Comparative example 23 | Room temperature | — | 5 | F | M | 4.6 | 34 |
| Comparative example 24 | Room temperature | — | 5 | F | M | 4.6 | 34 |
| Comparative example 25 | 800 (reheating) | 60 | 4 | F | B, M | 4.9 | 33 |
| Comparative example 26 | Room temperature | — | 5 | F | M | 4.7 | 6 |
| Comparative example 27 | Room temperature | — | 5 | F | B, M | 12.2 | 18 |
| Comparative example 28 | Room temperature | — | 5 | F | M | 4.2 | 44 |
| Comparative example 29 | Room temperature | — | 5 | F | M | 4.2 | 44 |
| Comparative example 30 | Room temperature | — | 5 | F | M | 4.2 | 44 |
| Comparative example 31 | Room temperature | — | 5 | F | M | 4.2 | 44 |
| Comparative example 32 | Room temperature | — | 5 | F | M | 4.2 | 44 |
| Comparative example 33 | Room temperature | — | 5 | F | M | 4.2 | 95 |
| Comparative example 34 | Room temperature | — | 5 | F | M | 2.2 | 58 |
| Comparative example 35 | Room temperature | — | 4 | F | M | 4.7 | 48 |
| Comparative example 36 | Room temperature | — | 5 | F | M | 4.2 | 44 |
| Comparative example 37 | 580 | 60 | 5 | F | P | 5.6 | 75 |
| Comparative example 38 | Room temperature | — | 5 | F | P, B | 5.2 | 38 |
| Comparative example 39 | Room temperature | — | 5 | F | M | 4.5 | 18 |
| Comparative example 40 | Room temperature | — | 5 | F | M | 3.6 | 43 |
| Comparative example 41 | Room temperature | — | 7 | F | B | 8.9 | 8 |

P: pearlite
C: cementite
M: martensite
B: bainite
A: residual austenite

TABLE 11

| | | Cold rolling conditions | | | Annealing conditions | | |
|---|---|---|---|---|---|---|---|
| | | | | | | Annealing temperature | Maintaining |
| | Composition Symbol | Sheet thickness | Rolling reduction % | Index of workability D | Pattern | Ts ° C. | time ts |
| | Standard | | | 0.5~1.0 | | | |
| Invention example 12 | Invention slab 9 | 1.2* | 88 | 0.96 | 2 | 675 | 5 |
| Invention example 13 | Invention slab 10 | 1.0 | 80 | 0.84 | 2 | 690 | 120 |
| Invention example 14 | Invention slab 10 | 1.0 | 80 | 0.84 | 2 | 700 | 120 |
| Invention example 15 | Invention slab 10 | 1.0 | 80 | 0.84 | 4 | 580 | 18000 |
| Invention example 16 | Invention slab 11 | 1.0 | 80 | 0.84 | 2 | 700 | 20 |
| Invention example 17 | Invention slab 11 | 1.0 | 80 | 0.54 | 2 | 650 | 600 |
| Invention example 18 | Invention slab 12 | 1.0 | 80 | 0.92 | 2 | 680 | 120 |
| Invention example 19 | Invention slab 12 | 1.0 | 80 | 0.92 | 2 | 680 | 120 |
| Invention example 20 | Invention slab 12 | 1.0 | 80 | 0.92 | 2 | 680 | 120 |
| Invention example 21 | Invention slab 12 | 1.0 | 80 | 0.92 | 2 | 680 | 120 |
| Invention example 22 | Invention slab 13 | 1.0 | 80 | 0.66 | 2 | 660 | 120 |
| Invention example 23 | Invention slab 14 | 1.5 | 70 | 0.93 | 2 | 660 | 120 |
| Invention example 24 | Invention slab 15 | 0.8 | 80 | 0.94 | 2 | 680 | 120 |
| Invention example 25 | Invention slab 15 | 0.8 | 80 | 0.94 | 4 | 650 | 7200 |
| Invention example 26 | Invention slab 16 | 1.0 | 80 | 0.72 | 3 | 700 | 120 |
| Invention example 27 | Invention slab 17 | 1.0 | 80 | 0.72 | 2 | 690 | 120 |
| Invention example 28 | Invention slab 18 | 0.8 | 80 | 0.98 | 2 | 725 | 10 |
| Invention example 29 | Invention slab 19 | 1.0 | 80 | 0.86 | 1 | 725 | 60 |
| Comparative example 23 | Invention slab 12 | 1.0 | 80 | 0.92 | 2 | 680 | 120 |
| Comparative example 24 | Invention slab 12 | 1.0 | 80 | 0.92 | 2 | 680 | 120 |
| Comparative example 25 | Invention slab 18 | 0.8 | 80 | 0.98 | 2 | 700 | 120 |
| Comparative example 26 | Invention slab 9 | 1.0 | 80 | 0.94 | 2 | 700 | 120 |
| Comparative example 27 | Invention slab 9 | 0.7 | 86 | 1.71 | 2 | 650 | 120 |
| Comparative example 28 | Invention slab 10 | 2.3 | 54 | 1.93 | 2 | 725 | 120 |
| Comparative example 29 | Invention slab 10 | 1.0 | 80 | 0.84 | 4 | 700 | 7200 |
| Comparative example 30 | Invention slab 10 | 1.0 | 80 | 0.84 | 2 | 750 | 120 |
| Comparative example 31 | Invention slab 10 | 1.0 | 80 | 0.84 | 2 | 800 | 120 |
| Comparative example 32 | Invention slab 10 | 1.0 | 80 | 0.84 | 2 | 850 | 120 |
| Comparative example 33 | Invention slab 10 | 0.5 | 90 | 0.42 | 2 | 550 | 1200 |
| Comparative example 34 | Invention slab 17 | 1.2 | 76 | 0.53 | 2 | 600 | 120 |
| Comparative example 35 | Invention slab 15 | 0.8 | 80 | 0.84 | 4 | 675 | 7200 |
| Comparative example 36 | Invention slab 11 | 1.0 | 80 | 0.84 | 2 | 750 | 120 |
| Comparative example 37 | Invention slab 10 | 1.5 | 70 | 1.68 | 2 | 675 | 120 |
| Comparative example 38 | Comparative slab 11 | 1.5 | 70 | 1.56 | 2 | 675 | 120 |
| Comparative example 39 | Comparative slab 12 | 1.0 | 80 | 0.90 | 2 | 700 | 120 |
| Comparative example 40 | Comparative slab 13 | 1.0 | 80 | 0.72 | 2 | 745 | 120 |
| Comparative example 41 | Comparative slab 14 | 1.0 | 86 | 1.27 | 2 | 675 | 60 |

| | Annealing conditions | | | | | | | |
|---|---|---|---|---|---|---|---|---|
| | Lower limit of annealing temperature $650-\sqrt{(ts)}$ ° C. | Upper limit of annealing temperature $750-\sqrt{(ts)}$ ° C. | Start temperature of cooling | Cooling method | Cooling rate ° C./s | Overaging temperature ° C. | Time second | Rate of elongation performed by skin-pass rolling % |
| | | | | | | | | 1~10 |
| Invention example 12 | 648 | 748 | 670 | WQ | 186 | — | — | 4 |
| Invention example 13 | 639 | 739 | 685 | WQ | 215 | — | — | 5 |
| Invention example 14 | 639 | 739 | 695 | WQ | 220 | — | — | 1.5 |
| Invention example 15 | 516 | 616 | 575 | Gas | 16 | — | — | 1.5 |
| Invention example 16 | 646 | 746 | 695 | Spraying with water | 122 | — | — | 1.5 |
| Invention example 17 | 626 | 726 | 645 | Gas | 22 | — | — | 5 |
| Invention example 18 | 639 | 739 | 675 | WQ | 132 | — | — | 1 |
| Invention example 19 | 639 | 739 | 675 | WQ | 132 | — | — | 3 |
| Invention example 20 | 639 | 739 | 675 | WQ | 132 | — | — | 5 |
| Invention example 21 | 639 | 739 | 675 | WQ | 132 | — | — | 10 |
| Invention example 22 | 639 | 739 | 655 | Spraying with water | 115 | — | — | 2 |
| Invention example 23 | 639 | 739 | 655 | Spraying with water | 124 | — | — | 2 |
| Invention example 24 | 639 | 739 | 675 | Gas | 16 | — | — | 1 |
| Invention example 25 | 565 | 665 | 645 | Gas | 12 | — | — | 1 |
| Invention example 26 | 639 | 739 | 695 | Gas | 25 | 500 | 30 | 2 |
| Invention example 27 | 639 | 739 | 685 | WQ | 224 | — | — | 2 |
| Invention example 28 | 647 | 747 | 720 | Gas | 15 | — | — | 3 |
| Invention example 29 | 642 | 742 | 720 | Spraying with water | 125 | 400 | 300 | 1.8 |
| Comparative example 23 | 639 | 739 | 675 | WQ | 132 | — | — | 0 |
| Comparative example 24 | 639 | 739 | 675 | WQ | 132 | — | — | 17 |

TABLE 11-continued

| | | | | | | | | |
|---|---|---|---|---|---|---|---|---|
| Comparative example 25 | 639 | 739 | 695 | Gas | 15 | — | — | 0 |
| Comparative example 26 | 639 | 739 | 695 | Gas | 18 | — | — | 3 |
| Comparative example 27 | 639 | 739 | 645 | Gas | 24 | — | — | 3 |
| Comparative example 28 | 639 | 739 | 720 | Gas | 13 | — | — | 2 |
| Comparative example 29 | 565 | 665 | 685 | Gas | 12 | — | — | 2 |
| Comparative example 30 | 639 | 739 | 745 | Gas | 25 | — | — | 2 |
| Comparative example 31 | 639 | 739 | 795 | Gas | 32 | — | — | 2 |
| Comparative example 32 | 639 | 739 | 845 | Gas | 36 | — | — | 2 |
| Comparative example 33 | 615 | 715 | 545 | Gas | 38 | — | — | 2 |
| Comparative example 34 | 639 | 739 | 595 | Gas | 26 | — | — | 2 |
| Comparative example 35 | 565 | 665 | 660 | Gas | 10 | — | — | 2 |
| Comparative example 36 | 639 | 739 | 745 | Gas | 5 | — | — | 3 |
| Comparative example 37 | 639 | 739 | 670 | WQ | 135 | | | 2 |
| Comparative example 38 | 639 | 739 | 670 | WQ | 128 | — | — | 2 |
| Comparative example 39 | 639 | 739 | 695 | WQ | 125 | — | — | 3 |
| Comparative example 40 | 639 | 739 | 740 | WQ | 133 | — | — | 3 |
| Comparative example 41 | 642 | 742 | 670 | WQ | 125 | — | — | 3 |

WQ: Water quenching

TABLE 12

| | | Annealed structure | | | | | | |
|---|---|---|---|---|---|---|---|---|
| | | | | Ferrite phase | | | | |
| | Composition Symbol | Primary phase | Second phase | Rate of nano ferrite % | Average grain size ds (nanograins) | Average grain size dL (micrograins) | Average grain size df (all grains) | dL/ds |
| | Standard | F | C, M, B, A | 15~90 | | | | ≧3 |
| Invention example 12 | Invention slab 9 | F | C | 66 | 0.47 | 1.43 | 0.52 | 3.1 |
| Invention example 13 | Invention slab 10 | F | C, M | 43 | 0.56 | 1.75 | 0.70 | 3.1 |
| Invention example 14 | Invention slab 10 | F | C, M | 29 | 0.51 | 1.58 | 0.73 | 3.1 |
| Invention example 15 | Invention slab 10 | F | C | 18 | 0.65 | 2.56 | 1.08 | 3.9 |
| Invention example 16 | Invention slab 11 | F | M | 22 | 0.53 | 1.62 | 0.83 | 3.1 |
| Invention example 17 | Invention slab 11 | F | C | 15 | 0.65 | 2.16 | 1.16 | 3.3 |
| Invention example 18 | Invention slab 12 | F | C | 34 | 0.61 | 1.87 | 0.83 | 3.1 |
| Invention example 19 | Invention slab 12 | F | C | 34 | 0.61 | 1.86 | 0.83 | 3.0 |
| Invention example 20 | Invention slab 12 | F | C | 34 | 0.61 | 1.86 | 0.83 | 3.0 |
| Invention example 21 | Invention slab 12 | F | C | 34 | 0.60 | 1.87 | 0.81 | 3.1 |
| Invention example 22 | Invention slab 13 | F | C | 88 | 0.56 | 1.73 | 0.58 | 3.1 |
| Invention example 23 | Invention slab 14 | F | C, M | 88 | 0.47 | 1.53 | 0.48 | 3.3 |
| Invention example 24 | Invention slab 15 | F | C, M | 43 | 0.51 | 1.90 | 0.63 | 3.7 |
| Invention example 25 | Invention slab 15 | F | C | 17 | 0.95 | 5.78 | 1.51 | 6.1 |
| Invention example 26 | Invention slab 16 | F | C, M | 75 | 0.49 | 1.55 | 0.52 | 3.2 |
| Invention example 27 | Invention slab 17 | F | C, M | 55 | 0.56 | 1.84 | 0.65 | 3.3 |
| Invention example 28 | Invention slab 18 | F | C | 17 | 0.78 | 2.56 | 1.34 | 3.3 |
| Invention example 29 | Invention slab 19 | F | C, B, A | 32 | 0.73 | 2.25 | 1.01 | 3.1 |
| Comparative example 23 | Invention slab 12 | F | C | 34 | 0.61 | 1.86 | 0.83 | 3.0 |
| Comparative example 24 | Invention slab 12 | F | C | 33 | 0.60 | 1.86 | 0.82 | 3.1 |
| Comparative example 25 | Invention slab 18 | F | C | 17 | 0.78 | 2.56 | 1.34 | 3.3 |
| Comparative example 26 | Invention slab 9 | F | C | 6 | 0.78 | 3.56 | 1.97 | 4.6 |
| Comparative example 27 | Invention slab 9 | F | C | 0 | — | 5.52 | 5.52 | — |
| Comparative example 28 | Invention slab 10 | F | P | 0 | — | 8.70 | 8.70 | — |
| Comparative example 29 | Invention slab 10 | F | C, M | 8 | 0.88 | 3.45 | 1.98 | 3.9 |
| Comparative example 30 | Invention slab 10 | F | M | 0 | — | 7.60 | 7.60 | — |
| Comparative example 31 | Invention slab 10 | F | M | 0 | — | 4.89 | 4.89 | — |
| Comparative example 32 | Invention slab 10 | F | M | 0 | — | 1.45 | 1.45 | — |
| Comparative example 33 | Invention slab 10 | F | C | 99 | 0.39 | 1.47 | 0.39 | 3.8 |
| Comparative example 34 | Invention slab 17 | F | C | 99 | 0.43 | 1.69 | 0.43 | 3.9 |
| Comparative example 35 | Invention slab 15 | F | C, M | 5 | 0.82 | 2.89 | 2.07 | 3.5 |
| Comparative example 36 | Invention slab 11 | F | P | 0 | — | 5.80 | 5.80 | — |
| Comparative example 37 | Comparative slab 10 | F | C | 0 | — | 8.57 | 8.57 | — |
| Comparative example 38 | Comparative slab 11 | F | C | 0 | — | 9.06 | 9.06 | — |
| Comparative example 39 | Comparative slab 12 | F | C | 66 | 0.64 | 1.55 | 0.71 | 2.4 |
| Comparative example 40 | Comparative slab 13 | F | M, C | 32 | 0.52 | 1.65 | 0.72 | 3.2 |
| Comparative example 41 | Comparative slab 14 | F | C | 0 | — | 8.9 | 8.90 | — |

TABLE 12-continued

| | Annealed structure Second phase | | | | | Static material characteristics | | | Dynamic material characteristics | |
|---|---|---|---|---|---|---|---|---|---|---|
| | Average area ratio A(ave) % | Standard deviations | s/ A(ave) | Average grain size | df/ dp | TS MPa | BH MPa | Overall elongation t-El % | Overall elongation t-El % | Difference between static and dynamic strengths Δσ MPa |
| | 3~30 | | ≦0.6 | | ≧3 | | | | | |
| Invention example 12 | 3 | 1.7 | 0.53 | 0.11 | 4.7 | 770 | 32 | 23 | 24 | 223 |
| Invention example 13 | 9 | 5.1 | 0.58 | 0.14 | 5.0 | 729 | 91 | 30 | 26 | 125 |
| Invention example 14 | 19 | 8.8 | 0.46 | 0.23 | 3.2 | 792 | 38 | 29 | 34 | 178 |
| Invention example 15 | 4 | 2.2 | 0.55 | 0.14 | 7.7 | 528 | 68 | 35 | 30 | 212 |
| Invention example 16 | 25 | 13.5 | 0.54 | 0.13 | 6.4 | 629 | 25 | 34 | 35 | 157 |
| Invention example 17 | 3 | 1.7 | 0.57 | 0.11 | 10.6 | 555 | 17 | 29 | 30 | 143 |
| Invention example 18 | 4 | 2 | 0.50 | 0.12 | 6.9 | 588 | 12 | 33 | 25 | 137 |
| Invention example 19 | 4 | 2.1 | 0.53 | 0.12 | 6.9 | 590 | 14 | 32 | 29 | 128 |
| Invention example 20 | 4 | 1.9 | 0.48 | 0.12 | 6.9 | 594 | 15 | 30 | 29 | 125 |
| Invention example 21 | 4 | 2.1 | 0.53 | 0.12 | 6.8 | 610 | 12 | 26 | 27 | 118 |
| Invention example 22 | 12 | 5 | 0.42 | 0.18 | 3.2 | 802 | 5 | 30 | 25 | 128 |
| Invention example 23 | 16 | 6 | 0.38 | 0.15 | 3.2 | 882 | 8 | 29 | 23 | 119 |
| Invention example 24 | 7 | 3.4 | 0.49 | 0.13 | 4.9 | 617 | 85 | 33 | 27 | 161 |
| Invention example 25 | 5 | 2.5 | 0.50 | 0.18 | 8.4 | 486 | 68 | 31 | 30 | 158 |
| Invention example 26 | 22 | 10 | 0.45 | 0.17 | 3.1 | 703 | 43 | 31 | 26 | 141 |
| Invention example 27 | 28 | 14 | 0.50 | 0.21 | 3.1 | 845 | 122 | 29 | 30 | 120 |
| Invention example 28 | 4 | 1.6 | 0.46 | 0.11 | 12.1 | 492 | 22 | 30 | 26 | 220 |
| Invention example 29 | 11 | 5 | 0.45 | 0.15 | 67 | 752 | 80 | 20 | 30 | 168 |
| Comparative example 23 | 4 | 2 | 0.50 | 0.12 | 6.9 | 590 | 12 | 35 | 21 | 178 |
| Comparative example 24 | 4 | 2.1 | 0.53 | 0.12 | 6.8 | 610 | 6 | 15 | 17 | 123 |
| Comparative example 25 | 4 | 1.6 | 0.46 | 0.11 | 12.1 | 492 | 22 | 30 | 17 | 237 |
| Comparative example 26 | 3 | 2.8 | 0.93 | 0.11 | 17.9 | 588 | 23 | 21 | 18 | 125 |
| Comparative example 27 | 4 | 1.7 | 0.49 | 0.13 | 42.5 | 685 | 0 | 12 | 11 | 65 |
| Comparative example 28 | 5 | 4.6 | 0.92 | 0.12 | 72.5 | 632 | 18 | 24 | 23 | 66 |
| Comparative example 29 | 8 | 6.8 | 0.85 | 1.30 | 1.5 | 555 | 5 | 33 | 35 | 102 |
| Comparative example 30 | 35 | 28 | 0.83 | 3.50 | 2.2 | 774 | 26 | 24 | 27 | 72 |
| Comparative example 31 | 48 | 35 | 0.73 | 5.6 | 0.9 | 896 | 24 | 25 | 27 | 82 |
| Comparative example 32 | 85 | 14 | 0.16 | 13 | 0.1 | 1174 | 12 | 22 | 20 | 83 |
| Comparative example 33 | 6 | 1.8 | 0.30 | 0.12 | 3.3 | 870 | 8 | 19 | 17 | 97 |
| Comparative example 34 | 2 | 1.8 | 0.90 | 0.10 | 4.3 | 1132 | 0 | 11 | 11 | 107 |
| Comparative example 35 | 6 | 5.6 | 0.93 | 1.20 | 1.7 | 587 | 3 | 33 | 34 | 74 |
| Comparative example 36 | 18 | 1.8 | 0.10 | 3.20 | 1.8 | 550 | 24 | 32 | 33 | 90 |
| Comparative example 37 | 7 | 5.9 | 0.82 | 0.48 | 17.9 | 584 | 5 | 31 | 23 | 68 |
| Comparative example 38 | 6 | 5.6 | 0.93 | 0.38 | 23.8 | 469 | 6 | 33 | 24 | 75 |
| Comparative example 39 | 13 | 5.5 | 0.44 | 0.11 | 6.5 | 1236 | 23 | 4 | 5 | 70 |
| Comparative example 40 | 4 | 1.2 | 0.34 | 0.23 | 3.1 | 969 | 14 | 10 | 11 | 84 |
| Comparative example 41 | 2 | 0.9 | 0.45 | 0.07 | 127. | 388 | 3 | 36 | 18 | 165 |

P: pearlite
C: cementite
M: martensite
B: bainite
A: residual austenite

Figure 9:
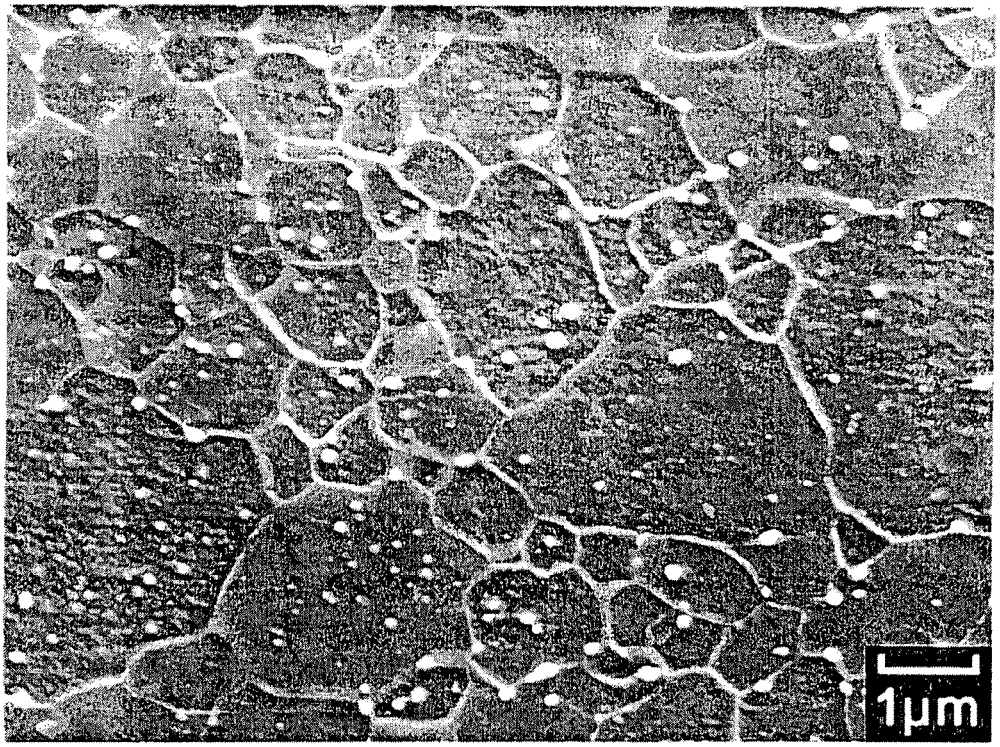
FIG. 9 is a SEM image showing a structure of a high-strength steel sheet of an example of the present invention after cold rolling.

A cross section parallel to the rolling direction was cut out from the steel sheet of invention example 18 and etched with a solution of 1% of nitric acid and ethanol, so that structure thereof could be observed by SEM. The structure is shown in FIG. 9. Grain distribution in a ferrite phase of the invention example 18 was measured, and the results thereof are shown in FIG. 10.

Figure 10:
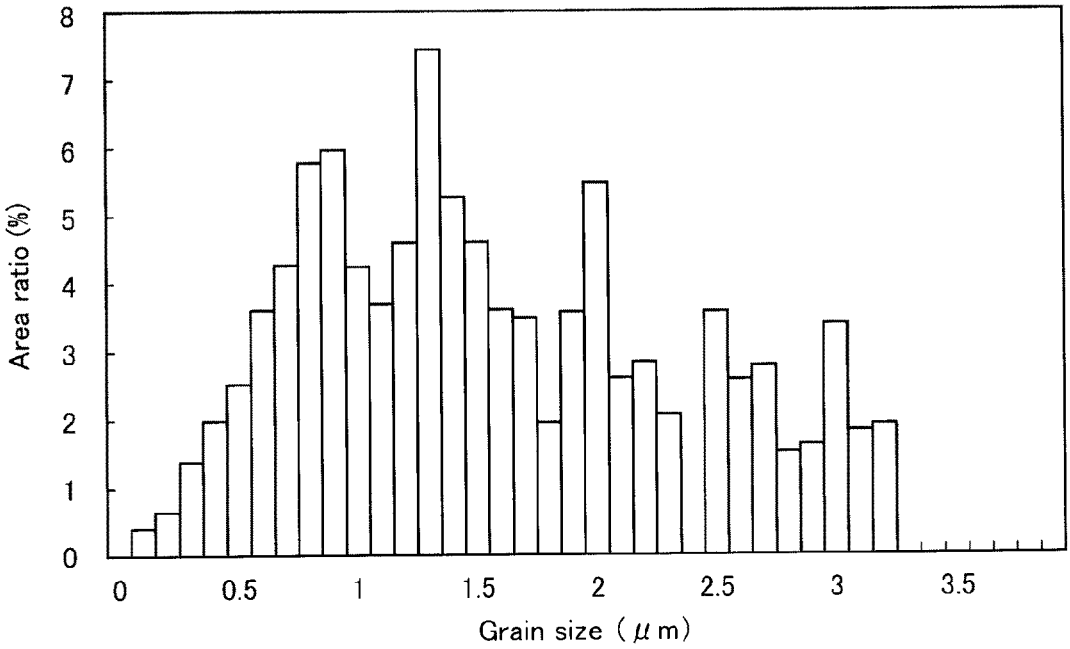
FIG. 10 is a graph showing grain size distribution of ferrite phase of an example of the present invention.

As shown in FIGS. 9 and 10, the steel sheet had a mixed structure including cementite as a hard second phase and including nanograins and micrograms as the rest.

Figure 14:
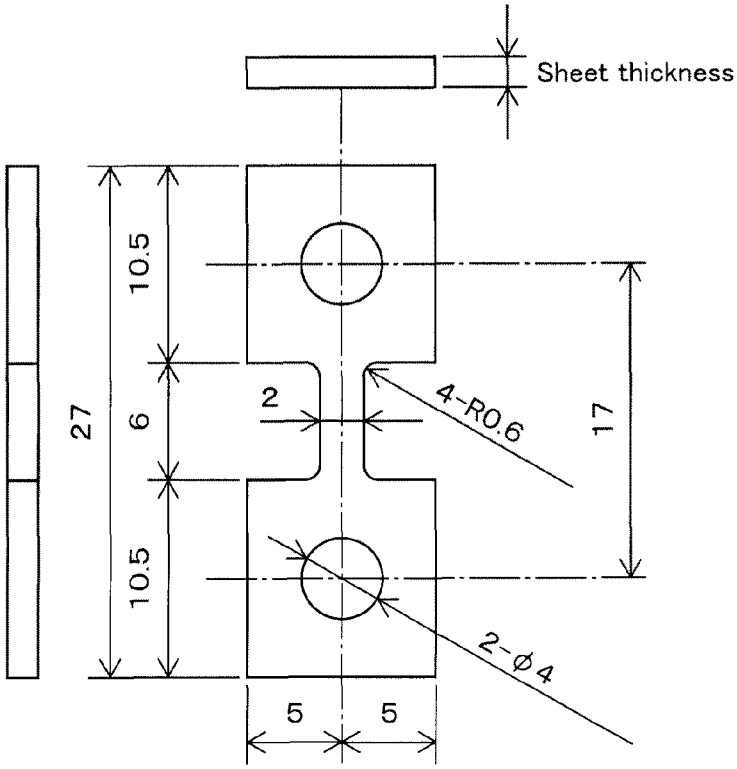
FIG. 14 is a drawing showing a shape of a test specimen used in a high-speed tensile test.

Test specimens for tensile tests having a shape shown in FIG. 14 were cut out from each steel sheet so as to have a tension axis parallel to the rolling direction, and tensile tests were preformed thereon. The tensile test was performed at 0.01/s and 1000/s of strain rate by a high-speed material testing machine TS-2000 manufactured by Saginomiya Seisakusyo, Inc. Static tensile strength (TS), amount of bake hardening (BH), overall elongation, and difference between static and dynamic strengths were determined by a nominal stress-nominal strain diagram that was obtained. An average nominal stress at 3 to 5% of nominal strain obtained when the strain rate was 0.01/s was subtracted from an average nominal stress at 3 to 5% of nominal strain obtained when the strain rate was 1000/s, whereby the difference between static and dynamic strengths was calculated. These results are also shown in Table 12.

Evaluation of Invention Examples 12 to 29

In the invention examples 12 to 29, each steel sheet had superior material characteristics, and specifically, the differences between static and dynamic strengths were large. Therefore, the steel sheet of each invention example may exhibit high strength in rapid deformation, superior absorption characteristics of impact energy, and high workability, whereby the steel sheet may be used for automobile bodies. In the invention example 12, although the area ratio of the hard second phase of the hot-rolled steel sheet was 12% that was close to the lower limit, since the ratio of nanograins after cold rolling and annealing was increased by repeatedly performing accumulative roll-bonding, the invention example 12 exhibited good characteristics. This result indicates that a predetermined structure can be obtained by performing accumulative roll-bonding even when the area ratio of the hard second phase of a hot-rolled steel sheet is approximately 10% and is small.

Evaluation of Comparative Examples 23 to 41

In the comparative examples 27 to 40, each steel sheet had small difference in static and dynamic strengths. Therefore, the steel sheets of the comparative examples 27 to 40 may not exhibit high strength in rapid deformation, superior absorption characteristics of impact energy, and high workability, whereby using the steel sheets for automobile bodies is not desirable. The other comparative examples such as the comparative example 23 exhibited 170 MPa or more of a difference between static and dynamic strengths, but the other characteristics such as elongation were inferior to those of the invention examples. Specifically, in the comparative example 23, since the skin-pass rolling was not performed thereto, the difference between static and dynamic strengths was large, but the overall elongation in rapid deformation was small.

VARIATIONS OF THE PRESENT INVENTION

In the present invention, a hot dip galvanized steel sheet and a hot dip galvannealed steel sheet may be obtained by plating a steel sheet at annealing in addition to the above-described production method. A steel sheet may be iron plated in an electroplating line after hot dip galvanizing in order to improve corrosion resistance. Moreover, an electrogalvanized steel sheet and an electrogalvanized steel sheet with a Ni—Zn alloy may be obtained by plating in an electroplating line after annealing the steel of the present invention. Furthermore, organic coating treatment may be applied to a steel sheet in order to improve corrosion resistance.

For purpose of comparison, Table 13 shows characteristics of commercial materials. According to Table 13, each commercial material 1 to 5 had a smaller difference between static and dynamic strengths than that of each invention example shown in Table 12. Therefore, the steel sheet of each invention example had a superior balance of strength in rapid deformation, absorption characteristics of impact energy, and workability, compared to that of conventional commercial materials.

TABLE 13

| No. | Material standard (Japan Iron and Steel Federation) | Sheet thickness mm | Structure: Primary phase | Structure: Second phase | Rate of nano ferrite % | Material characteristics: TS MPa | Material characteristics: Overall elongation t-El % | Dynamic material characteristics: Overall elongation t-El % | Dynamic material characteristics: Difference of static and dynamic strengths Δσ MPa |
|---|---|---|---|---|---|---|---|---|---|
| Commercial material 1 | JSC440W | 1.6 | F | C | 0 | 462 | 36 | 33 | 97 |
| Commercial material 2 | JSC590Y | 1.0 | F | M | 0 | 651 | 28 | 25 | 68 |
| Commercial material 3 | JSC780Y | 1.6 | F | M | 0 | 842 | 24 | 20 | 46 |
| Commercial material 4 | JSC980Y | 1.6 | F | M | 0 | 1005 | 16 | 15 | 72 |
| Commercial material 5 | JSC1180Y | 1.8 | F | M | 0 | 1272 | 7 | 6 | 65 |

Figure 11:
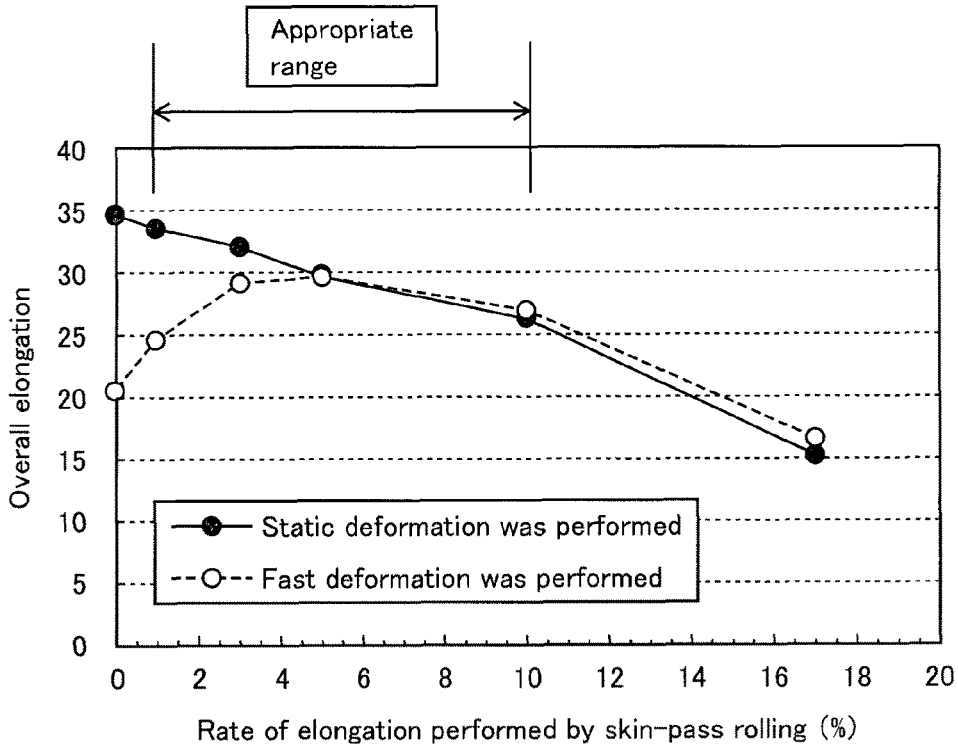
FIG. 11 is a graph showing a relationship between rate of elongation performed by skin-pass rolling and overall elongation in an example of the present invention.

FIG. 11 shows a relationship between elongation rate and overall elongation performed by skin-pass rolling, and Table 14 shows the results of the examples shown in FIG. 11. The overall elongation at static deformation was decreased as the rate of elongation performed by the skin-pass rolling was increased, whereas the overall elongation at rapid deformation was increased until the elongation rate was increased to approximately 5%. This result indicates that the amount of absorption energy during rapid deformation increases. The amount of absorption energy during rapid deformation was large when the elongation rate was 1 to 10%, whereby the elongation rate is appropriately set to be 1 to 10%.

TABLE 14

| No. | Rate of elongation performed by skin-pass rolling % | Material characteristics: TS MPa | Static characteristics: 3 to 5% deformation stress σs MPa | Static characteristics: Overall elongation t-El % | Dynamic characteristics: 3 to 5% deformation stress σd MPa | Dynamic characteristics: Overall elongation t-El % | Difference between static and dynamic strengths Δσ |
|---|---|---|---|---|---|---|---|
| Comparative example 23 | 0 | 590 | 576 | 35 | 754 | 21 | 178 |
| Invention example 18 | 1 | 588 | 572 | 33 | 709 | 25 | 137 |
| Invention example 19 | 3 | 590 | 563 | 32 | 691 | 29 | 128 |

TABLE 14-continued

| No. | Rate of elongation performed by skin-pass rolling % | Material characteristics: TS MPa | Static characteristics: 3 to 5% deformation stress σs MPa | Static characteristics: Overall elongation t-El % | Dynamic characteristics: 3 to 5% deformation stress σd MPa | Dynamic characteristics: Overall elongation t-El % | Difference between static and dynamic strengths Δσ |
|---|---|---|---|---|---|---|---|
| Invention example 20 | 5 | 594 | 581 | 30 | 706 | 29 | 125 |
| Invention example 21 | 10 | 610 | 606 | 26 | 724 | 27 | 118 |
| Comparative example 24 | 17 | 610 | 610 | 15 | 733 | 17 | 123 |

Figure 12:
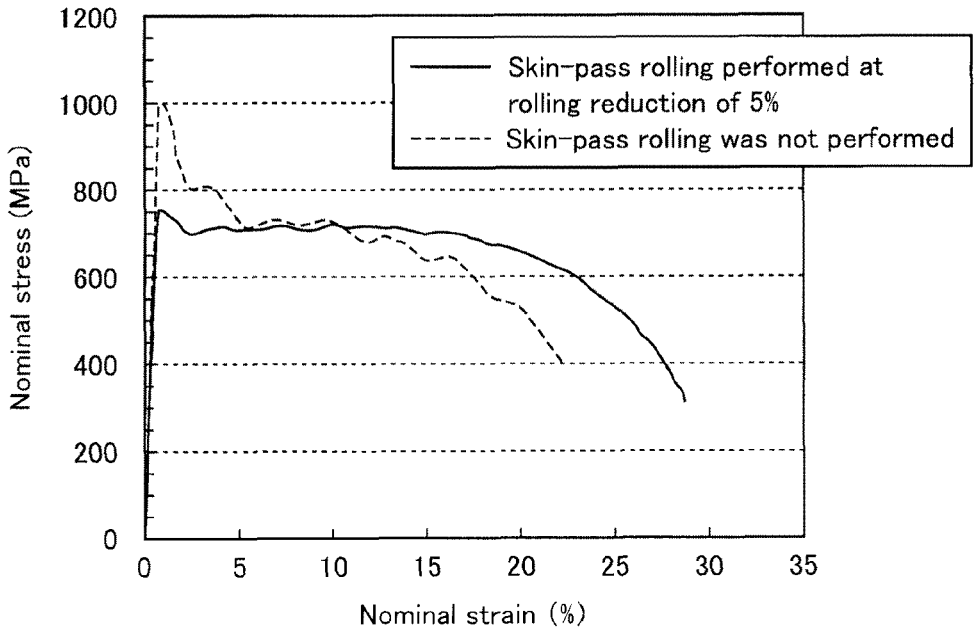
FIG. 12 is a graph showing stress-strain curves at rapid deformation in an example.
Figure 13:
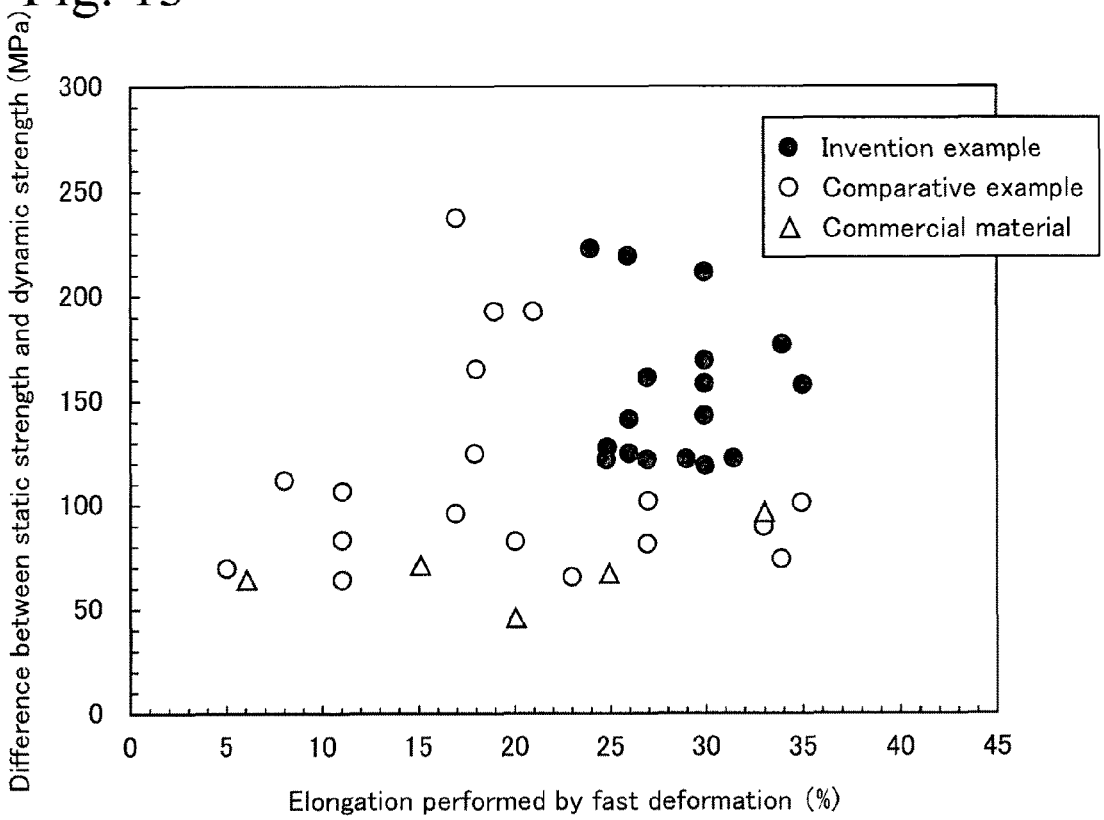
FIG. 13 is a graph showing a relationship between elongation at rapid deformation and difference between static and dynamic strengths in an example.

FIG. 12 shows stress-strain curves of a material formed by skin-pass rolling and a material that was not formed by skin-pass rolling. As shown in FIG. 12, the yield point was lowered by performing skin-pass rolling, and deformation occurred by smaller stress. FIG. 13 shows a relationship of elongation in rapid deformation and a difference between static and dynamic strengths. FIG. 13 clearly shows that the elongations and the differences of static and dynamic strengths of the invention examples were superior to those of the commercial materials and the comparative examples.

INDUSTRIAL APPLICABILITY

According to the present invention, a high-strength steel sheet and a production method therefor are provided. By refining ferrite grains, the high-strength steel sheet is strengthened and has a superior balance of strength and ductility required in press forming and superior absorption characteristics of impact energy at rapid deformation. Moreover, according to the present invention, by refining the ferrite grains, the strength of a steel sheet is improved, and a high-strength steel sheet having a large difference between static and dynamic strengths and is easily press formed is obtained. In addition, the high-strength steel sheet exhibits high ductility and absorbs large amounts of energy during rapid deformation. Therefore, the present invention may be used for automobile bodies that require high strength during rapid deformation, superior absorption characteristics of impact energy, and high workability, and the present invention thereby has advantages.

The invention claimed is:

1. A high-strength steel sheet comprising:

a metallic structure consisting of a ferrite phase and a hard second phase dispersed in the ferrite phase;

the hard second phase in the metallic structure having an area ratio of 30 to 70%; and the ferrite composed of grains L having a grain size of greater than 1.2 μm and grains s having a grain size of less than 1.2 μm, the grains s having an area ratio of 15 to 90% in the ferrite phase, wherein ds is an average grain size of the grains s of the ferrite of which grain sizes are not more than 1.2 μm, dL is an average grain size of the grains L of the ferrite of which grain sizes are more than 1.2 μm, and ds and dL satisfy the following equation (1):

$$dL/ds \geqq 3 \quad (1).$$

2. The high-strength steel sheet according to claim 1, wherein when i=not less than 9 pieces of 3 μm square area are optionally selected in a cross section parallel to a rolling direction of the steel sheet, the following equation (2) is satisfied:

$$s/A(ave) \leqq 0.6 \quad (2)$$

wherein:

A is an area ratio of hard second phases in each area;

A(ave) is an average of Ai(i=1, 2, 3, . . . ) which is an area ratio of hard second phases in each area; and s is a standard deviation of A(ave).

3. The high-strength steel sheet according to claim 1, wherein the steel sheet comprises C and at least one selected from the group consisting of Si, Mn, Cr, Mo, Ni, and B, and C(ss) satisfies the following equations (7) to (9) on the basis of the following equations (3) to (6):

$$F_1(Q)=0.65Si+3.1Mn+2Cr+2.3Mo+0.3Ni+2000B \quad (3)$$

$$F_2(T)=735+19Si-31Mn-12Ni+17Mo+20Cr+30V-800N \quad (4)$$

$$F_3(S)=112Si+98Mn+218P+317Al+9Cr+56Mo+8Ni+1417B \quad (5)$$

$$F_4(G)=620+300C+0.5\times F_3(S) \quad (6)$$

$$F_1(Q) \geqq 6.0 \quad (7)$$

$$F_2(T) \leqq F_4(G)-20 \quad (8)$$

$$0.07 \leqq C(ss) \leqq 0.45 \quad (9)$$

wherein component ratios (mass %) of the addition elements are substituted for each of the addition elements in equations (3), (4), (5), and (6);

wherein C(ss) represents the amount of solid-solved carbon calculated by subtracting amount of C combined with Nb, Ti, and V from total amount of C.

4. The high-strength steel sheet according to claim 3, wherein compositions thereof satisfy the following equations (12) and (13) on the basis of the following equations (10) and (11):

$$F_3(S)=112Si+98Mn+218P+317Al+9Cr+56Mo+8Ni+1417B \quad (10)$$

$$F_5(P)=500\times Nb+1000\times Ti+250\times V \quad (11)$$

$$F_3(S) \leqq 600 \quad (12)$$

$$F_5(P) \leqq 130 \quad (13)$$

wherein component ratios (mass %) of the addition elements are substituted for each of the addition elements in equations (10) and (11).

5. The high-strength steel sheet according to claim 3, wherein the steel sheet comprises at least one of not more than 0.26 mass % of Nb, not more than 0.13 mass % of Ti, and not more than 0.52 mass % of V.

6. The high-strength steel sheet according to claim 4, wherein the steel sheet comprises at least one of not more than 2 mass % of P and not more than 18 mass % of Al.

7. The high-strength steel sheet according to claim 3, wherein the steel sheet comprises 0.007 to 0.03 mass % of N.

8. The high-strength steel sheet according to claim 3, wherein the steel sheet comprises, all by mass %, not more than 5% of Si, not more than 5% of Mn, not more than 1.5% of Cr, not more than 0.7% of Mo, not more than 10% of Ni, and not more than 0.003% of B.

* * * * *